US011602682B2

(12) United States Patent
Anderson et al.

(10) Patent No.: US 11,602,682 B2
(45) Date of Patent: Mar. 14, 2023

(54) ROTATION POWERED VEHICLE

(71) Applicant: RXF Motions, Lompoc, CA (US)

(72) Inventors: Steven Craig Anderson, Lompoc, CA (US); Philip R. Dinter, Lompoc, CA (US)

(73) Assignee: RXF Motions, Lompoc, CA (US)

( * ) Notice: Subject to any disclaimer, the term of this patent is extended or adjusted under 35 U.S.C. 154(b) by 129 days.

(21) Appl. No.: 17/316,059

(22) Filed: May 10, 2021

(65) Prior Publication Data

US 2021/0402284 A1 Dec. 30, 2021

Related U.S. Application Data

(60) Continuation of application No. 16/541,925, filed on Aug. 15, 2019, now Pat. No. 11,027,188, which is a division of application No. 15/955,284, filed on Apr. 17, 2018, now Pat. No. 10,434,399, which is a continuation of application No. 15/425,665, filed on Feb. 6, 2017, now Pat. No. 9,975,034, which is a continuation of application No. 14/777,089, filed as application No. PCT/US2014/027542 on Mar. 14, 2014, now Pat. No. 9,597,579.

(60) Provisional application No. 61/789,462, filed on Mar. 15, 2013.

(51) Int. Cl.
*A63C 17/12* (2006.01)
*A63C 17/01* (2006.01)

(52) U.S. Cl.
CPC ..... *A63C 17/12* (2013.01); *A63C 17/012* (2013.01); *A63C 17/015* (2013.01)

(58) Field of Classification Search
CPC ..... A63C 17/12; A63C 17/012; A63C 17/015
See application file for complete search history.

(56) References Cited

U.S. PATENT DOCUMENTS 4,123,080 A * 10/1978 Agajanian ..... A63C 17/015 280/220
4,861,054 A * 8/1989 Spital ..... A63C 17/015 280/11.115
4,915,403 A * 4/1990 Wild ..... A63C 17/12 280/258
5,224,719 A * 7/1993 Goodspeed ..... A63C 17/015 280/11.115
5,280,935 A * 1/1994 Sobocan ..... A63C 17/12 280/11.115
5,310,202 A * 5/1994 Goodspeed ..... A63C 17/12 280/11.115
5,492,345 A * 2/1996 Kruczek ..... A63C 17/12 280/11.115
5,839,737 A * 11/1998 Kruczek ..... A63C 17/01 280/258
5,997,018 A * 12/1999 Lee ..... A63C 17/1409 280/11.28

(Continued)

*Primary Examiner* — Erez Gurari
(74) *Attorney, Agent, or Firm* — Felix L. Fischer

(57) ABSTRACT

Device and method embodiments for a rotation powered vehicle are described, the rotation powered vehicle being capable of converting a rotational motion of a platform pivotally secured to the rotation powered vehicle in either of two angular directions into a linear motion of the rotation powered vehicle in a single linear direction for the purposes of conveyance. In some cases, the angular motion of the platform may be slight when compared to the resultant linear powered stroke of the rotation powered vehicle.

10 Claims, 36 Drawing Sheets

(56) References Cited

U.S. PATENT DOCUMENTS

| | | | | | |
|---|---|---|---|---|---|
| 6,007,074 | A * | 12/1999 | Tarng | A63C 17/12 | 280/11.115 |
| 6,050,357 | A * | 4/2000 | Staelin | A63C 17/01 | 180/181 |
| 6,536,788 | B1 * | 3/2003 | Kuncz | A63C 17/01 | 280/87.041 |
| 6,739,603 | B1 * | 5/2004 | Powell | A63C 17/012 | 280/11.27 |
| 7,980,573 | B1 * | 7/2011 | Naman | A63C 17/12 | 280/87.041 |
| 9,375,632 | B1 * | 6/2016 | Kish | A63C 17/015 | |
| 9,987,546 | B1 * | 6/2018 | Clos | A63C 17/015 | |
| 2003/0042059 | A1 * | 3/2003 | Tsai | B62M 1/28 | 180/181 |
| 2007/0262546 | A1 * | 11/2007 | Bertiller | B60L 50/52 | 74/502.2 |
| 2007/0290477 | A1 * | 12/2007 | Lee | A63C 17/12 | 280/242.1 |
| 2008/0061521 | A1 * | 3/2008 | Ng | A63C 17/12 | 280/11.115 |
| 2014/0332297 | A1 * | 11/2014 | Palacio | A63C 17/1454 | 180/181 |
| 2016/0045814 | A1 * | 2/2016 | Zhou | A63C 17/12 | 280/221 |

* cited by examiner

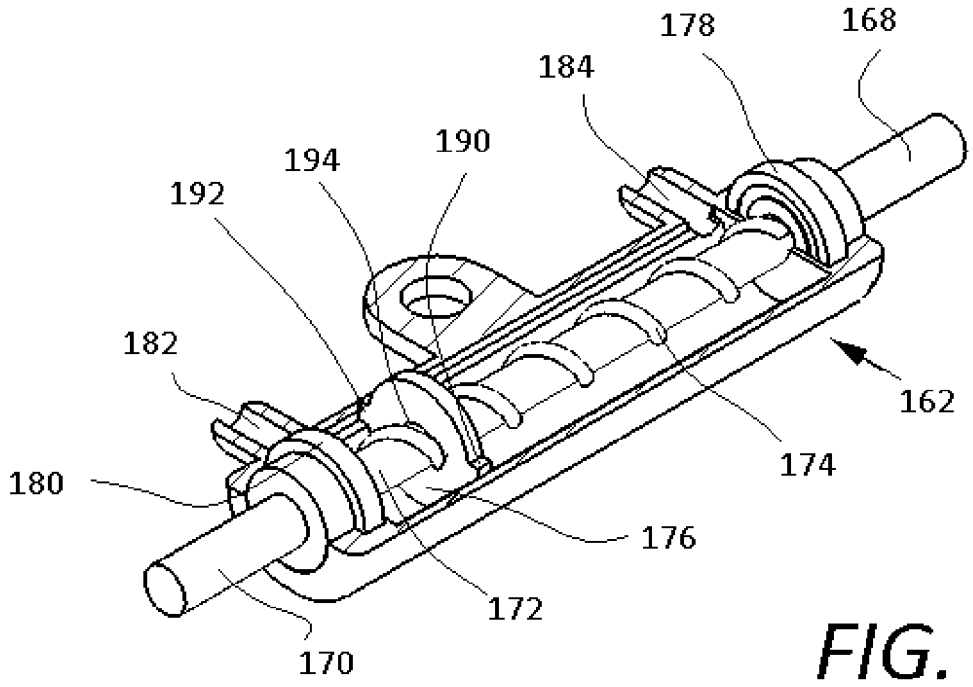
FIG. 17
FIG. 18
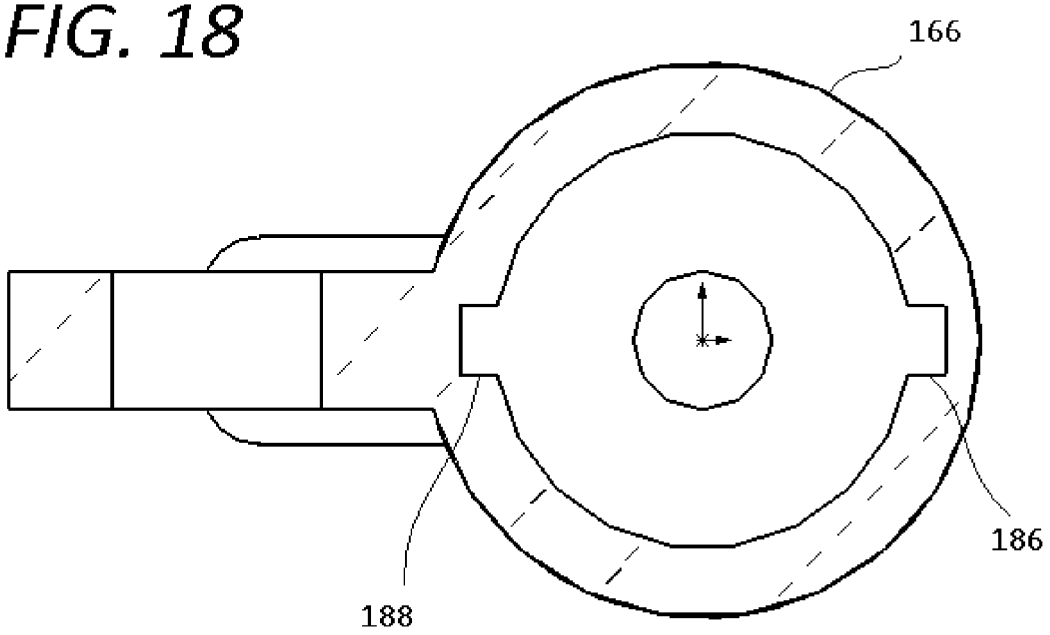

FIG. 27
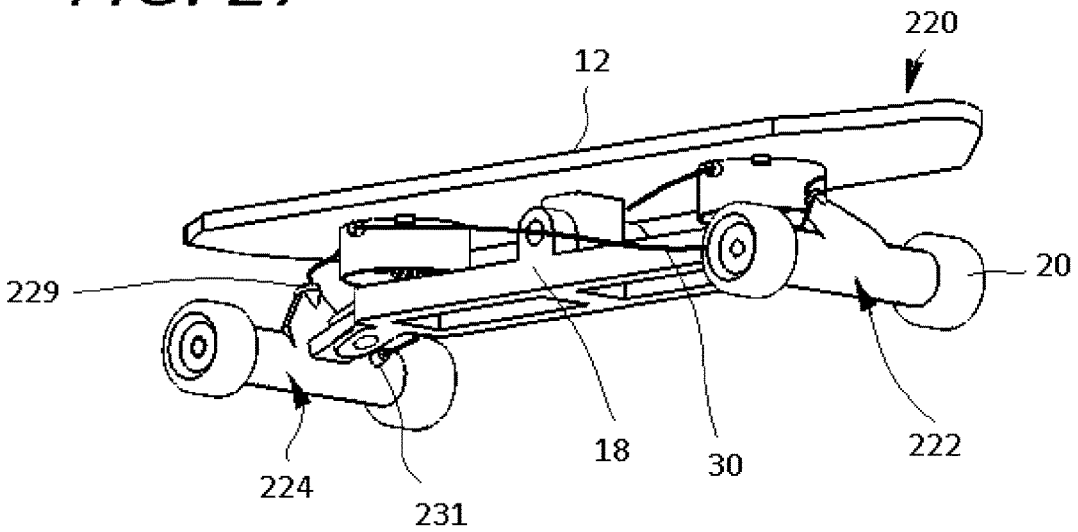
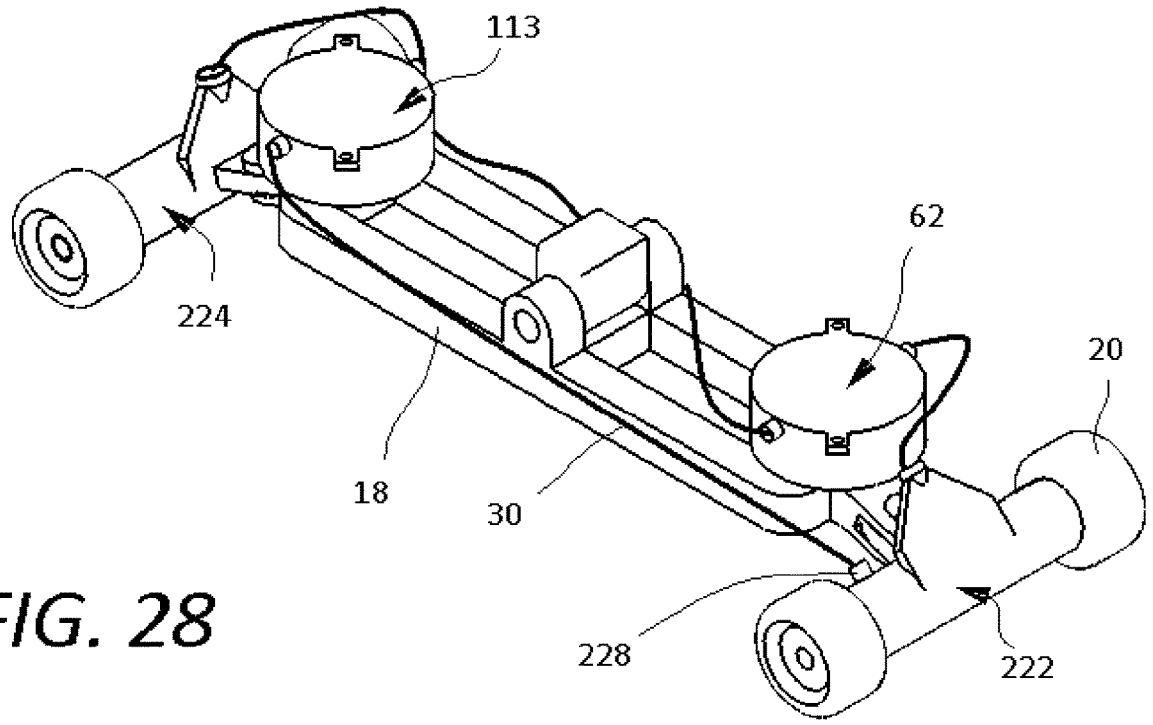
FIG. 28

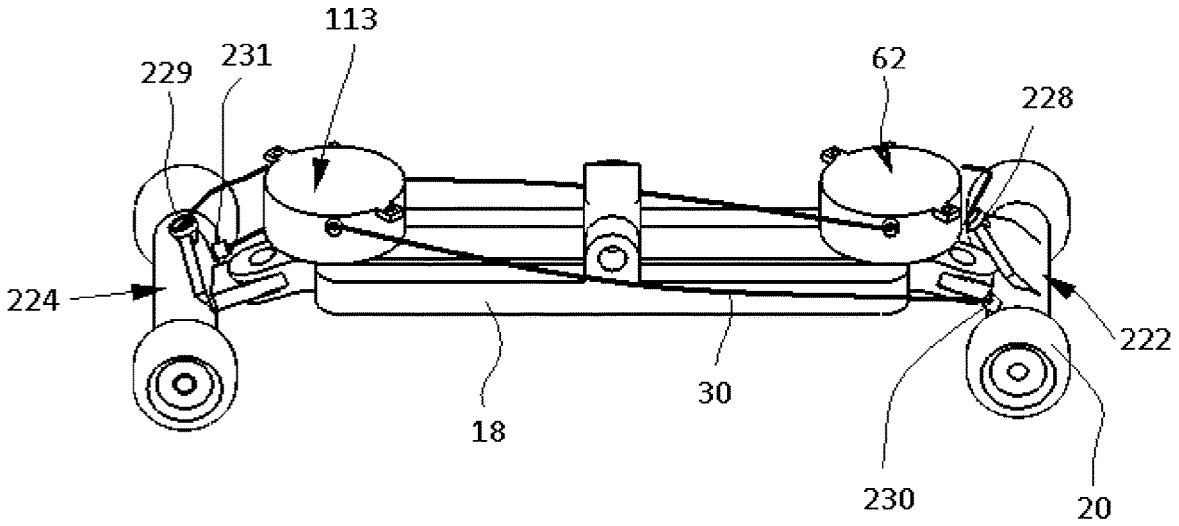
FIG. 29
FIG. 30
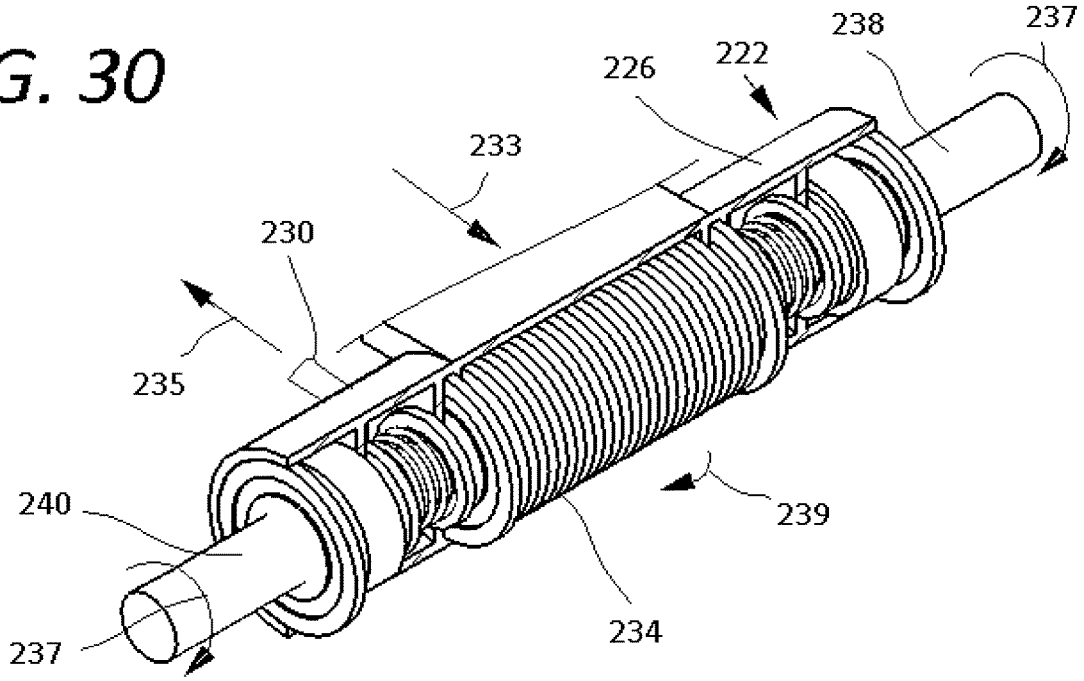

ROTATION POWERED VEHICLE

REFERENCE TO RELATED APPLICATIONS

This application is a continuation of application Ser. No. 16/541,925 filed on Aug. 15, 2019 which is a divisional application of Ser. No. 15/955,284 filed on Apr. 17, 2018 which is a continuation of application Ser. No. 15/425,665 filed on Feb. 6, 2017 which is a continuation of application Ser. No. 14/777,089 having a 371(c) date of Sep. 15, 2015 based on Patent Cooperation Treaty application serial no. PCT/US14/27542 having an international filing date of Mar. 14, 2014 entitled ROTATION POWERED VEHICLE which claims priority of U.S. provisional application Ser. No. 61/789,462 filed on Mar. 15, 2013, the disclosures of which are incorporated herein by reference.

BACKGROUND

There are a variety of power methods and devices for the purposes of providing a motive force to skateboards. These methods may include but are not limited to gas power via a gasoline engine attached to the skateboard and electric motors attached to the skateboard. These methods are convenient for a rider of the board but are damaging to the environment. Other "human" power methods may include skateboards that use a "serpentine" motion of the board in order to provide a motive force, or a rider of the skateboard may simply "kick" themselves along by dropping one foot to the ground while riding the board. These human powered methods are less convenient for a rider of the skateboard. Finally, some scooter designs rely on the rotation of the board a rider stands on in one direction in order to provide power to the wheels. These scooter designs require the board to be rotated through a very large angle with respect to the ground, thus requiring that a scooter handle be in place for the rider to hold onto. These scooter designs also only power the scooter when the board rotates in one direction. What have been needed are devices and methods which provide environmentally sound strategies such as mechanical or hydraulic drive mechanisms which are configured to power the board efficiently over long distances with a minimum effort from the rider. Further, the board must be configured such that a rider of the board can easily and intuitively steer it.

SUMMARY

Some embodiments are directed at a rotation powered vehicle, the rotation powered vehicle may include a rigid chassis having a plurality of axles secured to the chassis. The rotation powered vehicle may also include a plurality of wheels which may be secured to the axles. The rotation powered vehicle may also include a rigid platform which is pivotally secured to the chassis, with the rigid platform being capable of rotating in a first angular direction or in a second angular direction with respect to the chassis. The rotation powered vehicle may also include a first drive mechanism which is configured to convert a rotational motion of the platform in the first angular direction into a transnational motion of the rotation powered board in a first linear direction. The rotation powered board may also include a second drive mechanism which is configured to convert a rotational motion of the platform in the second angular direction into a transnational motion of the rotation powered board in a first linear direction.

Some embodiments are directed at methods for propelling a rotation powered vehicle. The methods may include performing a first half power cycle by rotating a rigid platform which is pivotally secured to a chassis in a first angular direction thereby activating a first drive mechanism which is configured to convert a rotational motion of the platform in the first angular direction into a rotational motion of a plurality of wheels in the first angular direction, the wheels being engaged to a plurality of axles which are secured to the chassis. The rotational motion of the plurality of wheels in the first angular direction results in a transnational motion of the rotation powered vehicle in a first linear direction. The methods may also include performing a second half power cycle by rotating the rigid platform which is pivotally secured to the chassis in a second angular direction thereby activating a second drive mechanism which is configured to convert a rotational motion of the platform in the second angular direction into a rotational motion of a plurality of the wheels in the first angular direction, with the wheels being engaged to a plurality of the axles which are secured to the chassis. Again the rotational motion of the plurality of wheels in the first angular direction results in a transnational motion of the rotation powered vehicle in a first linear direction.

BRIEF DESCRIPTION OF DRAWINGS

FIG. 17 depicts the dual direction plunger drive embodiment of FIG. 16 with a turbine body shown in cross section such that a plunger and a screw drive are visible.

FIG. 18 depicts a cross section of the turbine body of FIG. 16 showing slots which guide the plunger shown in FIG. 17.

FIGS. 27-29 depict an embodiment of a rotation powered vehicle which incorporates multiple Tessla drives.

FIG. 30 depicts a sectional view of a Tessla turbine drive of the embodiment of a rotation powered vehicle of FIG. 27.

DETAILED DESCRIPTION

Figure 1:
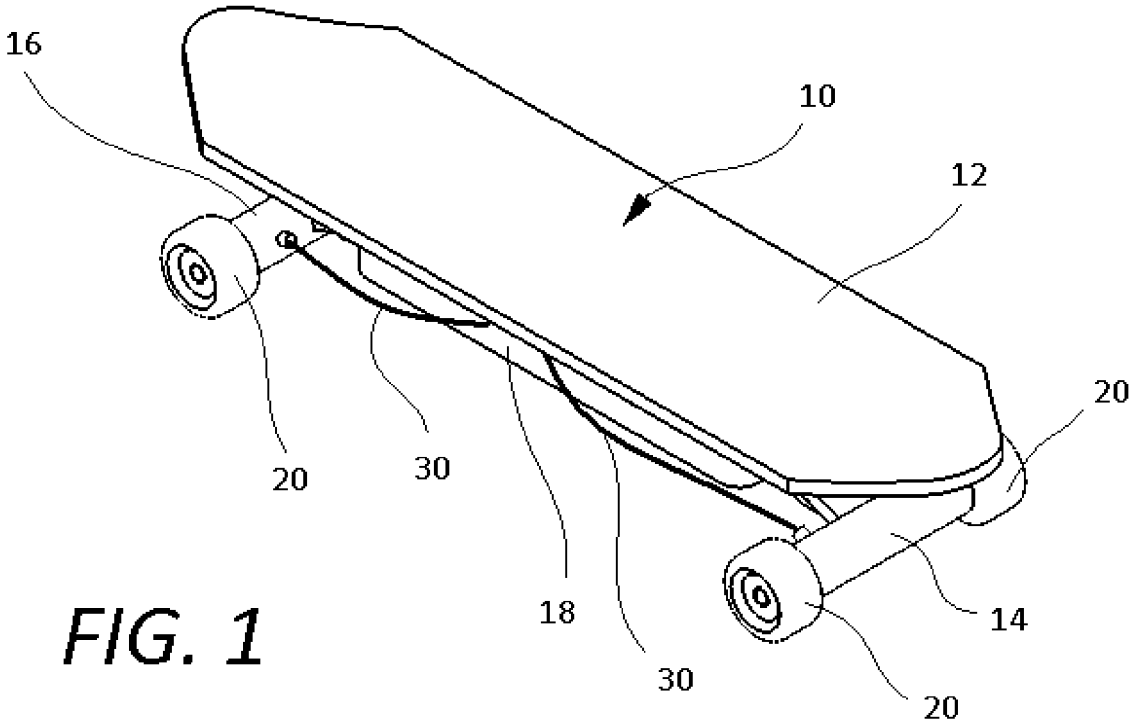
FIGS. 1 and 2 are different views of an embodiment of a rotation powered vehicle having multiple screw turbines.

Device and methods for a rotation powered vehicle are described, the rotation powered vehicle may have a platform which is pivotally attached to a chasses. Performing a rotational motion of the platform with respect to the chassis in either of two angular directions will result in the propulsion of the rotation powered vehicle in a single linear direction. The conversion of a rotational motion of the platform in either of two directions into a linear motion of the rotation powered vehicle in a single direction may be accomplished using multiple drive mechanisms, which may utilize hydraulic or mechanical methods and devices to accomplish the conversion.

Some embodiments are directed at a rotation powered vehicle on which a rider can propel themselves by rotating a platform on which they stand in either of two angular directions. The platform may be pivotally secured to chasses which may have a plurality of axles and a plurality of wheels which are secured to the axles. It is important that the rotational motion of the platform be small such that a rider of the rotation powered vehicle may comfortably stand on the platform and maintain their balance as they rotate the platform with their feet.

It is also important that the small rotational motion of the platform be translated into a large linear motion of the rotation powered vehicle. Two drive mechanisms are required to convert the rotational motion of the platform into a linear motion of the vehicle. Each drive mechanism takes a small rotational motion of the platform and converts it into a larger linear motion of the vehicle. One drive mechanism will convert a rotational motion of the platform in a first angular direction into a transnational motion of the vehicle in a first linear direction, and the second drive mechanism will convert a rotational motion of the platform in a second angular direction into a transnational motion of the vehicle in the first linear direction.

Some embodiments of the rotation powered vehicle may be powered by a series of power cycles. Each power cycle may consist of a first half power cycle wherein the platform is rotated in the first angular direction which activates the first drive mechanism and which moves the rotation powered board in the first linear direction. The first half power cycle may be followed by a second half power cycle wherein the platform is rotated in the second angular direction which activates the second drive mechanism and which moves the rotation powered board in the first linear direction.

Some embodiments of the rotation powered vehicle may also allow for the steering of the vehicle through the rotation of the platform in third and fourth angular directions. Thus a rider of the rotation powered vehicle can propel the vehicle by rotating the platform in either of two angular directions both of which are in a plane which is perpendicular to the surface of the platform and which is parallel to the direction of travel. A rider of the rotation powered vehicle may then steer the board in either of two additional angular directions both of which are in a plane which is perpendicular to the surface of the platform and which is perpendicular to the direction of travel.

Such embodiments of the rotation powered vehicle will provide a rider of the vehicle with a more "natural" riding experience. That is to say riding the rotation powered vehicle will be very similar to surfing wherein a rider of a surfboard leans the board in either of two angular directions both of which are in a plane which is perpendicular to the surface of the board and which is perpendicular to the direction of travel in order to steer the board. Additionally, a rider of a surfboard may bounce up and down on the board in order to propel the board forward. This is a technique which surfers refer to as "pumping" the surfboard. This "pumping" motion is similar to the rotational motions of the rotation powered vehicle which propel it forward.

For some embodiments of the rotation powered vehicle, the midpoint of the platform with respect to the direction of travel may be secured close to the midpoint of the chasses. This allows for a rider of the rotation powered vehicle to alter the power of a power cycle by altering where their feet are on the platform in relation to the midpoint of the platform. A rider standing on with their feet spread apart along the axis of motion will have their feet positioned at points far from the midpoint of the platform and will thus generate a larger rotational moment (resulting in more power transferred to the drive mechanisms) about the midpoint of the platform. A rider standing on with their feet close together along the axis of motion will have their feet positioned at points close to the midpoint of the platform and will thus generate a small rotational moment (resulting in less power transferred to the drive mechanisms) about the midpoint of the platform.

Some embodiments of rotation powered vehicles discussed herein are powered using multiple turbines. Each of the turbines may be in fluid communication with a respective pressure chamber. For some embodiments the pressure chambers may be disposed between the platform and the chassis. The fluid from a respective pressure chamber may be delivered to a respective turbine during a power cycle in which the platform is rotated with respect to the chassis. The fluid may exit the respective pressure chamber and then enter the respective turbine which converts the energy of the fluid into a motive force for the rotation powered board. The conversion of fluid energy into a motive force for the rotation powered board may be performed by each respective coupled pressure chamber and turbine during a given power cycle. Turbines typically convert the energy of a fluid into rotational motion of a shaft; one example of a turbine is a screw drive turbine.

Figure 2:
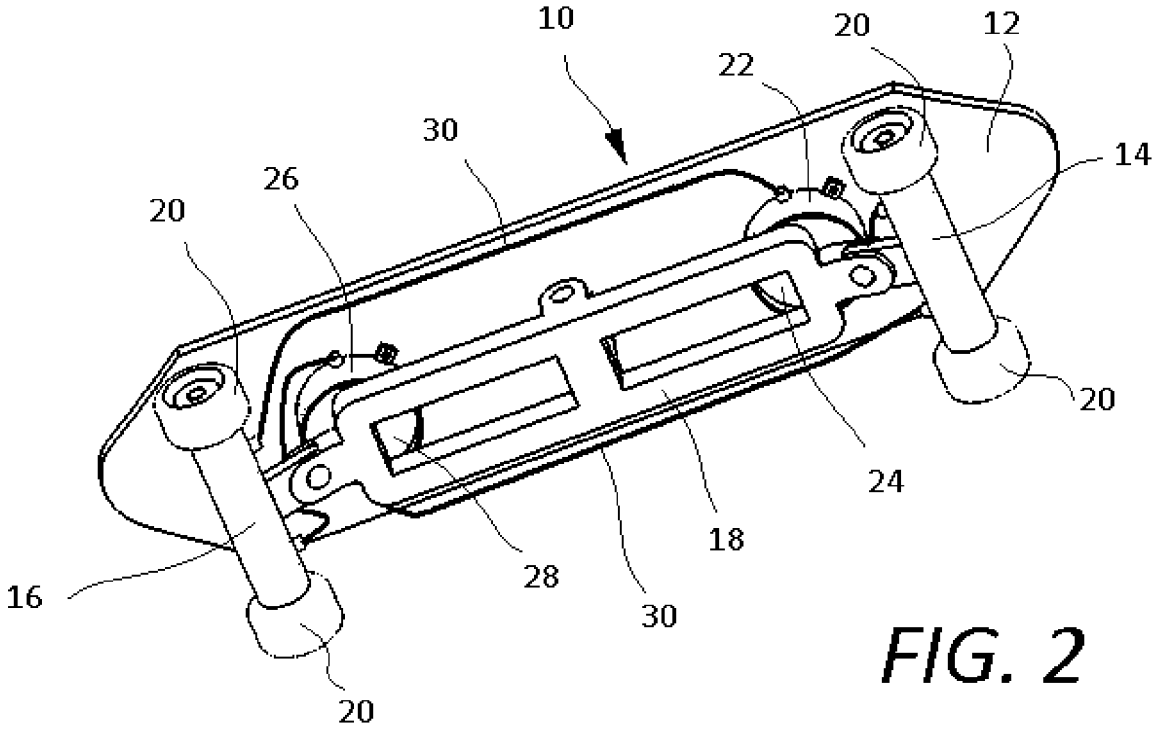

FIGS. 1-6 depict an embodiment of a rotation powered vehicle 10 that incorporates screw turbine drives and pressure chambers. The screw drive turbines and pressure chamber working in tandem act as the drive mechanisms which convert rotational motion of a platform of the embodiment into transnational motion of the rotation powered vehicle embodiment. FIG. 1 shows the rotation powered vehicle embodiment 10 which includes a platform 12, a first screw turbine assembly 14, a second screw turbine assembly 16, a chassis 18, and a plurality of wheels 20 coupled to the first screw turbine assembly 14 and the second screw turbine assembly 16. FIG. 2 shows the underside of the rotation powered vehicle embodiment 10 and shows a first pressure chamber 22, a first piston 24, a second pressure chamber 26, a second piston 28, and flexible tubing 30. Although the flexible tubing 30 is represented by lines in the various figures, the flexible tubing 30 is capable of carrying fluid to and from the various elements of the rotation powered vehicle 10 of FIG. 1.

Figure 3:
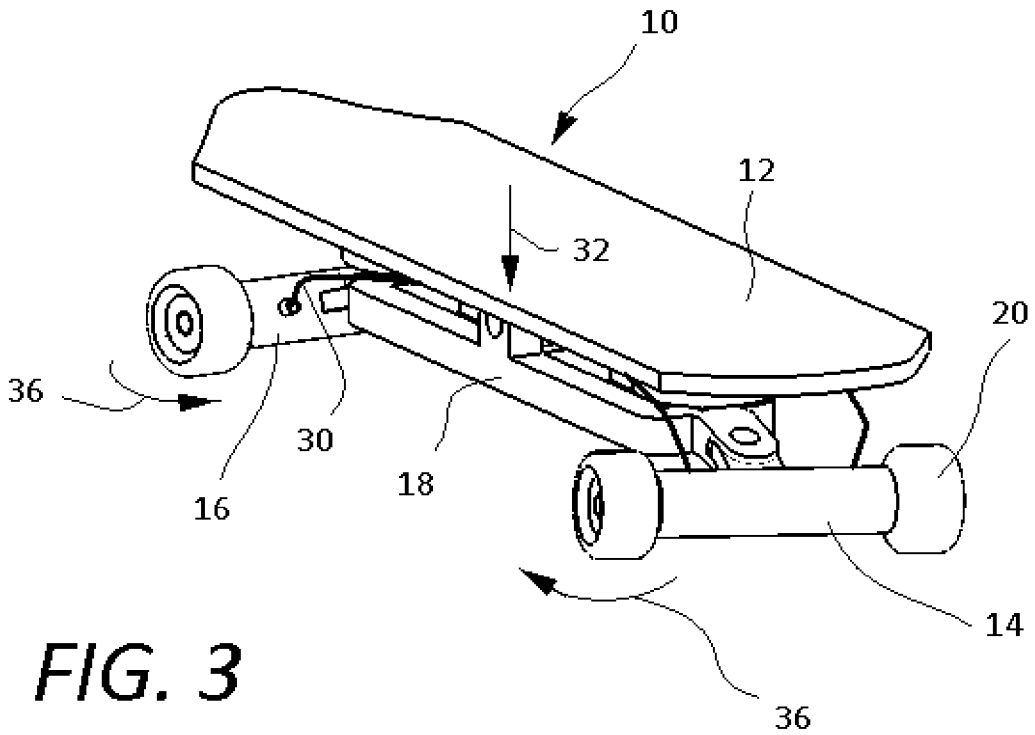
FIGS. 3 and 4 depict the rotation powered vehicle of FIG. 1 undergoing a rotation in a third angular direction.
Figure 4:
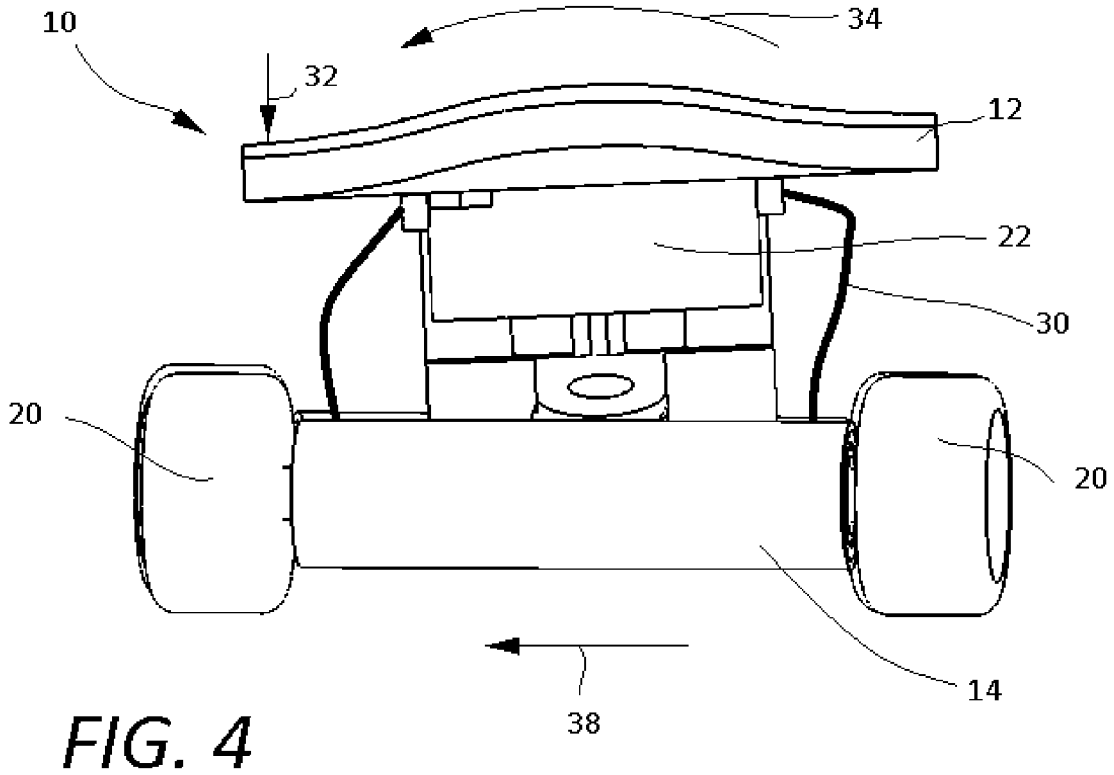

As seen in FIG. 2, the first screw turbine assembly 14 and the second screw turbine assembly 16 are pivotally secured to the chassis 18. This allows for the steering of the rotation powered vehicle 10. The first screw turbine assembly 14 and the second screw turbine assembly 16 may be pinned to the chassis 18, bolted to the chassis, or any suitable coupling configuration which allows for the rotation of the turbine assemblies with respect to the chassis may be used. FIGS. 3 and 4 depict a force represented by an arrow 32 which rotates the platform 12 in a fourth angular direction as indicated by the arrow 34 in FIG. 4. Rotating the platform 12 in the fourth angular direction will rotate the first screw turbine assembly 14 and the second screw turbine assembly 16 as depicted by the arrows 36 in FIG. 3. With the wheels 20 rotated as depicted in FIG. 3, the rotation powered vehicle 10 will turn in a fourth linear direction as indicated by the arrow 38 in FIG. 4 as it is propelled in a direction which is out of the page.

Figure 5:
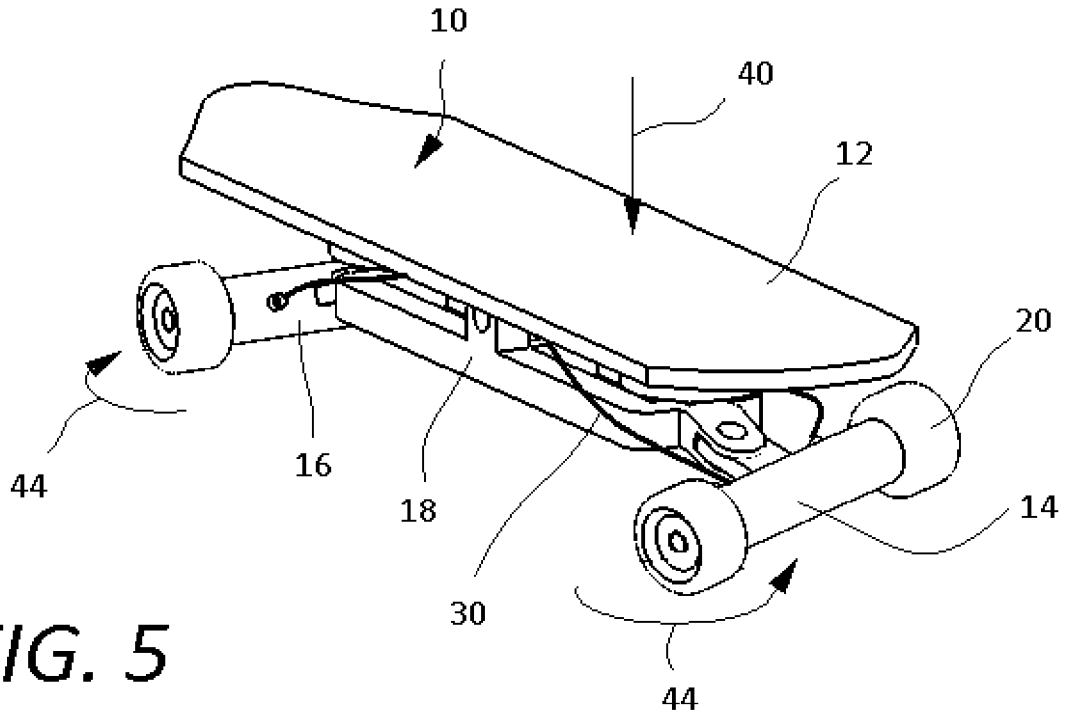
FIGS. 5 and 6 depict the rotation powered vehicle of FIG. 1 undergoing a rotation in a fourth angular direction.
Figure 6:
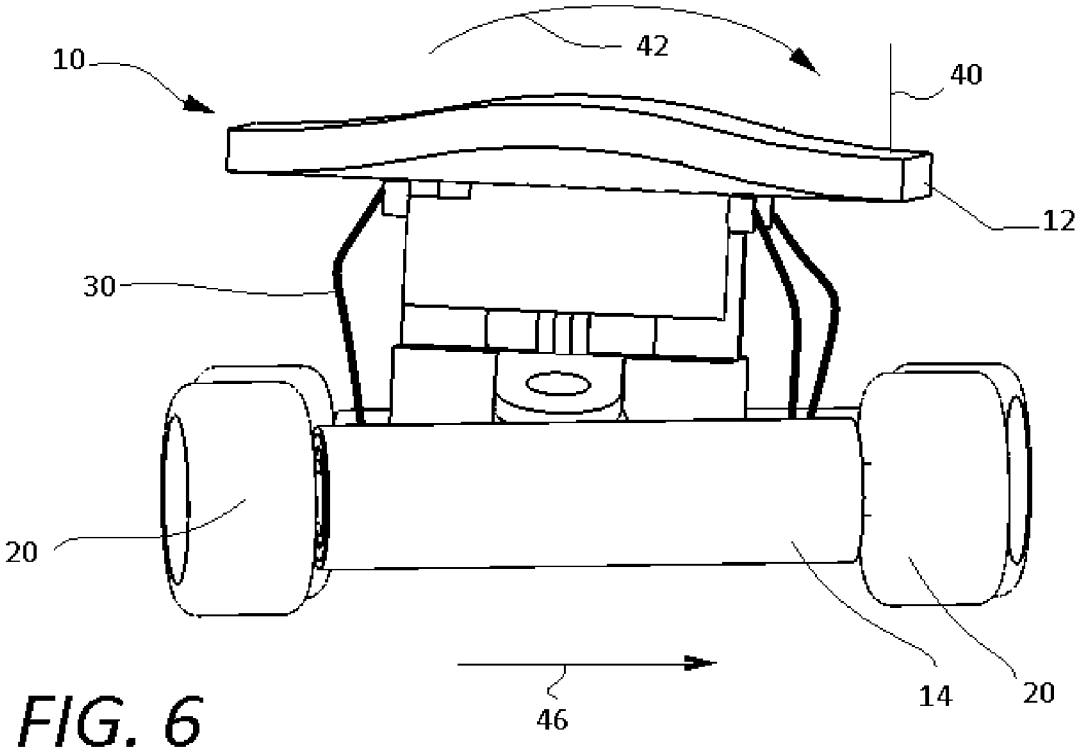

FIGS. 5 and 6 depict a force represented by an arrow 40 which rotates the platform 12 in a third angular direction as indicated by the arrow 42 in FIG. 4. Rotating the platform 12 in the third angular direction will rotate the first screw turbine assembly 14 and the second screw turbine assembly 16 as depicted by the arrows 44 n FIG. 1C. With the wheels 20 rotated as depicted in FIG. 3, the rotation powered vehicle 20 will turn in a third linear direction as indicated by the arrow 46 in FIG. 4 as it is propelled in a direction which is out of the page.

Figure 7:
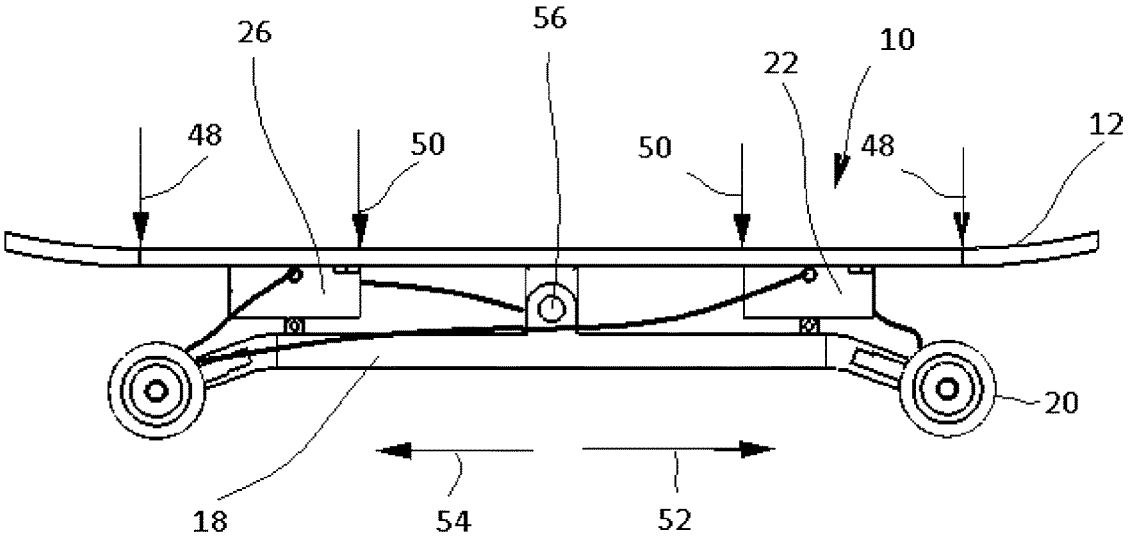
FIG. 7 depicts different standing positions on the rotation powered vehicle of FIG. 1 with a platform of the rotation powered vehicle in a neutral position.

As discussed above a rider of the rotation powered vehicle 10 may alter the power of a given power cycle by altering where their feet are on the platform 12 in relation to the midpoint of the platform 12. FIG. 7 depicts a first set of arrows 48 which indicate the positions of a riders feet on the platform in a first stance on the platform 12. A second set of arrows 50 indicate the positions of a riders feet in a second stance on the platform 12. The first stance indicated by arrows 48 will produce a given amount of power during a power cycle with the feet of the rider are positioned at the distances shown from a platform pivot point 56 which connects the platform 12 and the chassis 18. The second stance indicated by arrows 50 will produce less power during a power cycle because the feet of the rider are positioned closer to the platform pivot point 56. That is to say that the first stance indicated by arrows 48 will generate more of a moment around the platform pivot point 56 than the second stance indicated by arrows 50. FIG. 7 also indicates an arrow 52 representing a first linear direction and an arrow 54 representing a second linear direction.

Figure 8:
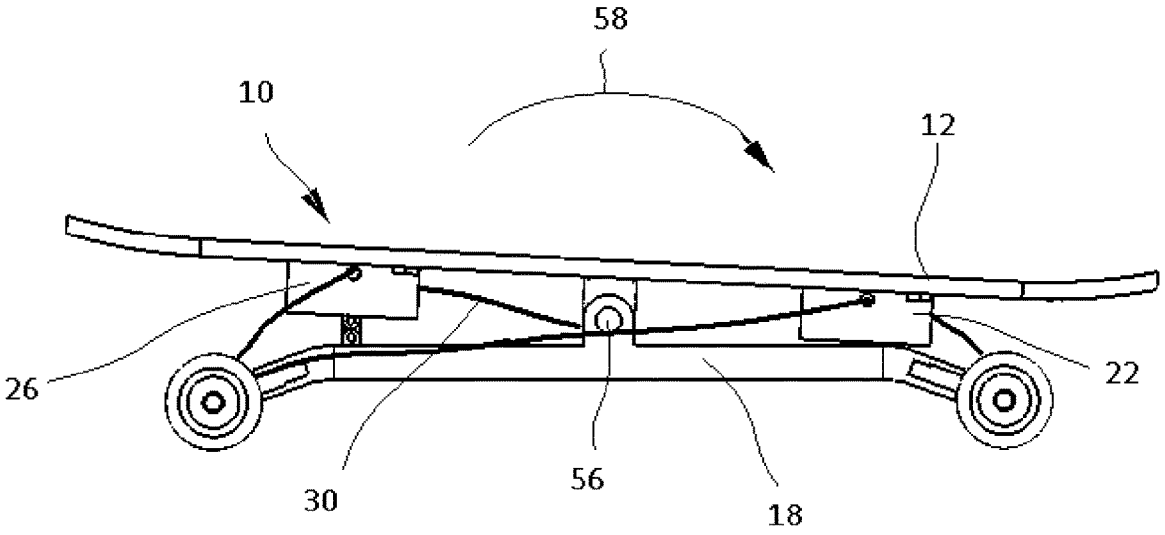
FIG. 8 depicts the rotation powered vehicle of FIG. 1 undergoing a first half power cycle as the platform rotates in a first angular direction.
Figure 9:
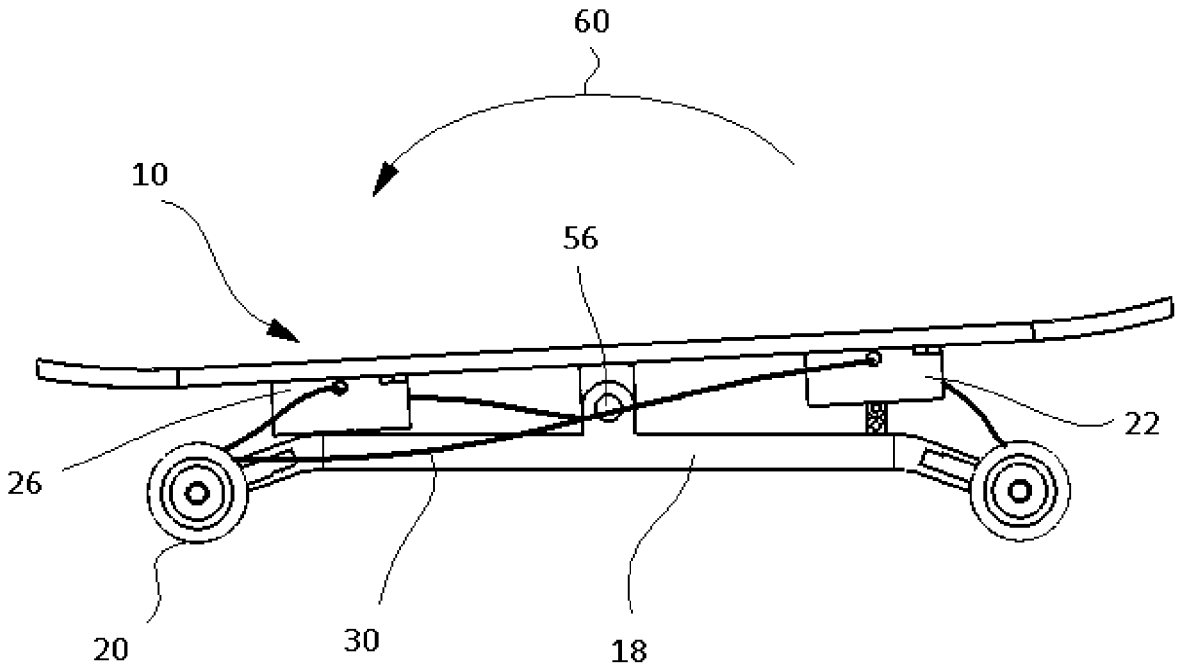
FIG. 9 depicts the rotation powered vehicle of FIG. 1 undergoing a second half power cycle as the platform rotates in a second angular direction.

The rotation powered vehicle embodiment 10 of FIG. 1 is capable of undergoing a power cycle. The power cycle may include a first half power cycle wherein the platform 12 is rotated in a first angular direction about the platform pivot point 56 which is indicated by the arrow 58 in FIG. 8. FIG. 8 shows the rotation powered vehicle 10 undergoing a first half power cycle with the platform rotated in the first angular direction. The power cycle may also include a second half power cycle wherein the platform is rotated in a second angular direction about the platform pivot point 56 which is indicated by the arrow 60 in FIG. 9. FIG. 9 shows the rotation powered vehicle 10 undergoing a second half power cycle with the platform 12 rotated in the second angular direction.

Figure 10:
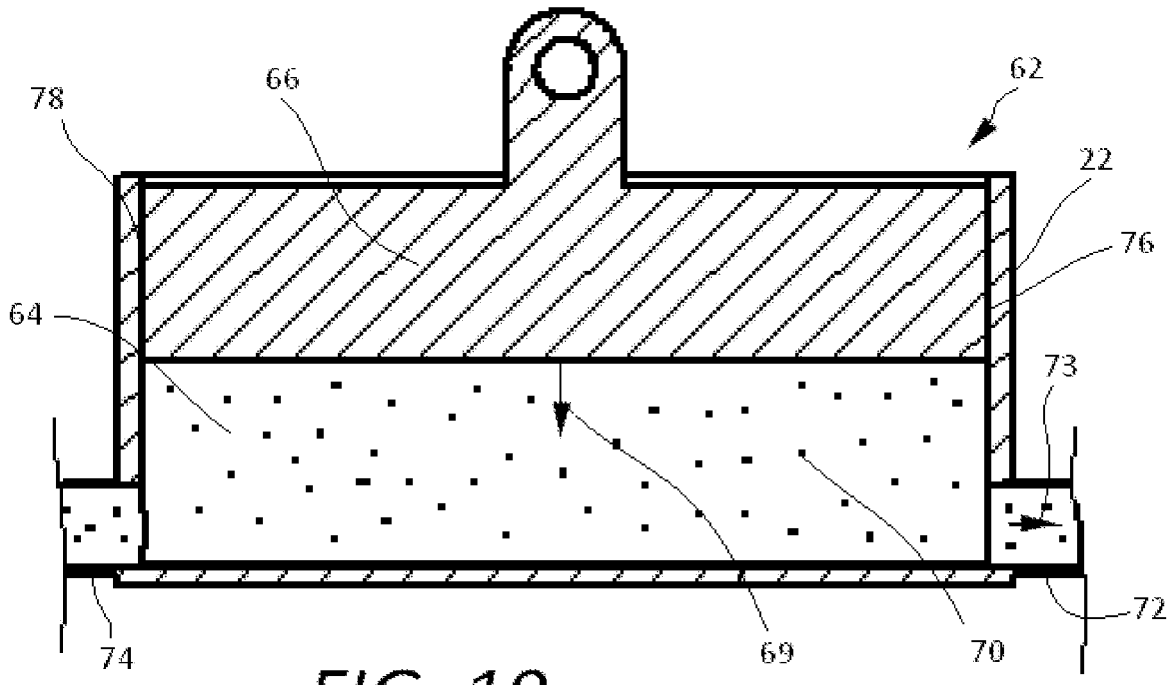
FIG. 10 is a cross sectional view of a pressure chamber and a piston with a variable volume within the pressure chamber created by the pressure chamber and piston

FIG. 10 is a sectional view of a first pressure chamber assembly 62 of the rotation powered vehicle 10 as it undergoes a first power cycle as is shown in FIG. 8. As is shown in FIG. 8, a first piston 66 is pivotally secured to the chassis 18. As the platform 12 rotates in the first angular direction, the first piston 66 is advanced into a first interior volume 64 of the first pressure chamber assembly 62 as shown in FIG. 10. As the first piston 66 advances into the first interior volume 64 as indicated by arrow 69, a first variable volume 68 which ifs formed by the first interior volume 64 and the first piston 66 is collapsed. As the first variable volume 68 is collapsed a portion of a volume of fluid 70 is transferred out of a first pressure output port 72 as shown by arrow 73. Also shown in FIG. 10 is a first pressure input port 74. A seal 76 between an outer surface 78 of the first piston 66 and the first interior volume 64 of the first pressure chamber 22 prevents fluid from leaking out of the first variable volume 68 past the first piston 66.

Figure 11:
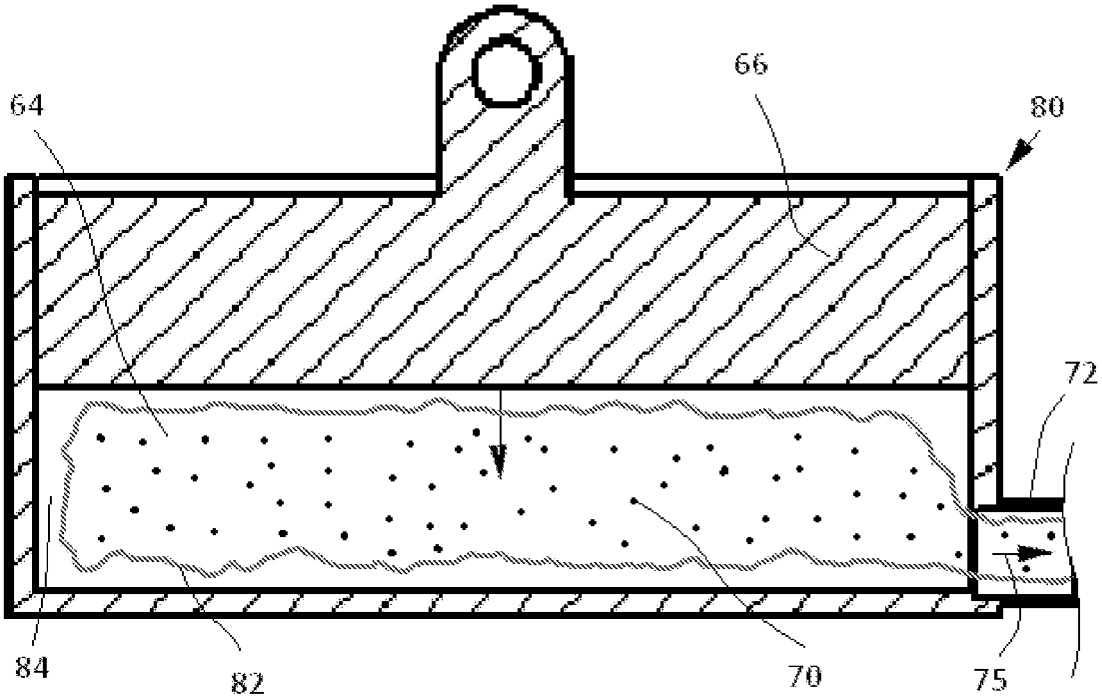
FIG. 11 is a cross section view of a pressure chamber, a piston, and a flexible bladder disposed within a variable volume created by the pressure chamber and piston.

FIG. 11 depicts another embodiment a first pressure chamber assembly 80 which is shown in FIG. 10. In the embodiment shown in FIG. 11, the variable volume 84 incorporates a first flexible bladder 82 which contains a portion of the volume of fluid 70. As the first piston 66 advances into the first interior volume 64, the variable volume 84 formed by the first interior volume 64 and the first piston 66 collapses. As the variable volume 84 collapses it also collapses the first flexible bladder 82, the first flexible bladder 82 being in fluid communication with the first pressure output port 72. As the first flexible bladder 82 collapses it forces a portion of the volume of fluid 70 out of the first pressure output port 74 as indicated by the arrow 75.

FIG. 9 depicts a second pressure chamber embodiment 26. The second pressure chamber 26 may include a second piston 28, a second interior volume, a second pressure input port 114, a second pressure output port 116, and a second variable volume (not shown) all of which may be identically configured to their companion elements which are shown in FIG. 10. The second pressure chamber embodiment 26 may also be configured such that there is a second seal between the second piston 28 and a surface of the second interior volume again analogous to FIG. 10. Alternatively the second pressure chamber embodiment 26 may include a second flexible bladder which configured identically to the first flexible bladder shown in FIG. 11.

Figure 12:
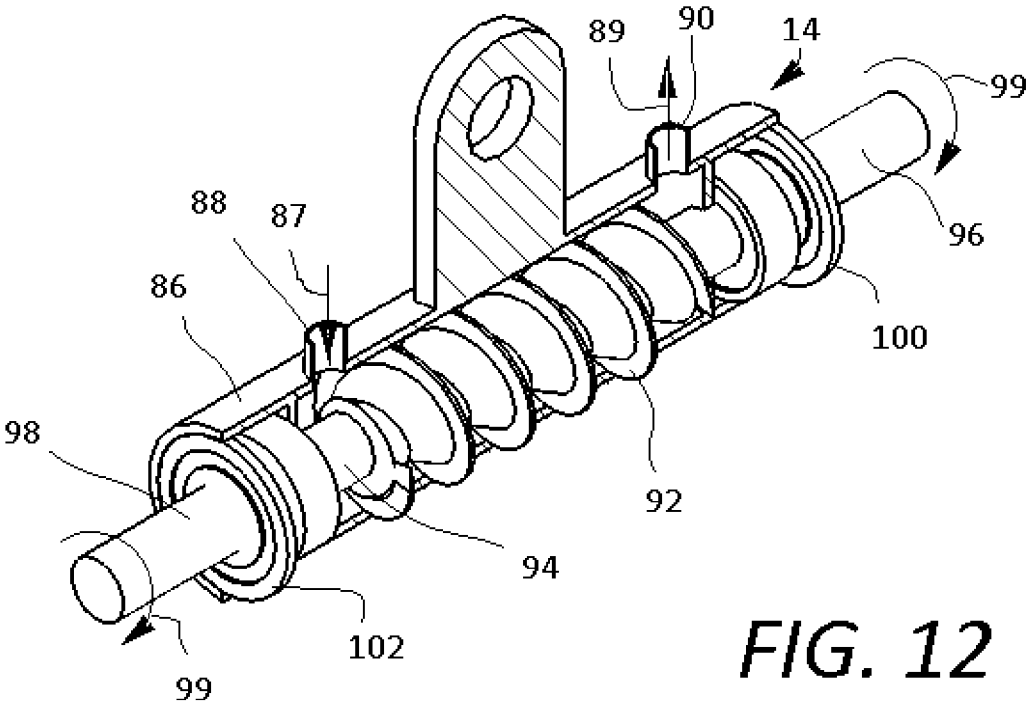
FIG. 12 depicts a screw turbine assembly with a turbine body shown in section view.

The rotation powered vehicle of FIG. 1 may also include the first screw turbine assembly 14 and the second screw turbine assembly 16. FIG. 12 depicts a first screw turbine assembly 14 having a first turbine body 86 which is shown in sectional view. The first turbine body 86 may include first turbine input port 88 and a first turbine output port 90. A first turbine blade 92 is attached to a first turbine shaft 94, and the first turbine shaft 94 is coupled to a first ratchet 96 and a second ratchet 98. The ratchets (and all ratchet embodiments contained within this document) may be configured as clutch bearings, or any other suitable one way bearings may be used. The use of two independent ratchets (for this embodiment and for all other embodiments discussed herein) allows for the wheels to be driven independently, without the need for a differential. The first ratchet 96 and second ratchet 98 are both supported by a first sealed bearing 100 and a second sealed bearing 102 respectively. The sealed bearings may act to prevent fluid from leaking outside the first turbine body 86. The first turbine input port 88 is in fluid communication with the first pressure output port 72 of the first pressure chamber assembly 62. This may be accomplished through the use of flexible tubing 30 which may connect to the first pressure output port 72 and the first turbine input port 88.

As shown in FIG. 12, a portion of the volume of fluid 70 which has exited the first pressure output port 72 during a first half cycle may enter the first turbine input port 88 as indicated by arrow 87. The fluid 70 may then interact with the first turbine blades 92 such that the first turbine shaft 94 rotates in the second angular direction indicated by arrow 99. This occurs when energy from the fluid 70 is transferred to the first turbine shaft 94 thereby rotating the first turbine shaft 94. The first ratchet 96 and the second ratchet 98 are configured to engage the first turbine shaft 94 when it rotates in the first angular direction, and the first ratchet 96 and the second ratchet 98 are configured not to engage the first turbine shaft 94 when the first turbine shaft 94 rotates in the second angular direction which is indicated by the arrow 60 in FIG. 9. Fluid 70 which exits the first turbine output port 90 as indicated by arrow 89 is sent to the second pressure input port 114 of the second pressure chamber 26 and into a second variable volume (not shown) which is expanding during the first half power cycle. The first ratchet 96 and second ratchet 98 then turn as indicated by arrows 99 thereby turning the wheels 20 in the first angular direction thereby propelling the rotation powered device 10 in the first linear direction.

The rotation powered vehicle embodiment of FIG. 1 may also include a second screw turbine assembly 16. The second screw turbine assembly may include a second turbine body 112, a second turbine input port 120, and a second turbine output port 122. The second screw turbine assembly 16 may also include a second turbine shaft (not shown) with second screw turbine blades (not shown) attached to the second turbine shaft (not shown). The second screw turbine assembly may also include a third ratchet 124, a fourth ratchet 126, a third sealed bearing, and a fourth sealed bearing. The second screw turbine assembly 16 components may be configured identically to their corresponding first screw turbine assembly 14 components which are configured as shown in FIG. 12.

During a second half power cycle (shown in FIG. 9), the platform 12 rotates in the second angular direction, and a portion of the volume of fluid 70 may be transferred out of the second variable volume through the second pressure output port 116 and into the second turbine input port 120. The portion of fluid interacts with the second turbine blades and rotates the second turbine shaft in the second angular direction. This occurs when energy from the fluid 70 is transferred to the second turbine shaft thereby rotating the second turbine shaft. The third ratchet 124 and the fourth ratchet 126 are configured to engage the second turbine shaft when it rotates in the first angular direction, and the third ratchet 124 and the fourth ratchet 126 are configured not to engage the second turbine shaft when the second turbine shaft rotates in the second angular direction. Fluid 70 which exits the second turbine output port 122 is sent to the first pressure input port 74 of the first pressure chamber 22 and into the first variable volume 68 which is expanding during the second half power cycle. The third ratchet 124 and fourth ratchet 126 turn the wheels 20 in the first angular direction thereby propelling the rotation powered device 10 in the first linear direction.

Figure 13:
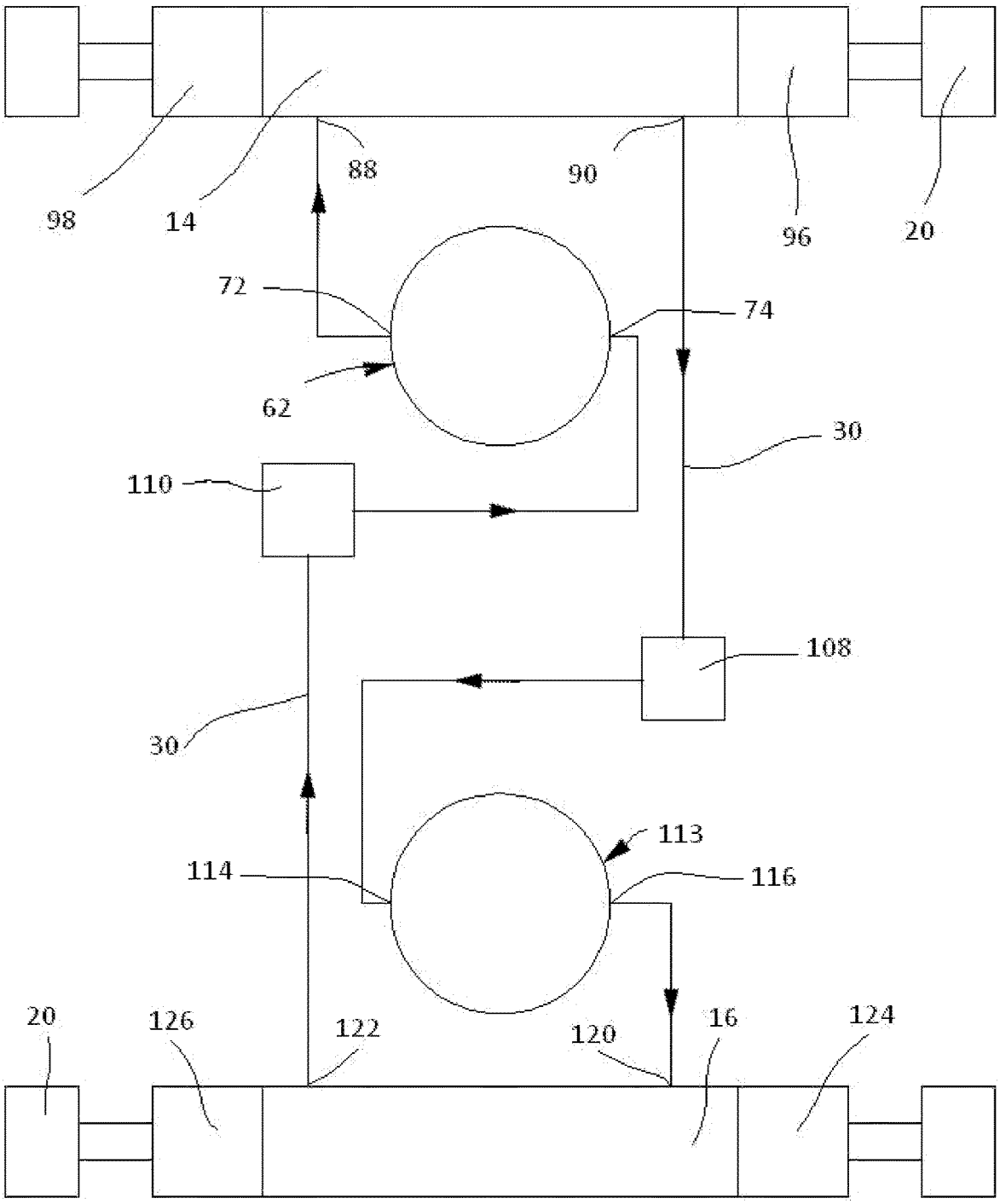
FIG. 13 is a schematic of the fluid routing for a screw drive turbine powered embodiment of a rotation powered vehicle.

FIG. 13 is a schematic which indicates the fluid connections for the rotation powered vehicle 10 of FIG. 1. The schematic represents the first screw turbine assembly 14 which includes the first ratchet 96, the second ratchet 98, and two wheels 20 attached to the first ratchet 96 and the second ratchet 98. The first screw turbine assembly 14 also includes a first turbine input port 88 and a first turbine output port 90. FIG. 5 also depicts the first pressure chamber assembly 62, and a first one way valve 108. The schematic also depicts the second screw turbine assembly 16 which includes the third ratchet 124, the fourth ratchet 126, and two wheels 20 attached to the third ratchet 124 and the fourth ratchet 126. The screw turbine assembly 16 also includes a second turbine input port 120 and a second turbine output port 122. FIG. 13 also depicts the second pressure chamber assembly 113, and a second one way valve 110.

As can be seen in FIG. 13, the first turbine input port 88 is in fluid communication with the first pressure output port 72. It can also be seen that the first turbine output port 90 is in fluid communication with the second pressure input port 114, with a first one way valve 108 between the first turbine output port 90 and the second pressure input port 114. The first one way valve 108 ensures that fluid does not exit the second pressure input port 114 during a second half power cycle. The second turbine input 88 is in fluid communication with the second pressure output port 116. The second turbine output port 122 is in fluid communication with the first pressure input port 74, with a second one way valve 112 between the second turbine output port 122 and the first pressure input port 74. The second one way valve 112 ensures that fluid does not exit the first pressure input port 74 during a first half power cycle.

FIG. 6 is a flowchart which represents a method embodiment for a power cycle of the rotation powered vehicle of FIG. 1A. Boxes 138-142 depict the method steps first half power cycle and boxes 144-158 depict the method steps for the second half power cycle. Box 142 represents a query as to weather or not pressure chamber 1 (the first pressure chamber assembly 62) is empty. Similarly, box 158 represents a query as to weather or not pressure chamber 2 (the second pressure chamber assembly 113) is empty. It is important to note that the first pressure chamber assembly 62 does not need to be completely empty (it can remain partially filled with the fluid 70) for the first half power cycle to end and for the second half cycle to begin. Similarly, the second pressure chamber assembly 113 does not need to be completely empty (it can remain partially filled with fluid 70) for the second half power cycle to end and for the first half cycle to begin.

Note that throughout the remainder of this document the conventions for the first angular direction, the second angular direction, the third angular direction the fourth angular direction, the first linear direction, the second linear direction, the third linear direction, and the fourth linear direction which have been indicated by arrows in FIGS. 4, 6, 7, 8, and 9 will be used in reference to other relevant figures and descriptions.

Figure 15:
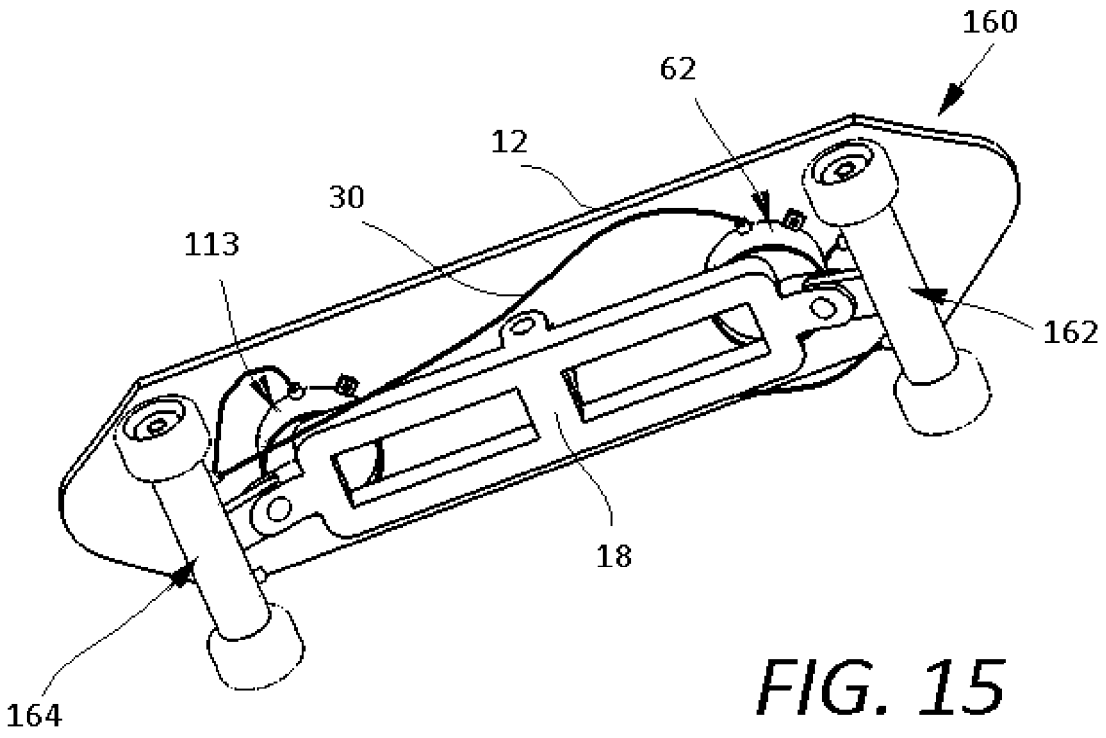
FIG. 15 depicts an embodiment of a rotation powered vehicle with a dual direction plunger drive system.

It is possible for turbine configurations other than the screw turbine described above to be used in order to power a given rotation powered vehicle embodiment. FIG. 15 depicts one such a rotation powered vehicle embodiment, the rotation powered vehicle 160 depicted in FIG. 15 incorporating a first plunger screw drive assembly 162 and a second plunger screw drive assembly 164. Other than the first plunger screw drive assembly 162 and the second plunger screw drive assembly 164, the rotation powered vehicle embodiment 160 may include components which may be similar to the components of the rotation powered vehicle depicted in FIG. 1. These components may include a platform 12, a chassis 18, a first pressure chamber assembly 62, a first piston 24, a second pressure chamber assembly 113, a second piston 28, and a quantity of flexible tubing 30 which connects the various input and output ports. The first pressure chamber 22 may include a first pressure input port 74 and a first pressure output port 72, and the second pressure 26 chamber may include second pressure input port 114 and a second pressure output port 116. Note that FIG. 15 does not depict all of the above listed components.

Figure 16:
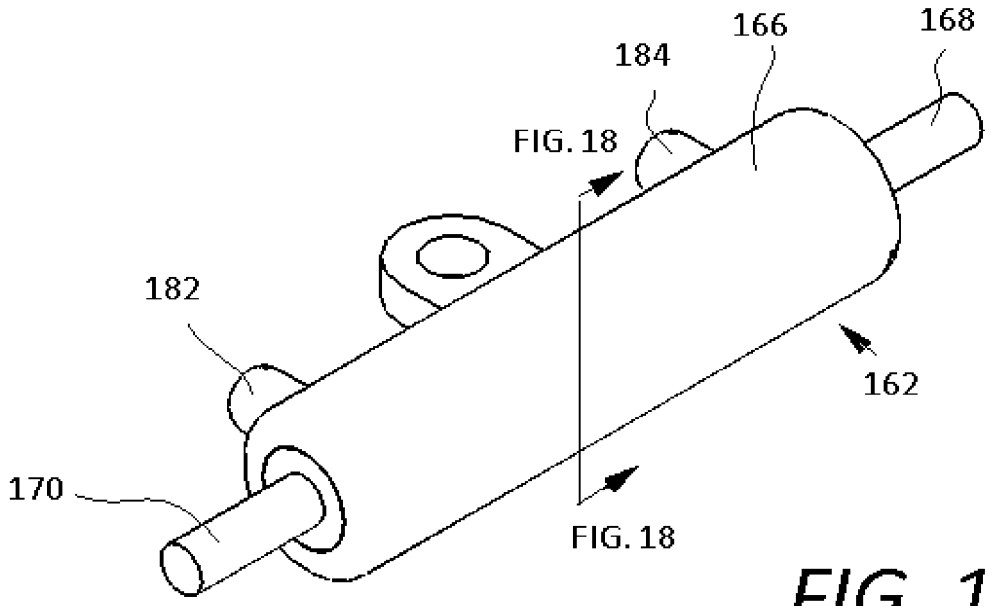
FIG. 16 depicts a dual direction plunger drive embodiment.

The first plunger screw drive assembly 162 is depicted in FIG. 16. The first plunger screw drive assembly 162 may include a first turbine body 166, and a first ratchet 168 and second ratchet 170. The first ratchet 168 and second ratchet 170 may be configured as clutch bearings or any other suitable one way bearings. FIG. 17 depicts the first plunger screw drive assembly 162 of FIG. 16 with the first turbine body 166 in sectional view. The sectional view reveals a first turbine shaft 172, a first screw drive 174, a first plunger 176, a first sealed bearing 178, and a second sealed bearing 180. The first plunger screw drive 162 may also include a first turbine input port 182 and a first turbine output port 184.

FIG. 18 is a cross sectional view of the first turbine body 166 showing a first slot 186 and a second slot 188, the first slot 186 and second slot 188 being keyed to a first boss 190 and a second boss 192 on the first plunger 176. As can be seen in FIG. 17 the first boss 190 keys into the first slot 186, and the second boss 192 keys into the second slot 188. This effectively "keys" the first plunger 176 into the first turbine body 166 such that it may slide along the first turbine shaft 172, but it may not rotate over the first turbine shaft 172. Although two bosses are depicted on the first plunger 176 and two slots are depicted in the first turbine body 166, any suitable combination of key features which may be bosses and or slots may be used to key the first plunger 176 to the first turbine body 166. For example one slot (or notch) could be disposed on the first plunger 176, with the slot coupling to a single boss disposed on the first turbine body 166.

While the first plunger 176 is "keyed" to the first turbine body 166, it may also incorporate a first threaded hole 194 which engages with the first screw drive 174. The first threaded hole 194 may be engaged with the first screw drive 174 such that as the first plunger 176 advances within the first turbine body 166 guided by the first slot 186 and the second slot 188, the first threaded hole 194 of the first plunger 176 will rotate the first turbine shaft 172. The first turbine shaft 172 will rotate in either a first angular direction or in a second angular direction depending on the direction motion of the first plunger 176 along the first turbine shaft 172.

Figure 19:
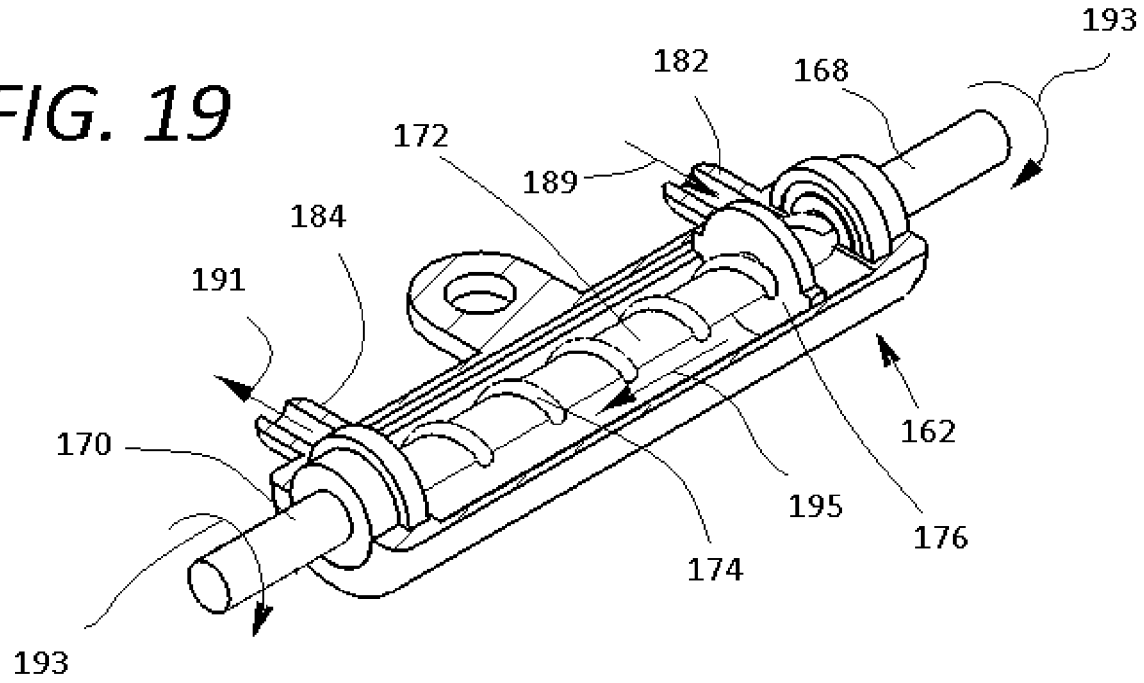
FIGS. 19-21 depict a half power cycle carried out by the dual direction plunger drive of FIG. 16.
Figure 20:
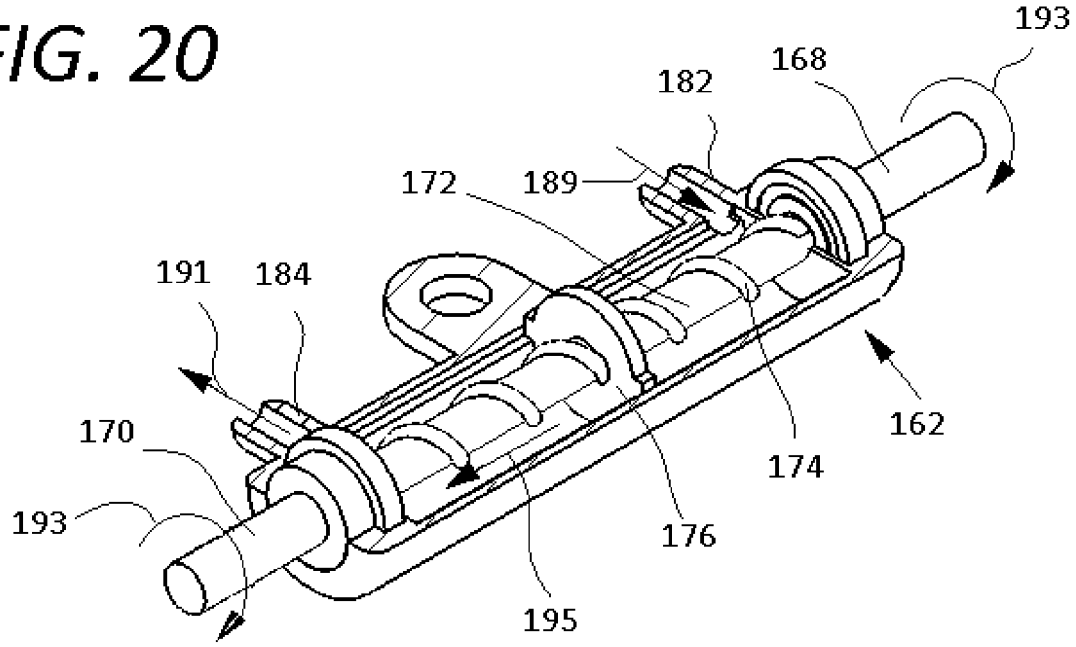
Figure 21:
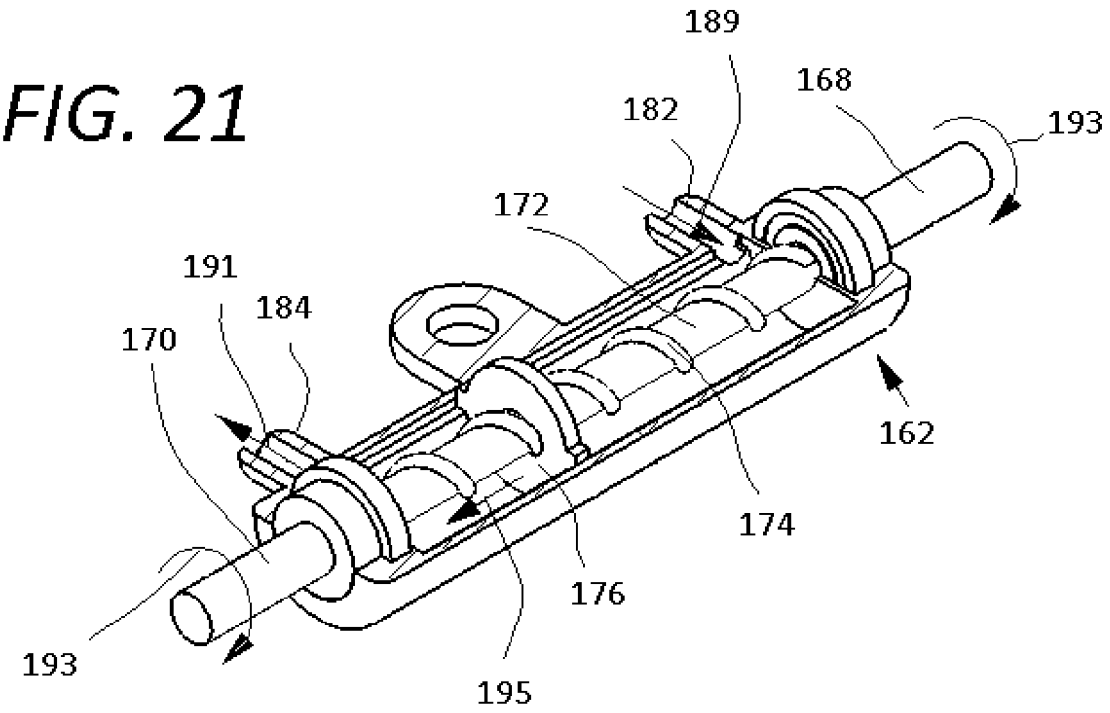

The motion of the first plunger 176 during a first half power cycle is depicted in FIGS. 19-21. FIG. 19 depicts a portion of a volume of fluid 70 from the first pressure output port 72 entering the first turbine input port 182 as indicated by arrow 189. The fluid advances the first plunger 176 along the first turbine shaft 172 as depicted by the arrows 195. As the first plunger 176 moves along the first turbine shaft 172, the first threaded hole 194 interacts with the first screw drive 174 thereby resulting in the rotation of the first turbine shaft 172 in the first angular direction. The rotation of the first turbine shaft 172 in the first angular direction results in the rotation of the first ratchet 168 and second ratchet 170 in the first angular direction as indicated by arrows 193. This is because the first ratchet 168 and the second ratchet 170 are configured to engage with and rotate with the first turbine shaft 172 when it moves in the first angular direction, and the first ratchet 168 and the second ratchet 170 are configured to not engage with the first turbine shaft 172 when it rotates in the second angular direction. The rotation of the first ratchet 168 and the second ratchet 170 in the first angular direction results in the rotation of the wheels 20 attached to the first ratchet 168 and second ratchet 170 in the first angular direction and therefore a translation of the rotation powered vehicle 160 in the first linear direction (as shown by arrow 52 in FIG. 7). As the plunger 176 advances in the direction indicated by arrow 195, fluid 70 exits the first turbine output port 184 as indicated by arrow 191.

The rotation powered vehicle of FIG. 15 may also include a second plunger screw drive assembly 164 which may be configured similarly to the first plunger screw drive which is shown in FIG. 8B. The second plunger screw drive assembly may include a second turbine body, a third ratchet 171 and fourth ratchet 173, a second screw drive, a second plunger, a third and fourth sealed bearing, a second turbine input port 183, and a second turbine output port 185. The second plunger screw drive may undergo a second half power cycle which is analogous to the first half power cycle which has been discussed above.

Figure 22:
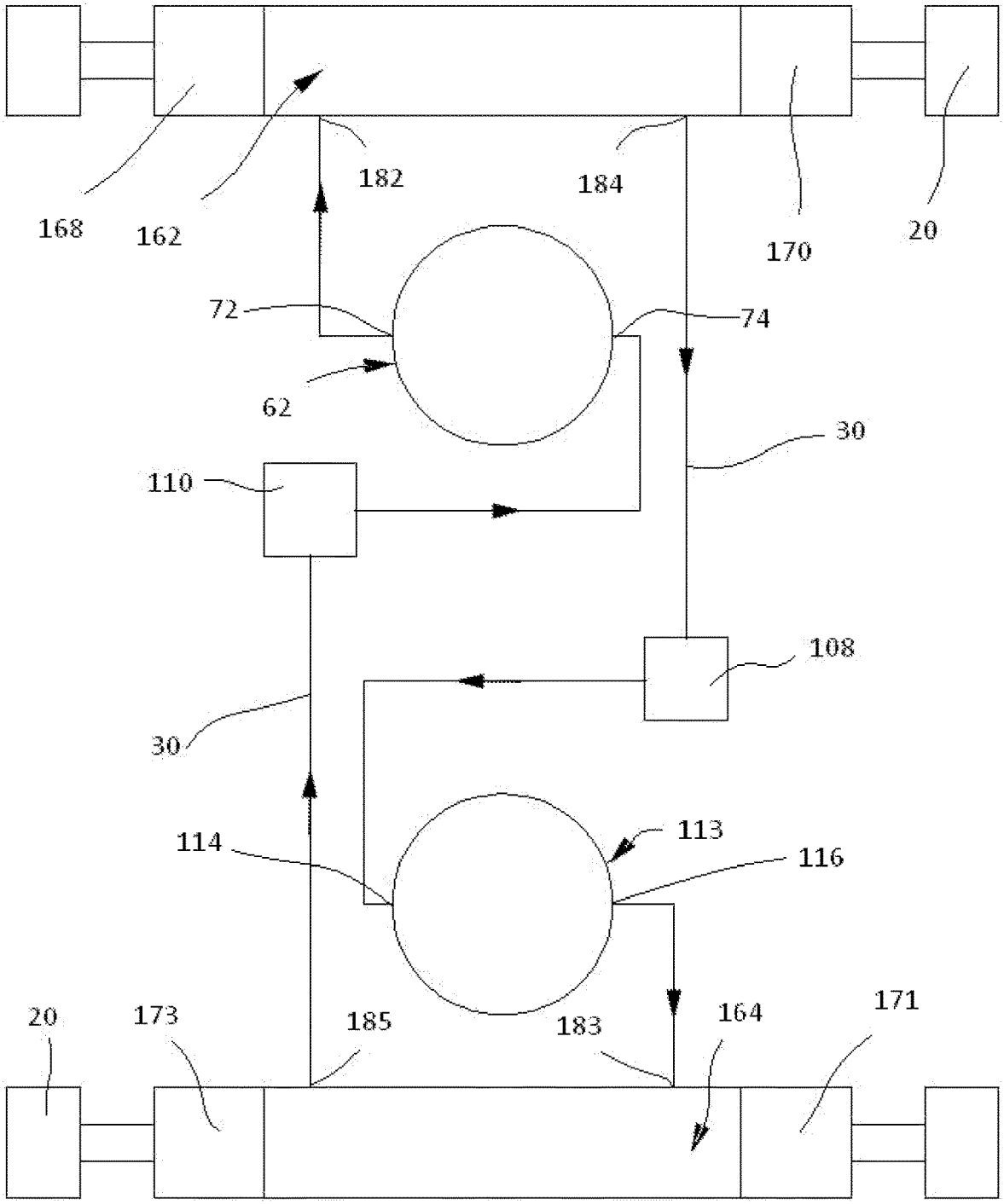
FIG. 22 is a schematic of the fluid routing for a screw drive turbine powered embodiment of a rotation powered vehicle.

A power cycle for the rotation powered vehicle embodiment 160 depicted in FIG. 15 is carried out analogously to the power cycle of the rotation powered vehicle 10 depicted in FIG. 1. FIG. 22 is a schematic which indicates the fluid connections and fluid paths for the rotation powered vehicle 160 of FIG. 15. The schematic represents the first plunger screw drive assembly 162 which includes the first ratchet 168, the second ratchet 170, and two wheels 20 attached to the first ratchet 168 and the second ratchet 170. The first plunger screw drive assembly 162 also includes a first turbine input port 182 and a first turbine output port 184. FIG. 22 also depicts the first pressure chamber assembly 62, and a first one way valve 108. The schematic also depicts the second plunger screw drive assembly 164 which includes the third ratchet 171, the fourth ratchet 173, and two wheels 20 attached to the third ratchet 171 and the fourth ratchet 173. The second plunger screw drive assembly 164 also includes a second turbine input port 183 and a second turbine output port 185. FIG. 22 also depicts the second pressure chamber assembly 113, and a second one way valve 110.

As can be seen in FIG. 22 the first turbine input port 182 is in fluid communication with the first pressure output port 72. It can also be seen that the first turbine output port 184 is in fluid communication with the second pressure input port 114, with a first one way valve 108 between the first turbine output port 184 and the second pressure input port 114. The first one way valve 108 ensures that fluid does not exit the second pressure input port 114 during a second half power cycle. The second turbine input port 183 is in fluid communication with the second pressure output port 116. The second turbine output port 185 is in fluid communication with the first pressure input port 74, with a second one way valve 112 between the second turbine output port 185 and the first pressure input port 74. The second one way valve 112 ensures that fluid does not exit the first pressure input port 74 during a first half power cycle.

Figure 14:
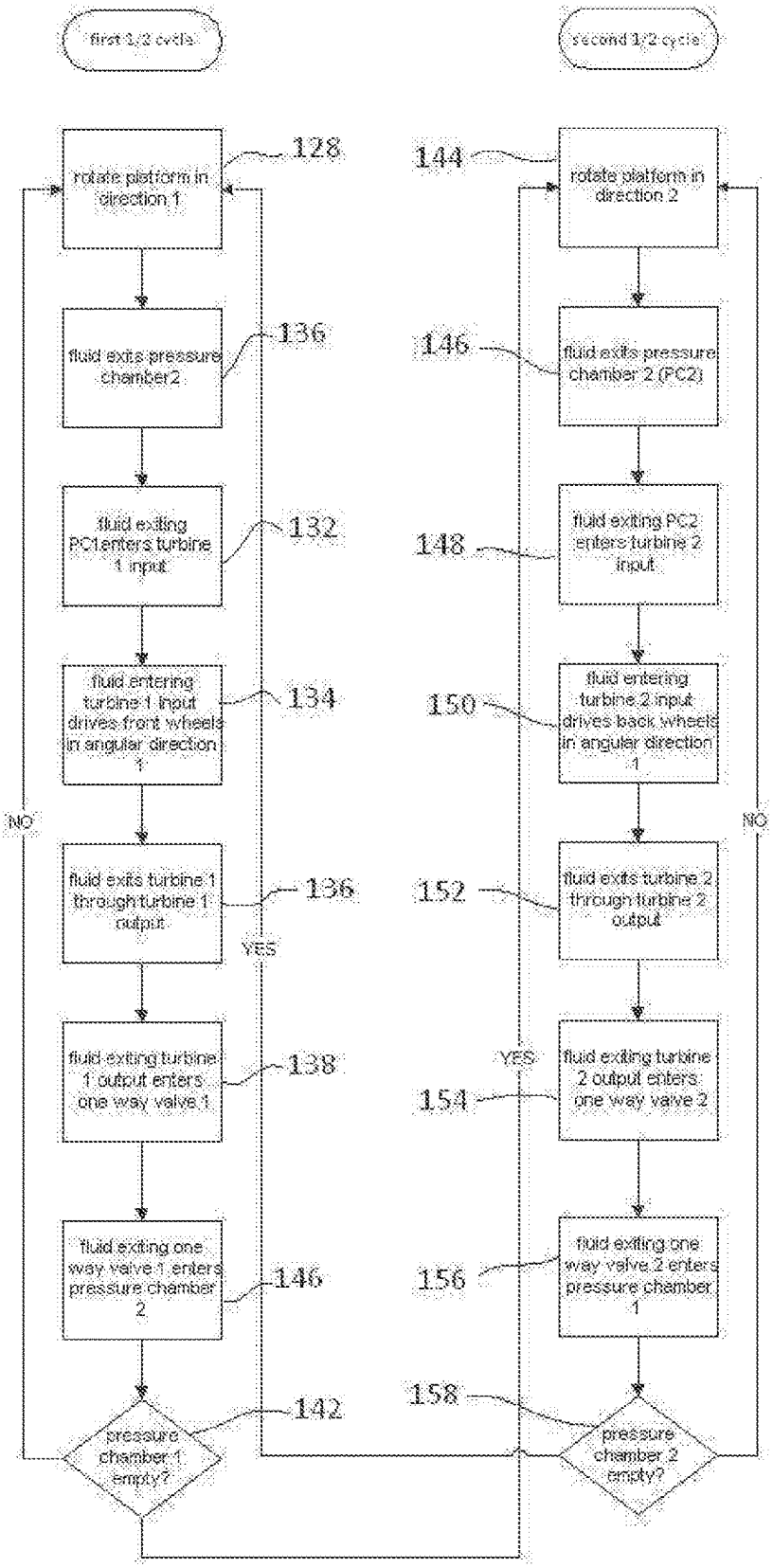
FIG. 14 is a flowchart which depicts a first power cycle and a second power cycle for some turbine powered embodiments of a rotation powered vehicle.

A power cycle for the rotation powered vehicle embodiment 160 depicted in FIG. 15 is carried out analogously to the power cycle of the rotation powered vehicle 10 depicted in FIG. 1. That is to say the flowchart depicted in FIG. 15 can be applied to the rotation powered vehicle 160 depicted in FIG. 15 in that the methods for carrying out a first half power cycle and a second half power cycle described in the flowchart in FIG. 14 may also be applied to rotation powered vehicle 160 depicted in FIG. 15. The only difference being the manner in which the first and second turbine shafts are rotated in the first angular direction during a first half or second half power cycle. For the rotation powered vehicle depicted 10 in FIG. 1, the first and second turbine shafts are rotated in the first angular direction when fluid interacts with the first and second turbine blades respectively. For the rotation powered vehicle embodiment depicted in FIG. 15 the first and second turbine shafts are rotated in the first angular direction as the first and second plungers engage with and rotate the first and second screw drives respectively.

Figure 23:
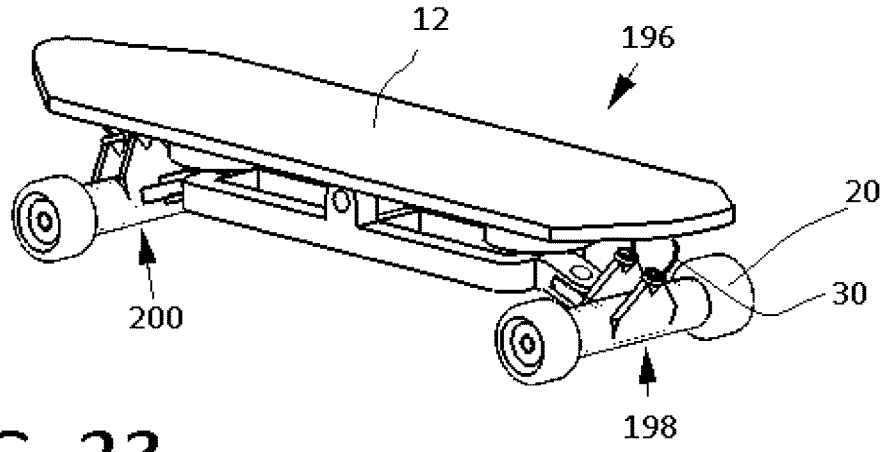
FIG. 23 depicts an embodiment of a rotation powered vehicle which incorporates multiple cross flow turbine drives.

Another embodiment of a rotation powered vehicle with yet another type of turbine drive is depicted in FIG. 23. The rotation powered vehicle embodiment 196 incorporates a first cross flow turbine assembly 198 and a second cross flow turbine assembly 200. Other than the first cross flow turbine assembly 198 and the second cross flow turbine assembly 200, the rotation powered vehicle embodiment 196 may include components which may be similar to the components of the rotation powered vehicle 10 depicted in FIG. 1. These components may include a platform 12, a chassis 18, a first pressure chamber assembly 62, a second pressure chamber assembly 113, and a quantity of flexible tubing 30. The first pressure chamber assembly may include a first pressure input port 74 and a first pressure output port 72, and the second pressure chamber assembly 113 may include second pressure input port 114 and a second pressure output port 116.

Figure 24:
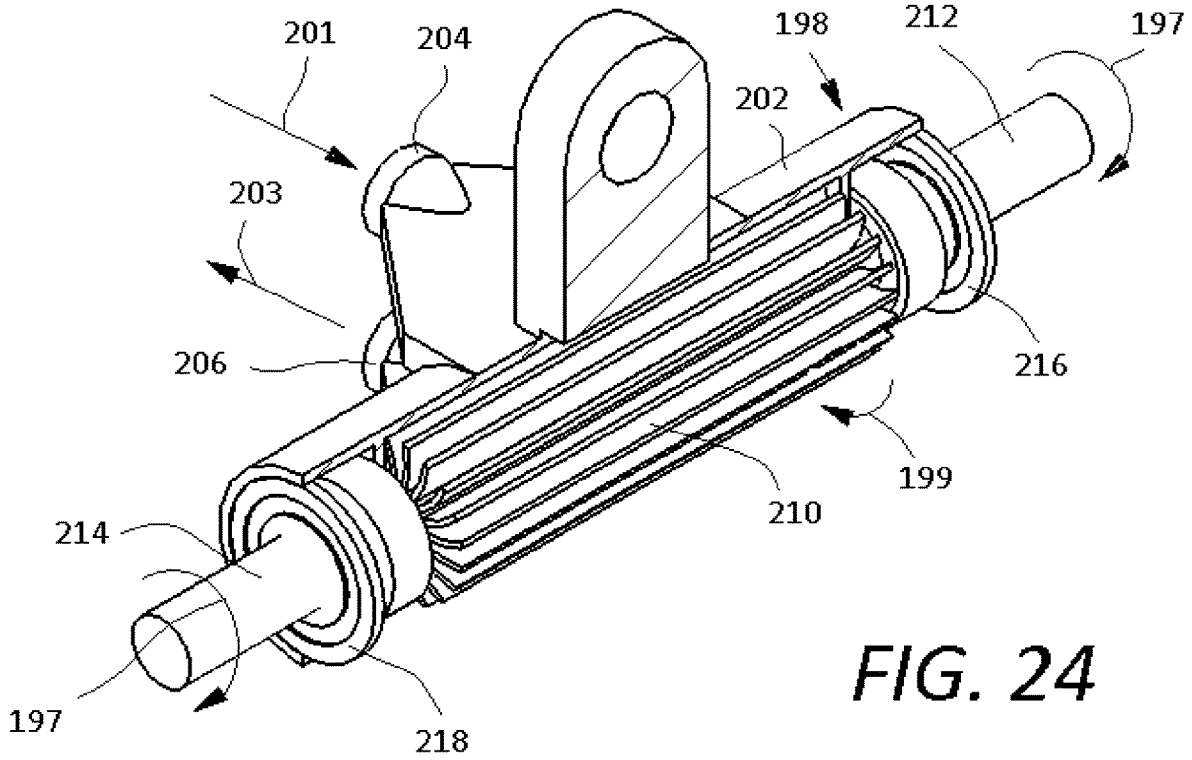
FIGS. 24 and 25 show sectional views of one of the cross flow turbines of the rotation powered vehicle embodiment of FIG. 23.
Figure 25:
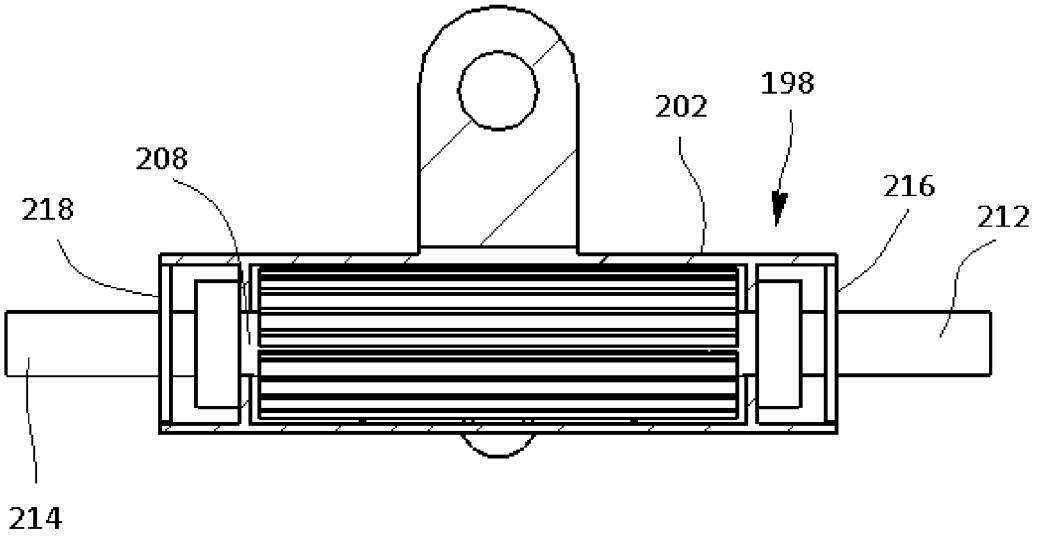

FIG. 24 depicts the first cross flow turbine assembly 196 which may include a first turbine body 202 having a first turbine input port 204 and a first turbine output port 206. The first cross flow turbine assembly 196 may also include a first turbine shaft 208 and first turbine blades 210 secured to the first turbine shaft 208. The first cross flow turbine assembly 196 may also include a first ratchet 212, a second ratchet 214, a first sealed bearing 216, and a second sealed bearing 218.

The first cross flow turbine assembly 196 can carry out a half power cycle as depicted in FIG. 24. FIG. 24 depicts a portion of a volume of fluid 70 (as indicated by arrow 201) from the first pressure output port 72 entering the first turbine input port 204 which rotates the first turbine blades 210 and therefore the first turbine shaft 208 in the first angular direction (as indicated by arrow 199). The fluid 70 which enters the first turbine input port 204 interacts with the turbine blades 210 such that the energy of the fluid 70 is converted into rotational motion (as indicated by arrow 199) of the first turbine shaft 208. The first ratchet 212 and the second ratchet 214 are configured to engage with and rotate with the first turbine shaft 208 when it moves in the first angular direction, and the first ratchet 212 and the second ratchet 214 are configured to not engage with the first turbine shaft 208 when it rotates in the second angular direction. The rotation of the first ratchet 212 and the second ratchet 214 in the first angular direction (as indicated by arrows 197) results in the rotation of the wheels 20 attached to the first ratchet 212 and second ratchet 214 in the first angular direction and therefore a translation of the rotation powered vehicle 196 in the first linear direction. The fluid 70 may then exit the first cross flow turbine assembly 196 through the first turbine output port 206 as indicated by arrow 203 in FIG. 24.

The second cross flow turbine assembly 200 may include a second turbine body having a second turbine input port 205 and a second turbine output port 207. The assembly may also include a second turbine shaft, second turbine blades, a third ratchet 215, a fourth ratchet 217, a third sealed bearing and a fourth sealed bearing. All of these components may be configured similarly to their respective counterparts which are shown in FIG. 24.

Figure 26:
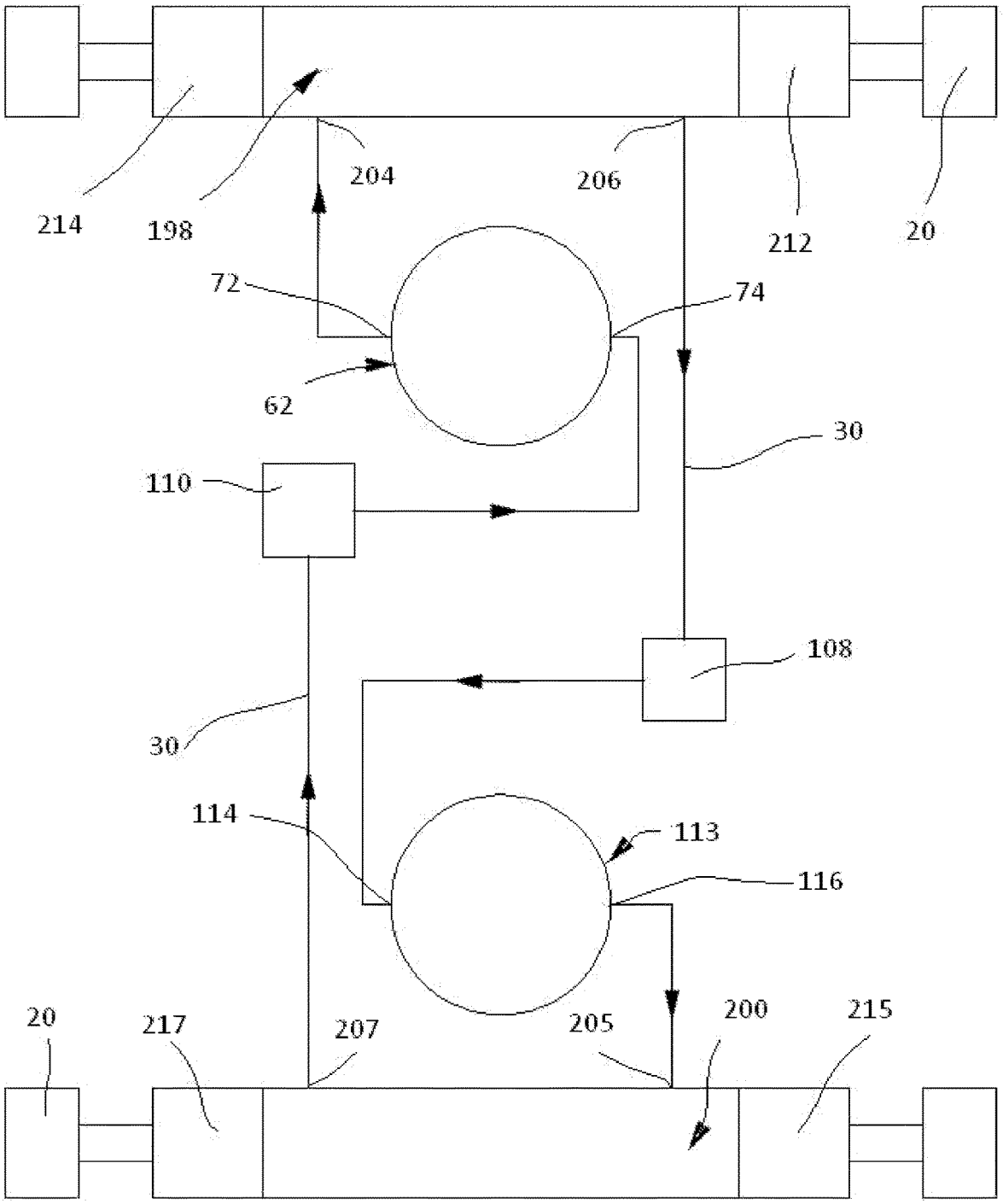
FIG. 26 is a schematic of the fluid routing for a cross flow turbine powered embodiment of a rotation powered vehicle.

A power cycle for the rotation powered vehicle embodiment 196 depicted in FIG. 23 is carried out analogously to the power cycle of the rotation powered vehicle 10 depicted in FIG. 1. FIG. 26 is a schematic which indicates the fluid connections for the rotation powered vehicle 196 of FIG. 23. The schematic represents the first cross flow turbine assembly 198 which includes the first ratchet 212, the second ratchet 214, and two wheels 20 attached to the first ratchet 212 and the second ratchet 214. The first cross flow turbine assembly 198 also includes a first turbine input port 204 and a first turbine output port 206. FIG. 26 also depicts the first pressure chamber assembly 62, and a first one way valve 108. The schematic also depicts the second cross flow turbine assembly 200 which includes the third ratchet 215, the fourth ratchet 217, and two wheels 20 attached to the third ratchet 215 and the fourth ratchet 217. The second cross flow turbine assembly 200 also includes a second turbine input port 205 and a second turbine output port 207. FIG. 26 also depicts the second pressure chamber assembly 113, and a second one way valve 110.

As can be seen in FIG. 26, the first turbine input port 204 is in fluid communication with the first pressure output port 72. It can also be seen that the first turbine output port 206 is in fluid communication with the second pressure input port 114, with a first one way valve 108 between the first turbine output port 90 and the second pressure input port 114. The first one way valve 108 ensures that fluid does not exit the second pressure input port 114 during a second half power cycle. The second turbine input 205 is in fluid communication with the second pressure output port 116. The second turbine output port 207 is in fluid communication with the first pressure input port 74, with a second one way valve 112 between the second turbine output port 207 and the first pressure input port 74. The second one way valve 112 ensures that fluid does not exit the first pressure input port 74 during a first half power cycle.

A power cycle for the rotation powered vehicle embodiment 196 depicted in FIG. 23 is carried out analogously to the power cycle of the rotation powered vehicle 10 depicted in FIG. 1. That is to say the flowchart depicted in FIG. 15 can be applied to the rotation powered vehicle 196 depicted in FIG. 23. The only difference being the manner in which the first and second turbine blades interact with the fluid. For the case of the rotation powered board embodiment 10 of FIG. 1, the first and second turbine blades are screw turbine blades. For the case of the rotation powered board embodiment 196 of FIG. 23, the first and second turbine blades are cross flow turbine blades.

Another embodiment of a rotation powered vehicle with yet another type of turbine drive is depicted in FIGS. 27-29. The rotation powered vehicle embodiment 220 incorporates a first Tessla turbine assembly 222 and a second Tessla turbine assembly 224. Other than the first Tessla turbine assembly 222 and the second Tessla turbine assembly 224, the rotation powered vehicle embodiment 220 may include components which may be similar to the components of the rotation powered vehicle 10 depicted in FIG. 1. These components may include a platform 10, a chassis 18, a first pressure chamber assembly 62, a second pressure chamber 113, and a quantity of flexible tubing 30. The first pressure chamber assembly 62 may include a first pressure input port 74 and a first pressure output port 72, and the second pressure chamber assembly 113 may include second pressure input port 114 and a second pressure output port 116.

Figure 31:
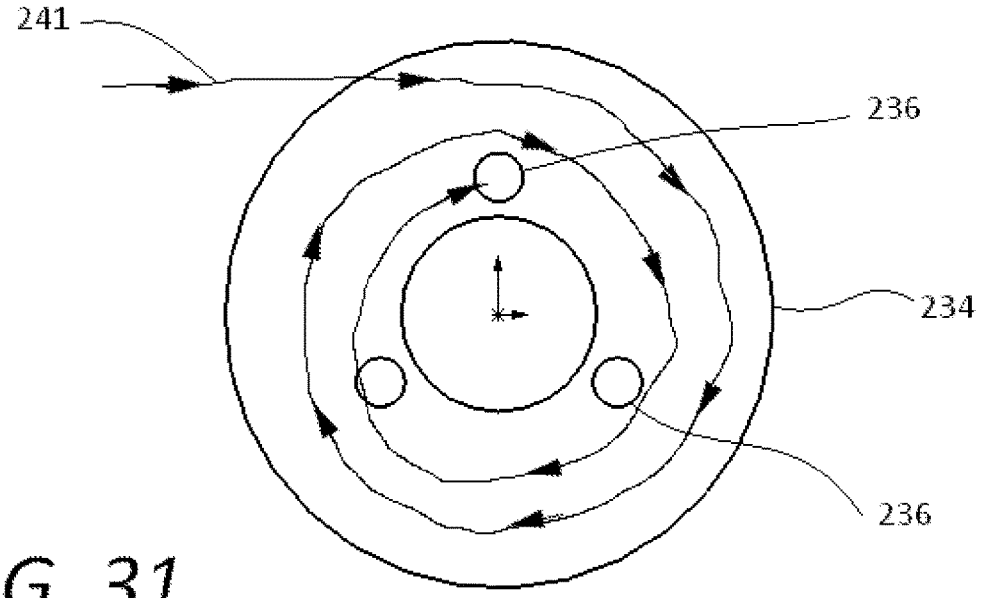
FIG. 31 depicts a Tessla turbine blade.
Figure 32:
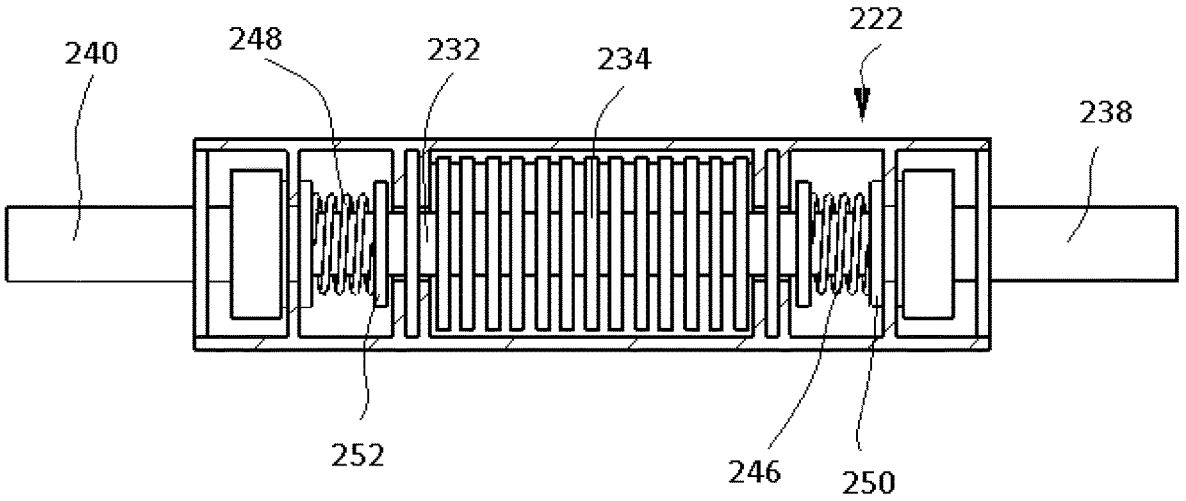
FIG. 32 depicts a sectional view of a Tessla turbine drive of the embodiment of a rotation powered vehicle of FIG. 27.

FIG. 30 is depicts the first Tessla turbine assembly 222 which may include a first turbine body 226 having a first turbine input port 228 and a first turbine output port 230. The first Tessla turbine assembly 222 may also include a first turbine shaft 232 and first turbine blades 234 secured to the first turbine shaft 232. The first Tessla turbine assembly 222 may also include a first ratchet 238, a second ratchet 240, a first sealed bearing 242, and a second sealed bearing 244. A single Tessla turbine blade is shown in FIG. 31. The Tessla turbine blades 234 are configured side by side as shown in FIG. 32. As shown in FIG. 30, fluid 70 may enter the first turbine body 226 through the first turbine input port 228 as indicated by arrow 233. The fluid 70 may then exit the first turbine body through the first turbine output port 230 as indicated by arrow 235. The fluid 70 interacts with the turbine blades 234 such that energy from the fluid 70 is transferred to the turbine blades 234. As shown in FIG. 31, as fluid enters the first turbine body 226 and interacts with the Tessla turbine blade 234 the fluid spirals (as indicated by arrow 241 in FIG. 31) toward the center of the Tessla turbine blade 234 where it can exit the space between two Tessla turbine blades 234 in a series of holes 236 which are near the first turbine shaft 232. The fluid transfers energy to the Tessla turbine blades 234 as it spirals towards the holes 236 thereby causing the Tessla turbine blades 234 to rotate as indicated by arrow 239. The rotation of the Tessla turbine blades 234 results in the rotation of the first turbine shaft 232 which in turn results in the rotation of the first ratchet 238 and the second ratchet 240 as indicated by arrows 237 in FIG. 30.

The first Tessla turbine assembly 222 can carry out a half power cycle as depicted in FIG. 30. FIG. 30 depicts a portion of a volume of fluid 70 from the first pressure output port 72 entering the first turbine input port 228 which rotates the first turbine blades 234 and therefore the first turbine shaft 232 in the first angular direction. The first ratchet 238 and the second ratchet 240 are configured to engage with and rotate with the first turbine shaft 232 when it moves in the first angular direction, and the first ratchet 238 and the second ratchet 240 are configured to not engage with the first turbine shaft 232 when it rotates in the second angular direction. The rotation of the first ratchet 238 and the second ratchet 240 in the first angular direction results in the rotation of the wheels 20 attached to the first ratchet 238 and second ratchet 240 in the first angular direction and therefore a translation of the rotation powered vehicle 220 in the first linear direction.

The first Tessla turbine assembly 222 depicted in FIGS. 30 and 31 may also include a first spring 246, a second spring 248, a first bushing 250, and a second bushing 252. The first spring 246 may apply a force to the first bushing 250 in order to provide a rotational fluid seal between the first bushing 250 and the first turbine body 226. Similarly, the second spring 248 may apply a force to the second bushing 252 in order to provide a rotational fluid seal between the second bushing 252 bushing and the first turbine body 226.

The second cross flow turbine assembly 224 may include a second turbine body having a second turbine input port 229 and a second turbine output port 231. The assembly may also include a second turbine shaft, second turbine blades, a third ratchet 243, a fourth ratchet 245, a third sealed bearing and a fourth sealed bearing. All of these components may be configured similarly to their respective counterparts which are shown in FIG. 30.

Figure 33:
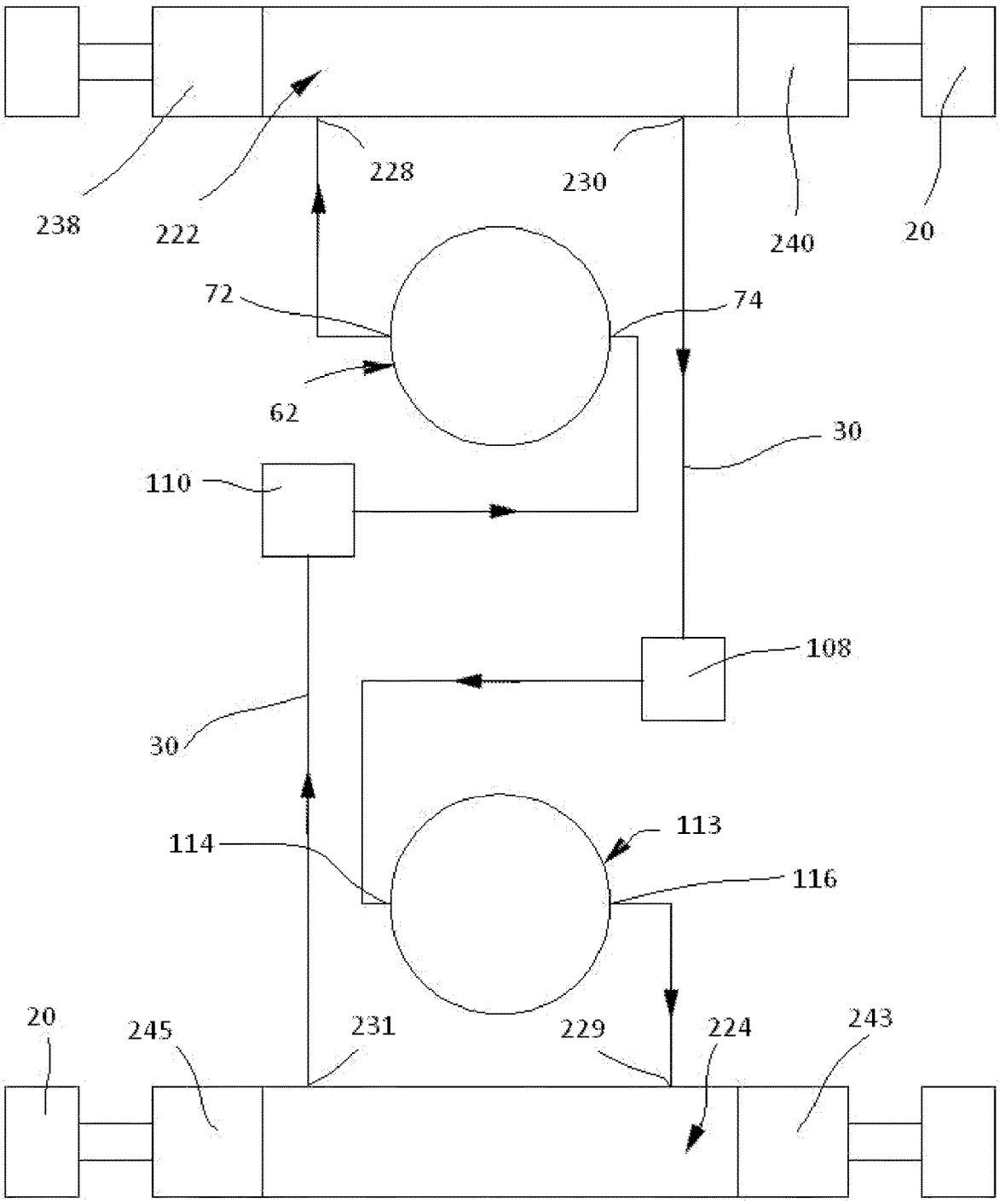
FIG. 33 is a schematic of the fluid routing for a Tessla turbine powered embodiment of a rotation powered vehicle.
Figure 34:
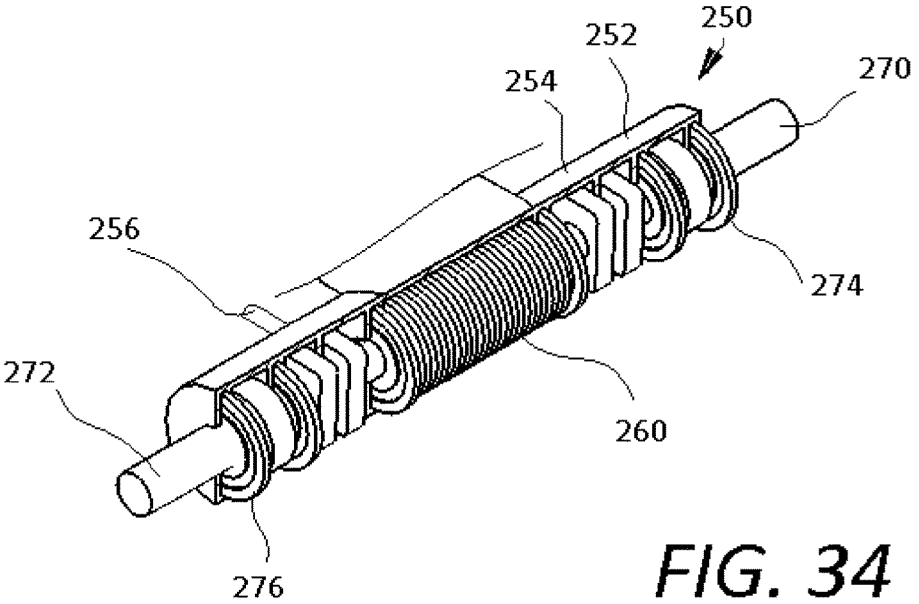
FIGS. 34-37 depict a Tessla turbine embodiment with a magnetic clutch.
Figure 35:
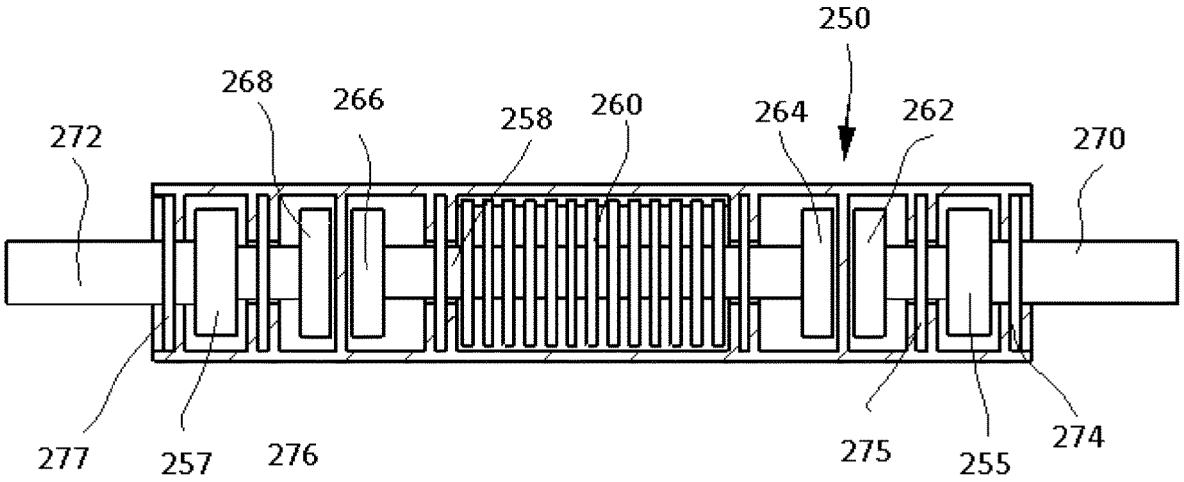

A power cycle for the rotation powered vehicle embodiment 220 depicted in FIG. 27 is carried out analogously to the power cycle of the rotation powered vehicle 10 depicted in FIG. 1. FIG. 33 is a schematic which indicates the fluid connections for the rotation powered vehicle 220 of FIG. 27. The schematic represents the first Tessla turbine assembly 222 which includes the first ratchet 238, the second ratchet 240, and two wheels 20 attached to the first ratchet 238 and the second ratchet 240. The first Tessla assembly 222 also includes a first turbine input port 228 and a first turbine output port 230. FIG. 33 also depicts the first pressure chamber assembly 62, and a first one way valve 108. The schematic also depicts the second Tessla turbine assembly 224 which includes the third ratchet 243, the fourth ratchet 245, and two wheels 20 attached to the third ratchet 243 and the fourth ratchet 245. The second Tessla turbine assembly 224 also includes a second turbine input port 229 and a second turbine output port 231. FIG. 33 also depicts the second pressure chamber assembly 113, and a second one way valve 110.

As can be seen in FIG. 33, the first turbine input port 228 is in fluid communication with the first pressure output port 72. It can also be seen that the first turbine output port 230 is in fluid communication with the second pressure input port 114, with a first one way valve 108 between the first turbine output port 90 and the second pressure input port 114. The first one way valve 108 ensures that fluid does not exit the second pressure input port 114 during a second half power cycle. The second turbine input 229 is in fluid communication with the second pressure output port 116.

The second turbine output port 231 is in fluid communication with the first pressure input port 74, with a second one way valve 112 between the second turbine output port 207 and the first pressure input port 74. The second one way valve 112 ensures that fluid does not exit the first pressure input port 74 during a first half power cycle.

A power cycle for the rotation powered vehicle embodiment 220 depicted in FIG. 27 is carried out analogously to the power cycle of the rotation powered vehicle 10 depicted in FIG. 1. That is to say flowchart depicted in FIG. 15 can be applied to the rotation powered vehicle 220 depicted in FIG. 27. The only difference being the manner in which the first and second turbine blades interact with the fluid. For the case of the rotation powered board embodiment 10 of FIG. 1, the first and second turbine blades are screw turbine blades. For the case of the rotation powered board embodiment 220 of FIG. 10, the first and second turbine blades are Tessla turbine blades.

FIGS. 34-37 depict a Tessla turbine assembly embodiment 250 which includes a magnetic clutch feature. The Tessla turbine assembly embodiment 250 may include a turbine body 252, a turbine input port 254, a turbine output port 256, a turbine shaft 258, and turbine blades 260. The Tessla turbine assembly 250 may also include a first magnet 262, a second magnet 264, a third magnet 266, a fourth magnet 268, a first ratchet 270, a second ratchet 272, a first bearing 274, and a second bearing 276. The Tessla turbine assembly embodiment 250 may also include a first collet, a second collet 257, a first bearing 274, a second bearing 275, a third bearing 276, and a fourth bearing 277.

Figure 36:
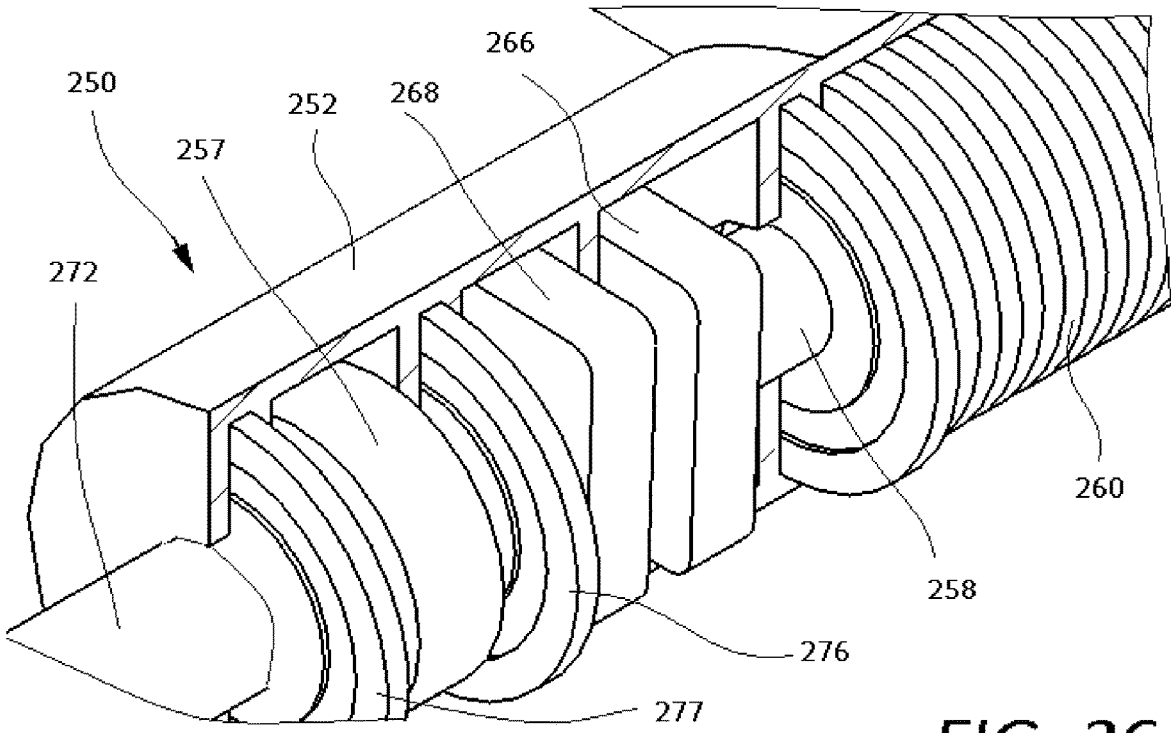
Figure 37:
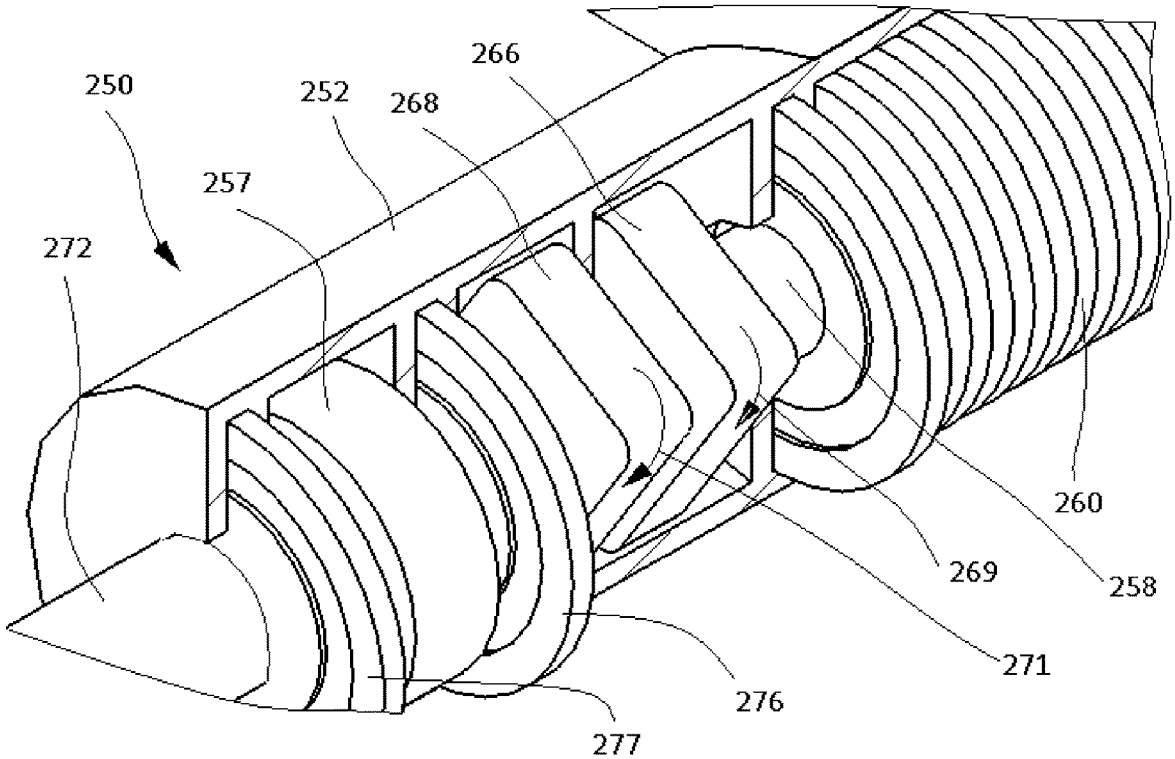

The purpose of the magnetic clutch is to isolate the fluid around the turbine blades from the ratchets which drive the wheels. This will prevent fluid from leaking around the turbine shaft 258 and exiting the turbine body 252. FIGS. 36 and 37 depict a partial rotation of the magnetic clutch. The third magnet 266 may be magnetically coupled to the fourth magnet 268. As the turbine shaft 258 rotates the third magnet 266 in the first angular direction (as indicated by arrow 269), the fourth magnet 268 also rotates in the first angular direction (as indicated by arrow 271) thereby rotating the second ratchet 272 in the first angular direction. The same thing happens to the first magnet 262 and second magnet 264: as the turbine shaft 258 rotates the second magnet 264 in the first angular direction, the first magnet 262 also rotates in the first angular direction thereby rotating the first ratchet 270 in the first angular direction. The magnetic clutch configuration may be used on any of the rotation powered vehicle turbine embodiments which are discussed in the document.

Yet another embodiment of a rotation powered vehicle is depicted in FIGS. 38-42. The rotation powered board embodiment 278 uses the transfer of fluid between two chambers to provide power to the wheels for a given half power cycle. This rotation powered board 298 may include a chassis 280 and a rigid platform 282 which is pivotally secured to the chassis 280 by a platform pivot section 283. The rotation powered board 298 may also include a first pressure chamber 284 which may be secured to the platform 282, and which may incorporate a first pressure port 286 which is in fluid communication with a first pressure interior volume 288.

A first pressure piston 290 (see FIG. 44) may be pivotally secured to the chassis 280, and the first pressure piston 290 may be slidably disposed within the first pressure interior volume 288. The first pressure piston 290 and the first pressure interior volume 288 may form a first variable volume 292. The first variable volume 292 will expand when the platform 282 rotates in the first angular direction, and the first variable volume 292 will contract when the platform 282 is rotated in the second angular direction. The expansion and contraction of the first variable volume 292 is the result of the movement of the first pressure piston 290 within the first pressure interior volume 288.

A first drive chamber 294 (see FIG. 44) may be secured to the chassis 280. The first drive chamber 294 can include a first drive interior volume 296 disposed within the first drive chamber 294, and a first drive port 298 which is in fluid communication with the first drive interior volume 296. The first drive port 298 is also in fluid communication with the first pressure port 286. A first drive piston 300 may be disposed within the first drive interior volume 296 and a first rack 302 may be rigidly secured to the first drive piston 300. Together the first drive piston 300 and the first drive interior volume 296 form a second variable volume 304. The second variable volume 304 may expand when fluid enters the first drive port 298 thereby extending the first rack 302 from the first drive chamber 294, or the second variable volume 304 may contract when fluid exits the first drive port 298 thereby retracting the first rack 302 into the first drive chamber 294.

The rotation powered board 298 may also include a second pressure chamber 306 which may be secured to the platform 282, and which may incorporate a second pressure port 308 which is in fluid communication with a second pressure interior volume 310. A second pressure piston 312 may be pivotally secured to the chassis 280, and the second pressure piston 312 may be slidably disposed within the second pressure interior volume 310. The second pressure piston 312 and the second pressure interior volume 310 may form a third variable volume 314. The third variable volume 314 will expand when the platform 282 rotates in the first angular direction, and the third variable volume 314 will contract when the platform 282 is rotated in the second angular direction. The expansion and contraction of the third variable volume 314 is the result of the movement of the second pressure piston 312 within the second pressure interior volume 310.

A second drive chamber 316 may be secured to the chassis 280. The second drive chamber 316 can include a second drive interior volume 318 disposed within the second drive chamber 316, and a second drive port 320 which is in fluid communication with the second drive interior volume 318. The second drive port 320 is also in fluid communication with the second pressure port 308. A second drive piston 322 may be disposed within the second drive interior volume 318 and a second rack 324 may be rigidly secured to the second drive piston 322. Together the second drive piston 322 and the second drive interior volume 318 form a fourth variable volume 326. The fourth variable volume 326 may expand when fluid enters the second drive port 320 thereby extending the second rack 324 from the second drive chamber 316, or the fourth variable volume 326 may contract when fluid exits the second drive port 320 thereby retracting the second rack 324 into the second drive chamber 316.

Figure 38:
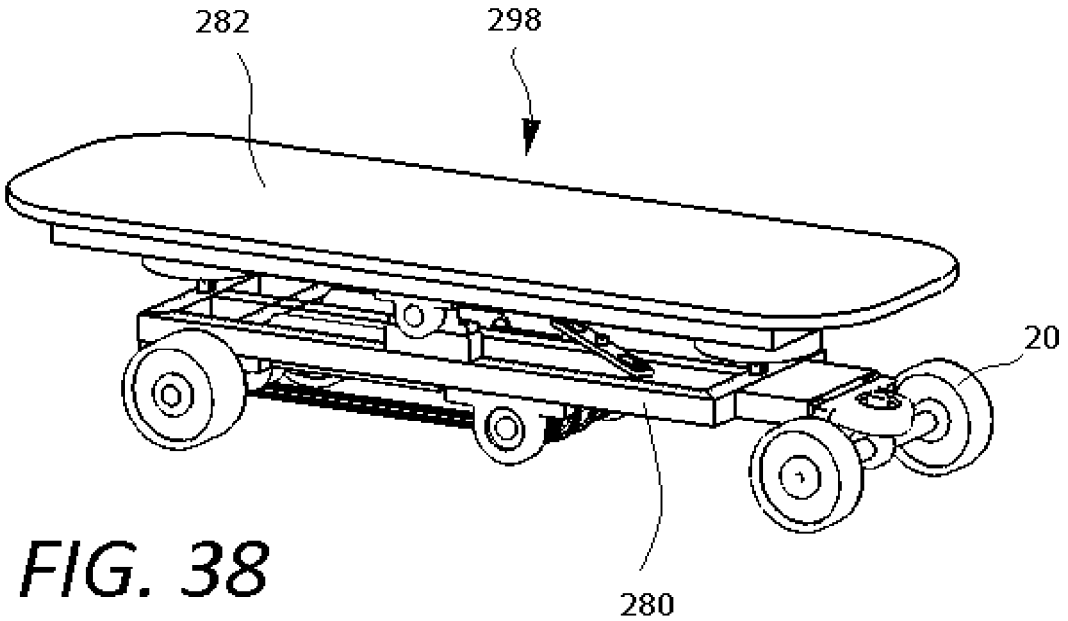
FIGS. 38-42 depict a rotation powered vehicle embodiment which incorporates a hydraulic rack and pinion drive.
Figure 39:
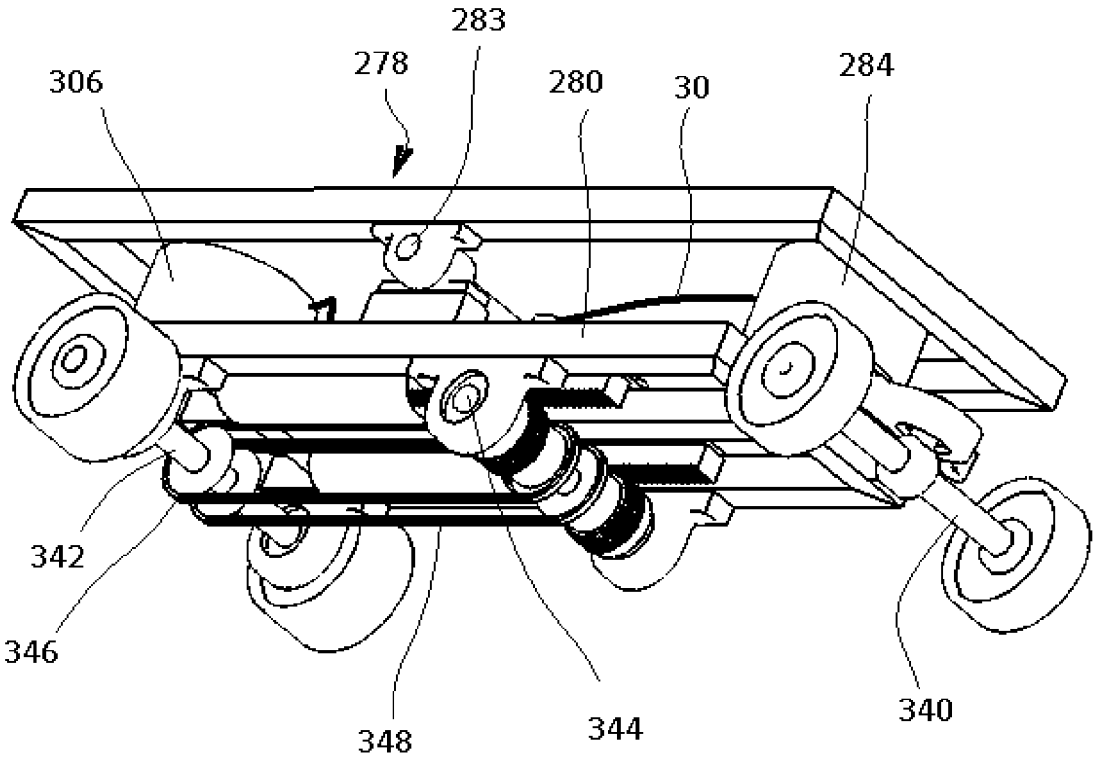
Figure 40:
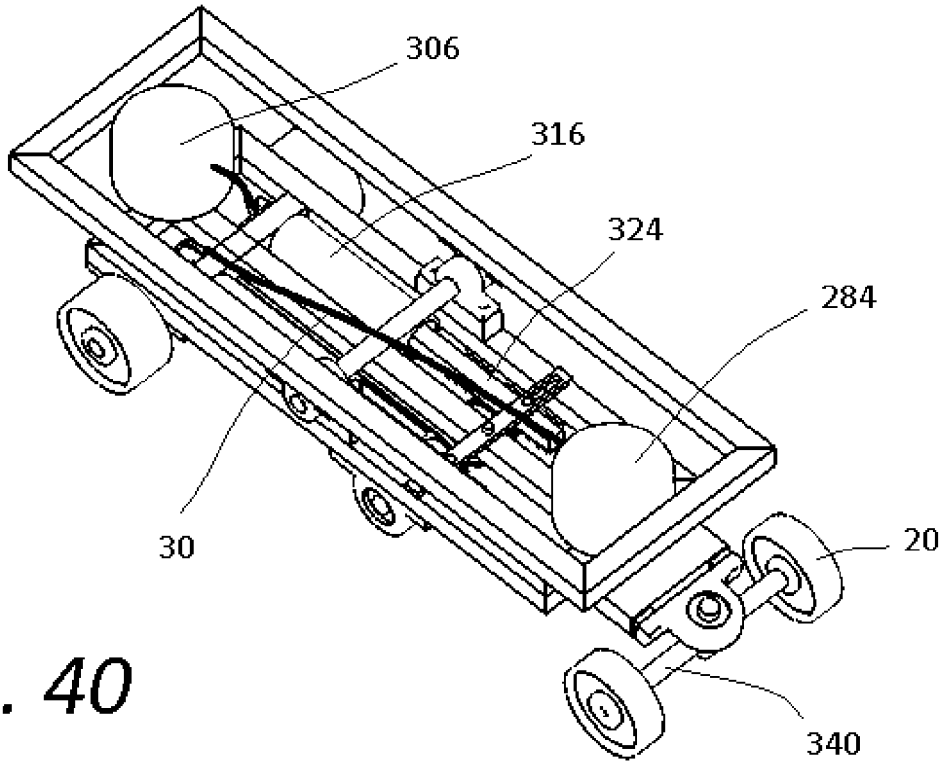

The rotation powered vehicle 298 of FIG. 38 may also include a first volume of fluid 328 which may be partially disposed within either the first variable volume 292 or the second variable volume 304. The embodiment may also include a second volume of fluid 330 which may be partially disposed within either the third variable volume 314 or the fourth variable volume 326.

The rotation powered vehicle 298 of FIG. 38 may also include a first gear 332 which is coupled to a first ratchet 334. The first ratchet 334 may be configured to engage the first gear 332 and rotate with the first gear 332 if the first gear 332 is rotating in the first angular direction. The first ratchet 334 may also be configured not to engage the first gear 332 when the first gear 332 rotates in the second angular direction. The rotation powered vehicle 298 may also include a second gear 336 which is coupled to a second ratchet 338. The second ratchet 338 may be configured to engage the second gear 336 and rotate with the second gear 336 if the second gear 336 is rotating in the first angular direction. The second ratchet 338 may also be configured not to engage the second gear 336 when the second gear 336 rotates in the second angular direction.

The rotation powered vehicle 298 may also include a front axle 240 which is pivotally secured to the chassis 280 and which allows for the steering of the rotation powered vehicle 278. The rotation powered vehicle 298 may also include a drive axle 342 which is may be coupled to the first gear 332 by a first chain 346. The drive axle 342 may also be coupled to the second gear 336 by a second chain 348.

Figure 43:
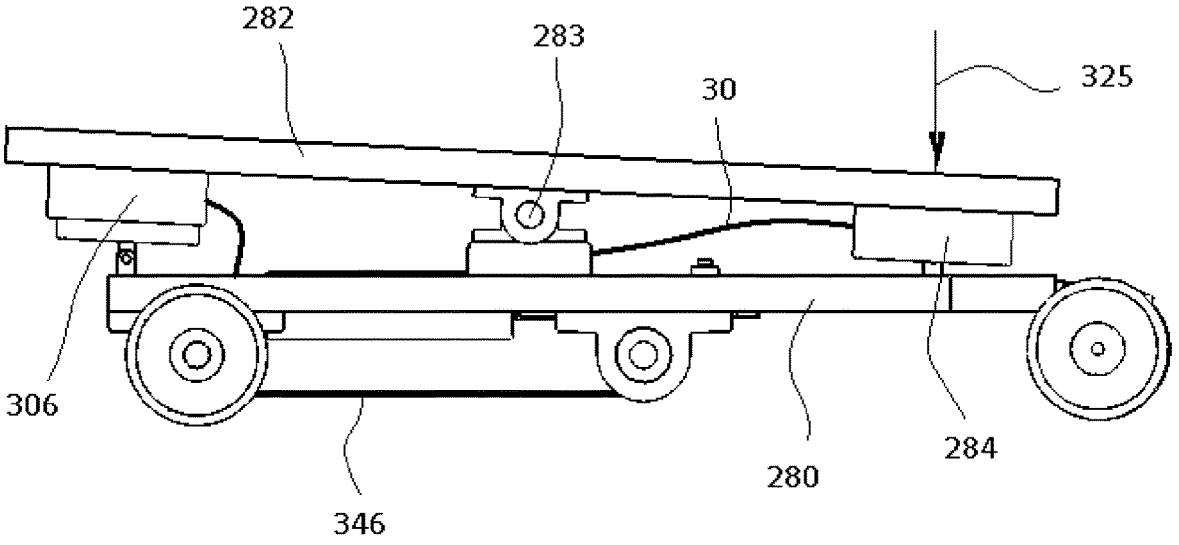
FIG. 43 depicts the rotation powered vehicle of FIG. 38 undergoing a first power cycle.
Figure 44:
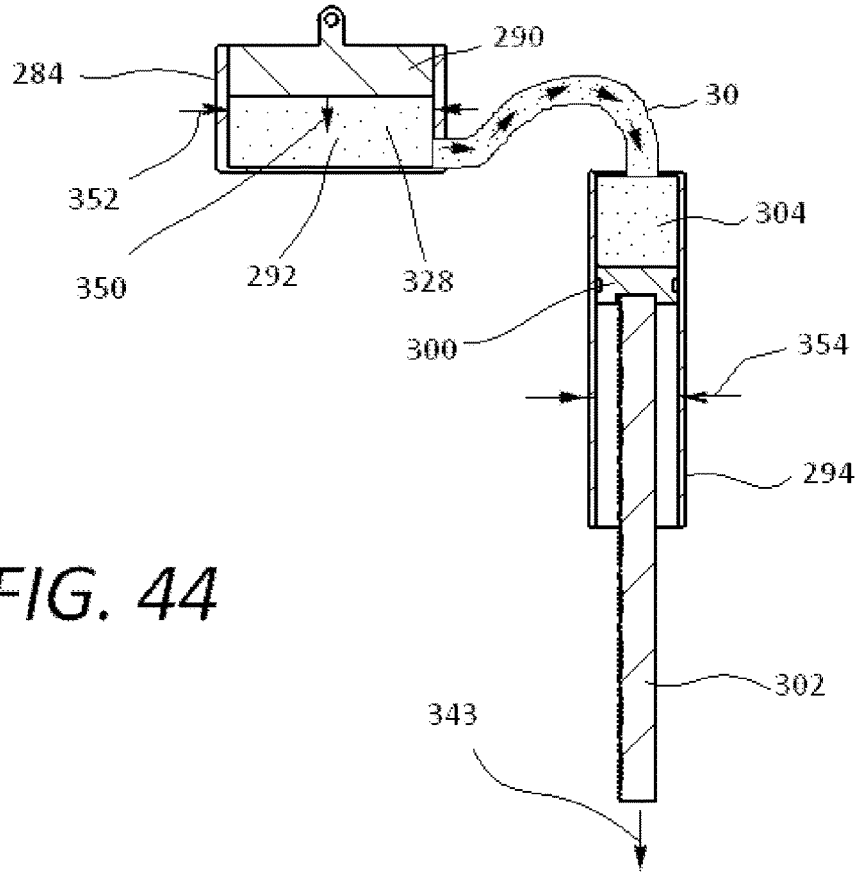
FIG. 44 depicts a pressure chamber and a drive chamber with a fluid being transferred from the pressure chamber to the drive chamber.

FIGS. 43-46 depict the rotation powered vehicle 278 undergoing a first half power cycle. FIG. 43 depicts the platform 282 being rotated in the first angular direction by the application of a force 325 to the platform 282. The rotation of the platform 282 in the first angular direction collapses the first variable volume 292 and transfers a portion of the first volume of fluid 328 to the second variable volume 304 which expands the second variable volume 304 and extends the first rack 302 from the first drive chamber 294. This process is shown in FIG. 44 which depicts the first pressure chamber 284, the first pressure piston 290, the first drive chamber 294, the first drive piston 300, the first volume of fluid 328, the first variable volume 292, and the second variable volume 304. FIG. 44 depicts a force indicated by arrow 350 moving the first pressure piston 290 into the first pressure interior volume 288 thereby collapsing the first variable volume 292. This forces a portion of the first volume of fluid 328 into the second variable volume 304 which expands and extends the first drive piston 300 and the first rack 302 out of the first drive interior volume 296 as indicated by arrow 343.

FIG. 44 also depicts a pressure chamber diameter 352 and a drive chamber diameter 354. It is the relationship between these two diameters that will determine the relative motion of the first pressure piston 290 with respect to the motion of the first drive piston 300. For example if the diameters are circular and the radius of the first pressure chamber 284 is r1 and the radius of the first drive chamber 284 is r2 then by equating volumes in the two chambers one gets the following equation:

$$L2 = L1 * \frac{r1^2}{r2^2} \tag{1}$$

where L1 is the distance the first pressure piston 290 travels and L2 is the distance the first drive piston 300 travels. So if r1 is 3" and r2 is 1", the L2 is 9 times L1, that is for every inch that the first pressure piston 290 moves the first drive piston 300 will move 9 inches. Similarly, the ratio between the two diameters can be used to act as a force limiter or a force multiplier. By equating pressures in the two chambers:

$$F2 = F1 * \frac{r2^2}{r1^2} \tag{2}$$

where F1 is the force on the first pressure piston 290 and F2 is the resultant force on the first drive piston 300. So if r1 is 3" and r2 is 1", the F2 is ⅓ the value of F1.

Figure 45:
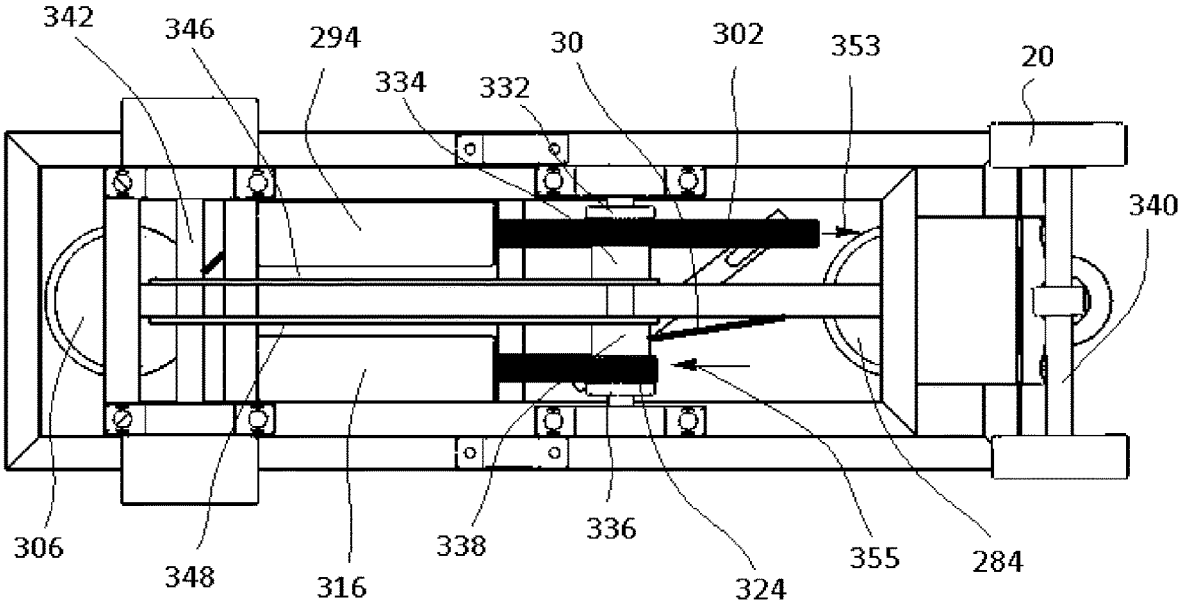
FIG. 45 depicts the rotation powered vehicle of FIG. 38 undergoing a first power cycle.
Figure 46:
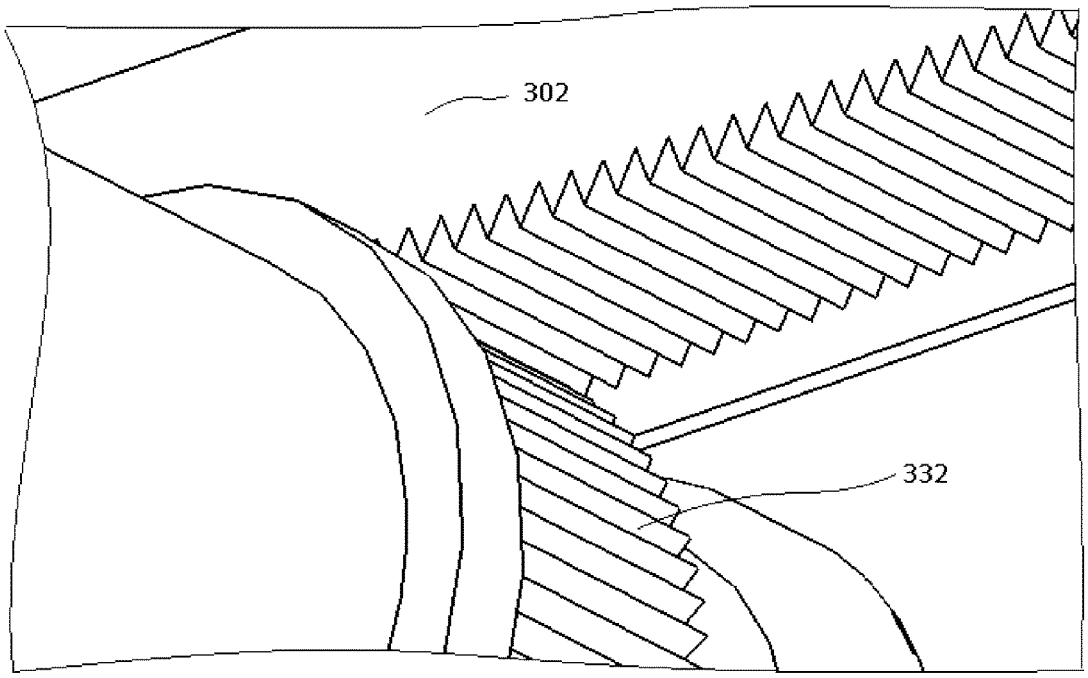
FIG. 46 depicts a rack operatively engaged with a gear, both of the rotation powered vehicle embodiment of FIG. 38.

Returning to the first half power cycle, FIG. 45 shows the first rack 302 extending from the first drive chamber 294 as indicated by arrow 353. Simultaneously, the second rack 324 retracts into the second drive chamber 316 as indicated by arrow 355. FIG. 46 depicts the first rack 302 operatively engaged with the first gear 332. As the first rack 302 extends from the first drive chamber 294, the first rack 302 turns the first gear 332 in the first angular direction. As the first gear 332 rotates in the first angular direction it rotates the first ratchet 334 in the first angular direction which in turn rotates the drive axle 342 in the first angular direction thereby translating the rotation powered vehicle 278 in the first linear direction.

Figure 41:
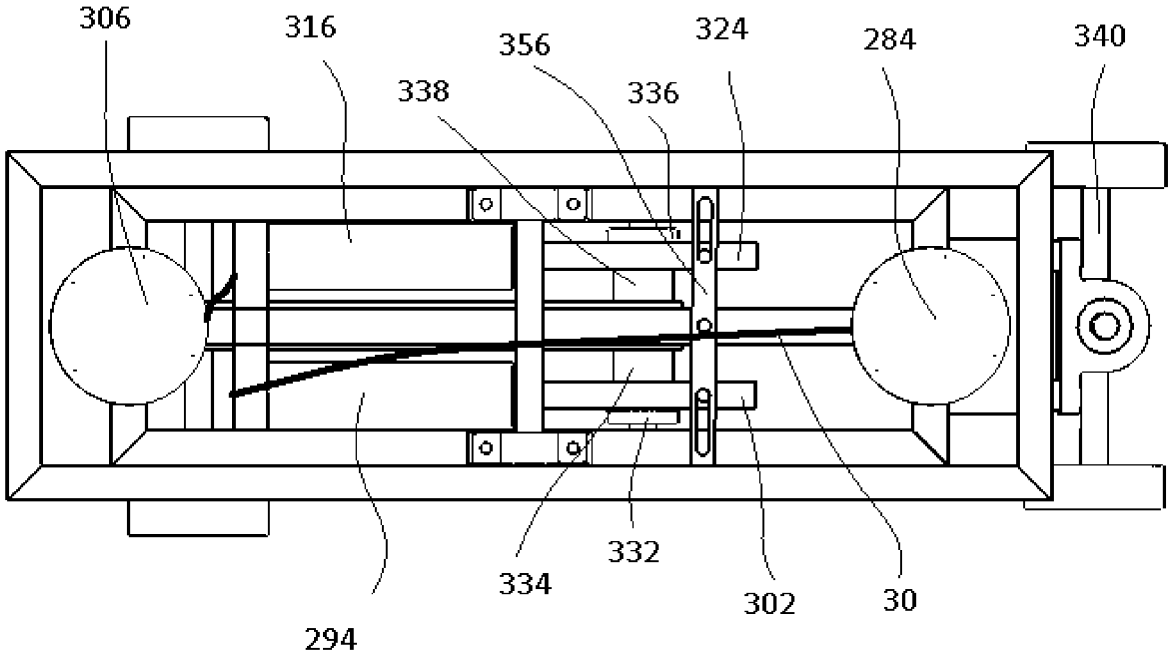
Figure 42:
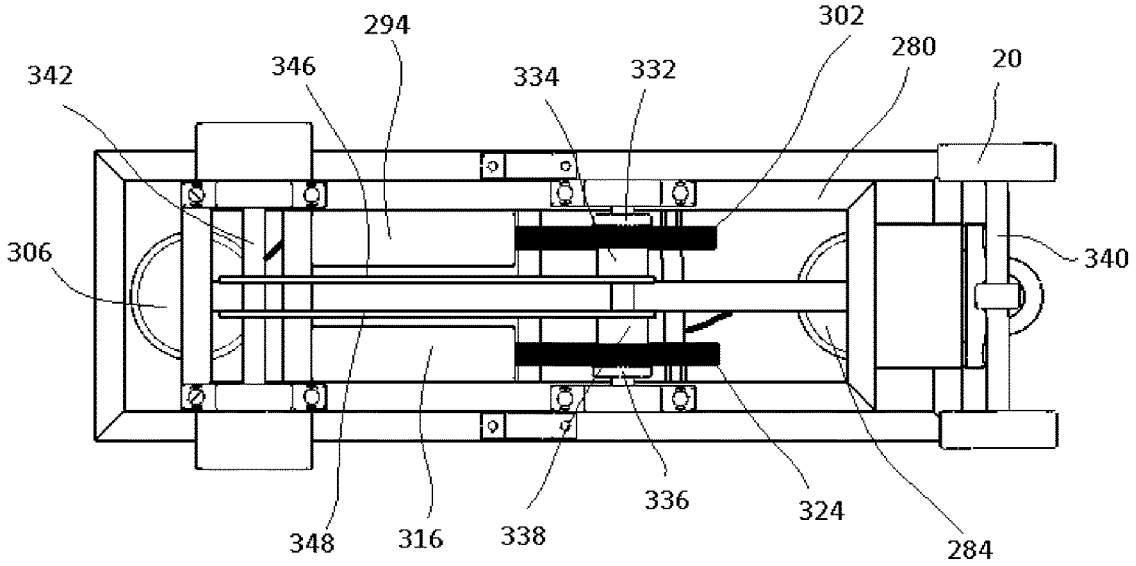

FIG. 41 shows a linkage 356 which is pivotally secured between the first rack 302 and the second rack 324. The linkage 356 acts to retract the second rack 324 into the second drive chamber 316 as the first rack 302 extends from the first drive chamber 294. In turn the linkage 356 acts to retract the first rack 302 into the first drive chamber 294 as the second rack 324 extends from the second drive chamber 316.

Figure 47:
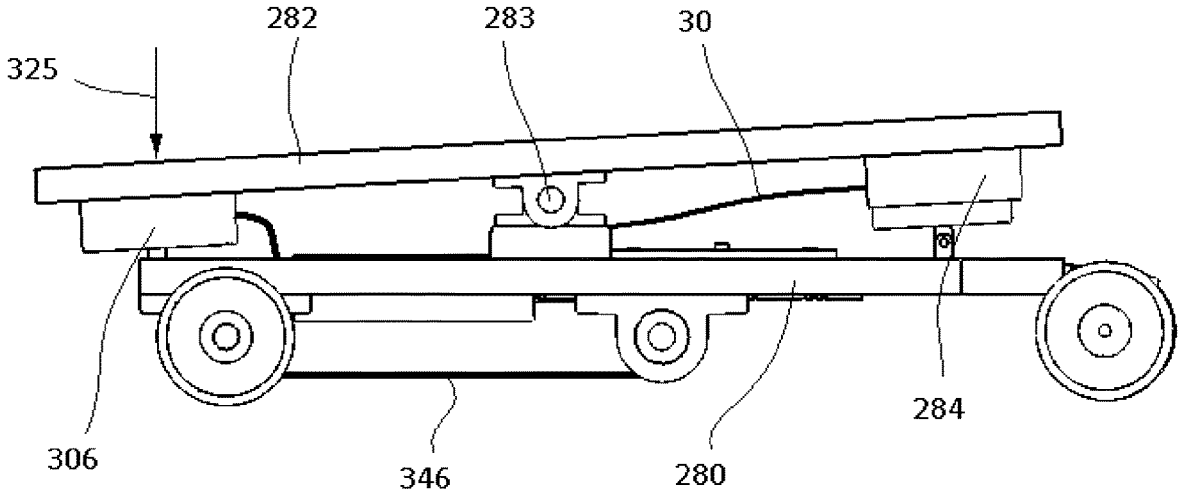
FIGS. 47 and 48 depict the rotation powered vehicle embodiment of FIG. 38 undergoing a second power cycle.
Figure 48:
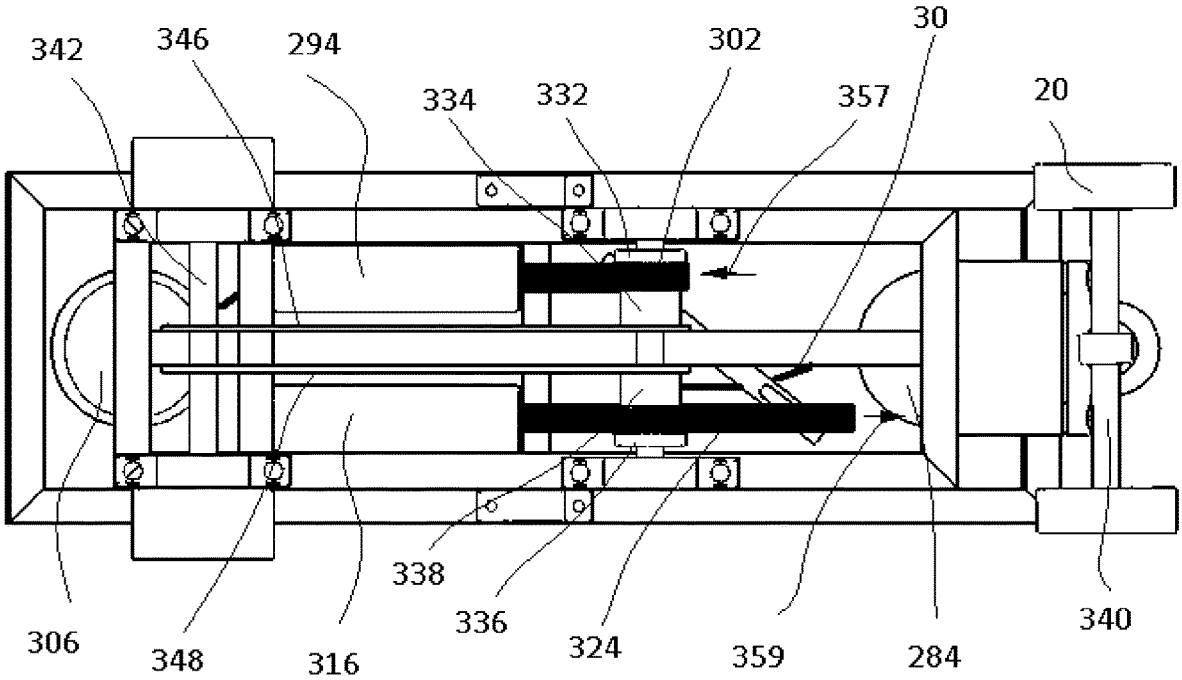

FIGS. 47 and 48 depict a second half cycle of the rotation powered vehicle 278 of FIG. 38. FIG. 47 depicts the platform 282 being rotated in the second angular direction by a force 325. The rotation of the platform 282 in the second angular direction collapses the third variable volume 314 and transfers a portion of the second volume of fluid 330 to the fourth variable volume 326 which expands the fourth variable volume 326 and extends the second rack 324 from the second drive chamber as shown in FIG. 48. As the second rack 324 extends from the second drive chamber 316 as indicated by arrow 359, the second rack 324 turns the second gear 336 in the first angular direction. Simultaneously, the first rack 302 retracts into the first drive chamber 294 as indicated by arrow 357. As the second gear 336 rotates in the first angular direction it rotates the second ratchet 338 in the first angular direction which in turn rotates the drive axle 342 in the first angular direction thereby translating the rotation powered vehicle 278 in the first linear direction.

Figure 49:
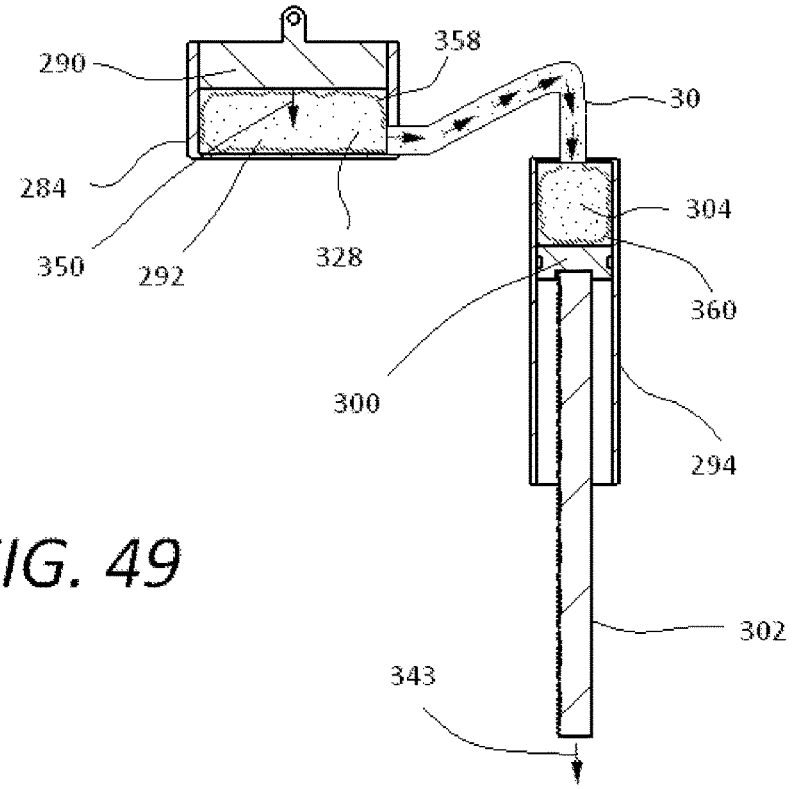
FIG. 49 depicts a pressure chamber and a drive chamber with a fluid being transferred from a flexible bladder disposed within the pressure chamber and to a flexible bladder disposed within the drive chamber.

FIG. 49 depicts an alternate drive embodiment for the rotation powered vehicle 278 of FIG. 38. FIG. 49 depicts the same elements depicted in FIG. 44 with the addition of a first flexible bladder 358 disposed within the first variable volume 292 and in fluid communication with the first pressure port 286, and a second flexible bladder 360 disposed within the second variable volume 304 and in fluid communication with the first drive port 298.

Figure 50:
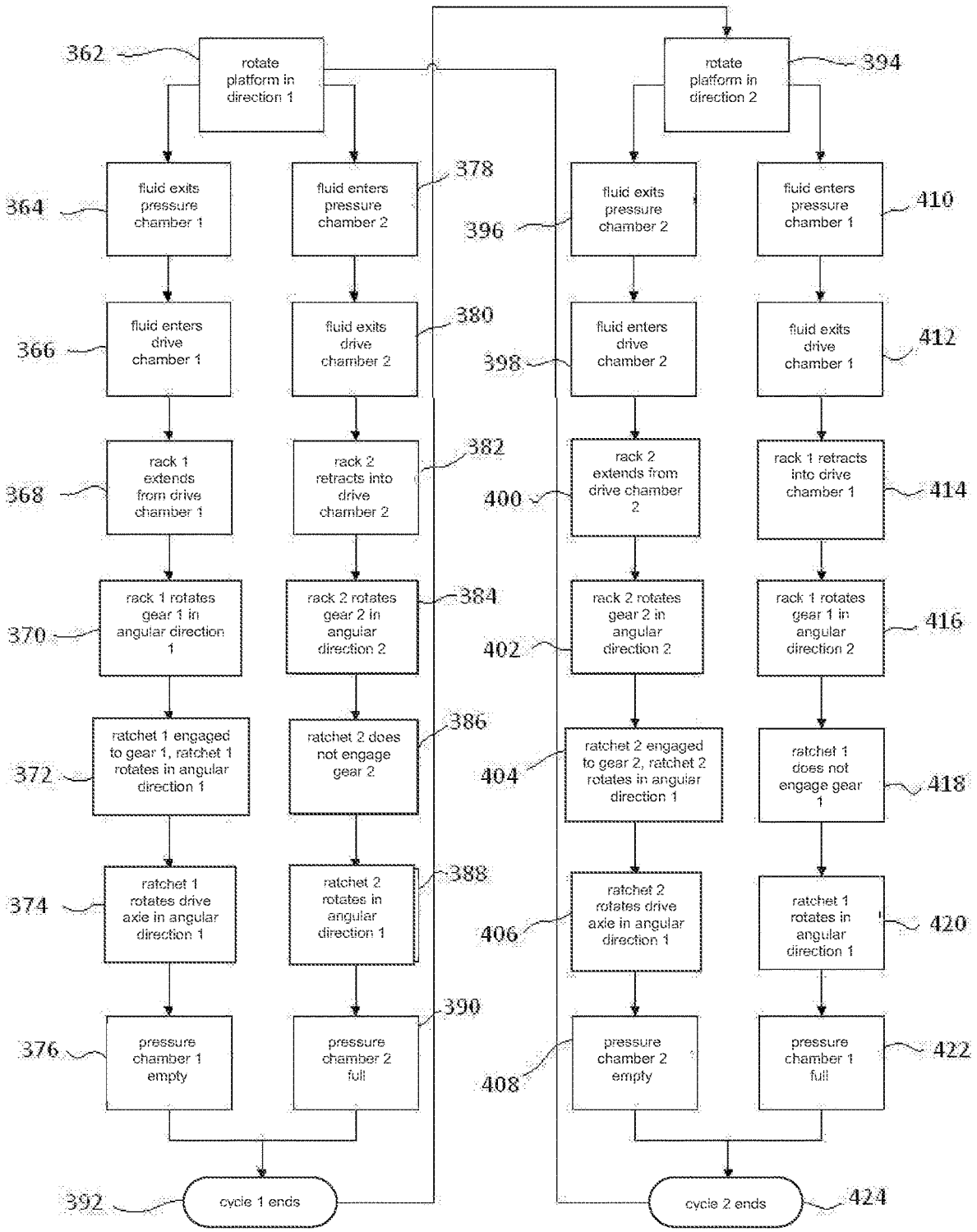
FIG. 50 is a flowchart which depicts a first power cycle and a second power cycle for the rotation powered vehicle embodiment of FIG. 38.

FIG. 50 is a flowchart which depicts the method described above for carrying out a power cycle of the rotation powered device of FIG. 38. Boxes 362-392 depict the method steps first half power cycle and boxes 394-424 depict the method steps for the second half power cycle.

FIGS. 51-54 depict another embodiment of a rotation powered vehicle 426. All of the previous rotation powered vehicle embodiments have employed hydraulic power to carry out a power cycle. The rotation powered vehicle embodiment 426 of FIG. 51 uses mechanical drive mechanisms in order to convert the rotational motion of the platform into transnational motion of the rotation powered vehicle 426.

Figure 51:
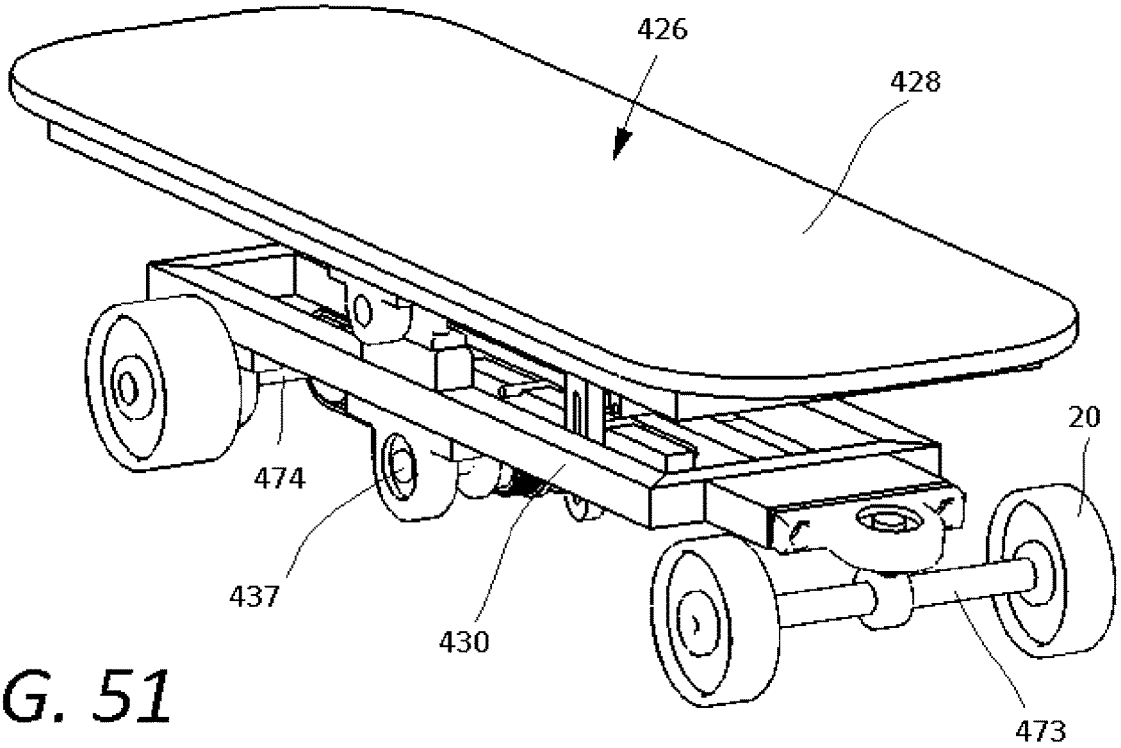
FIGS. 51-54 depict a rotation powered vehicle embodiment having a mechanical drive mechanism.
Figure 52:
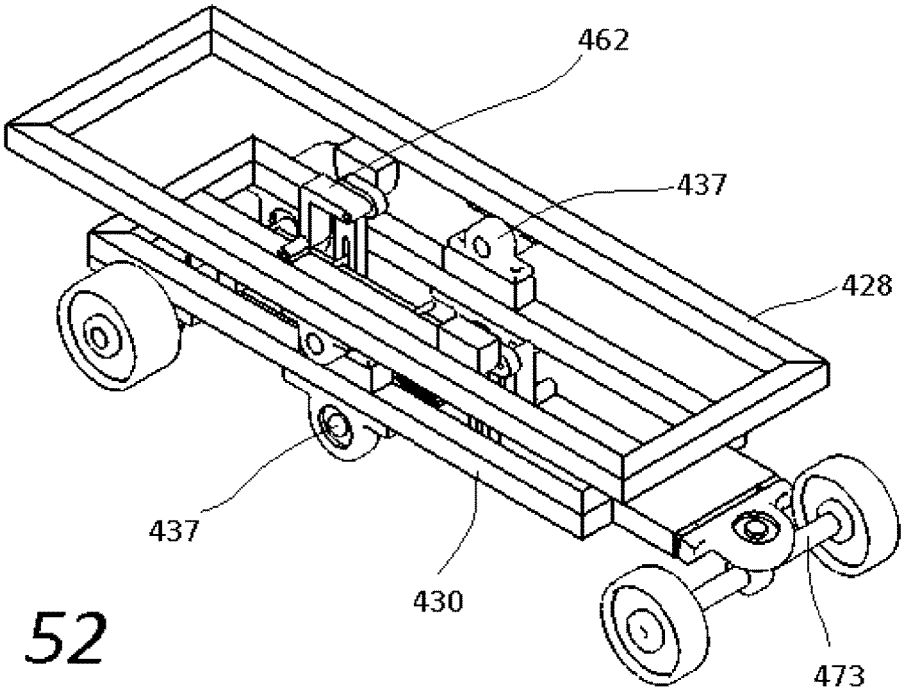
Figure 53:
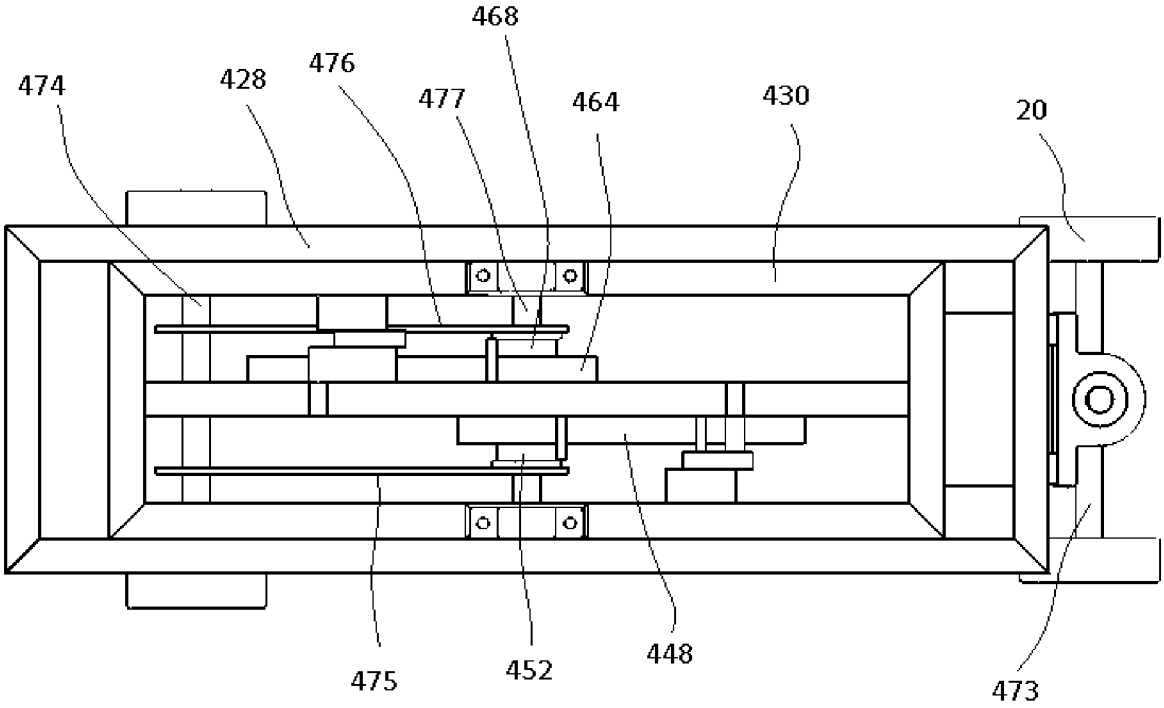
Figure 54:
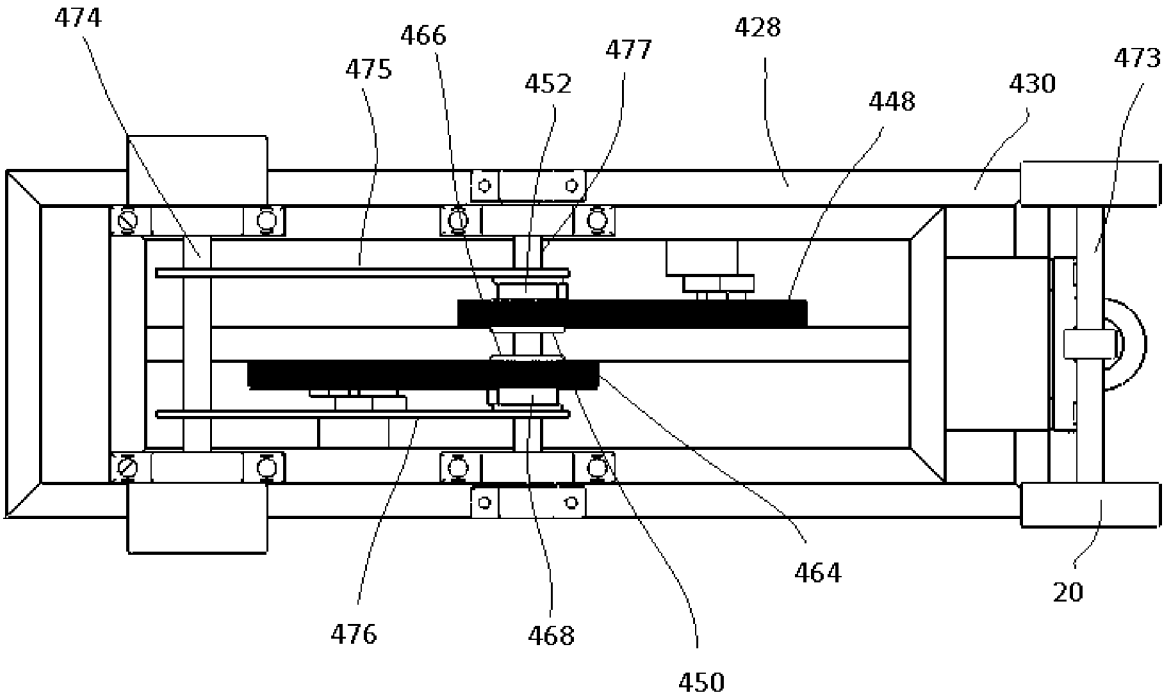

The rotation powered vehicle embodiment 426 of FIG. 51 may include a chassis 430 and a rigid platform 428 which is pivotally secured to the chasses 430 by a platform pivot section 437. The rotation powered vehicle embodiment 426 may also include a first linkage 432 which is pivotally secured to the platform 428 at a first pivot point 434 on the first linkage 432. The first linkage 432 may also include a first linkage slot 444. A first coupler link 446 may be pivotally secured to the chassis 430 and pivotally secured to a second pivot point 442 on the first linkage 438. A first rack 448 may be slidably disposed along the chassis 430, and the first rack 448 may include a first rack pin 449 which may be engaged with the first linkage slot 444.

A first gear 450 may be disposed on a gear axel 477 and may be operatively coupled to the first rack 448. A first ratchet 452 may in turn be coupled to the first gear 450. The first ratchet 452 may be configured such that it engages with and rotates with the first gear 450 if the first gear 450 rotates in the first angular direction. The first ratchet 452 may also be configured such that it does not engage the first gear 450 if the first gear 450 rotates in the second angular direction.

The rotation powered vehicle embodiment 426 may also include a second linkage 454 which is pivotally secured to the platform 428 at a third pivot point 456 on the second linkage 454. The second linkage 454 may also include a second linkage slot 460. A second coupler link 462 may be pivotally secured to the chassis 430 and pivotally secured to a fourth pivot point 458 on the second linkage 454. A second rack 464 may be slidably disposed along the chassis 430, and the second rack 464 may include a second rack pin 472 which may be engaged with the second linkage slot 460.

A second gear 466 may be disposed on the gear axel 477 and may be operatively coupled to the second rack 464. A second ratchet 468 may in turn be coupled to the second gear 466. The second ratchet 468 may be configured such that it engages with and rotates with the second gear 466 if the second gear 466 rotates in the first angular direction. The second ratchet 468 may also be configured such that it does not engage the second gear 466 if the second gear 466 rotates in the second angular direction.

The rotation powered vehicle embodiment may also include a front axle 473 which is pivotally secured to the chassis 430 and which allows for the steering of the rotation powered vehicle 426. The embodiment may also include a drive axle 474 which is secured to the first gear 450 by a first chain 475, and which is secured to the second gear 466 by a second chain 476.

Figure 55:
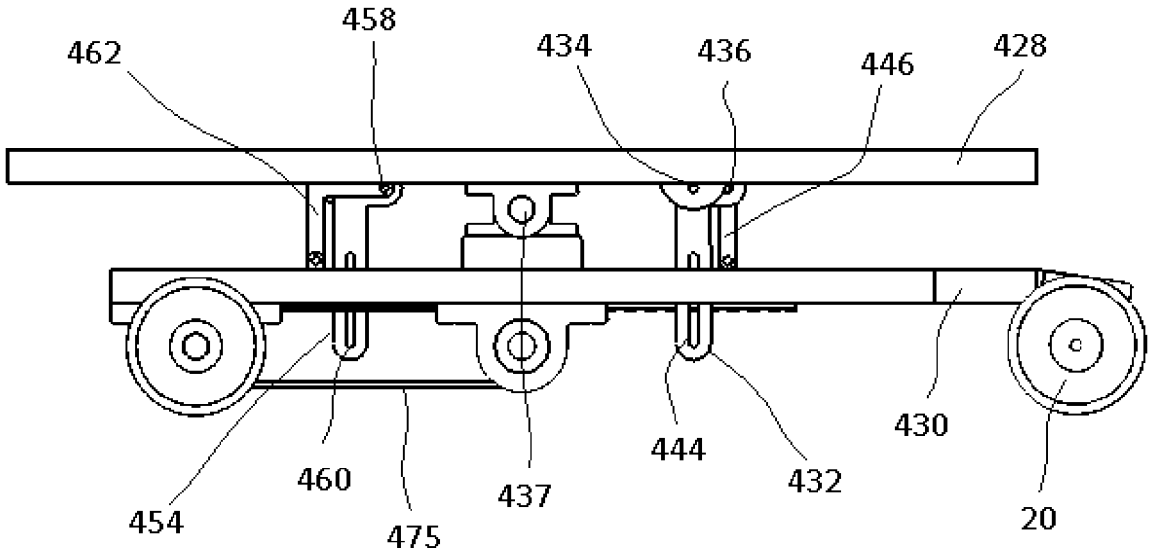
FIGS. 55-57 depict the rotation powered vehicle embodiment of FIG. 51 undergoing a first power cycle.
Figure 56:
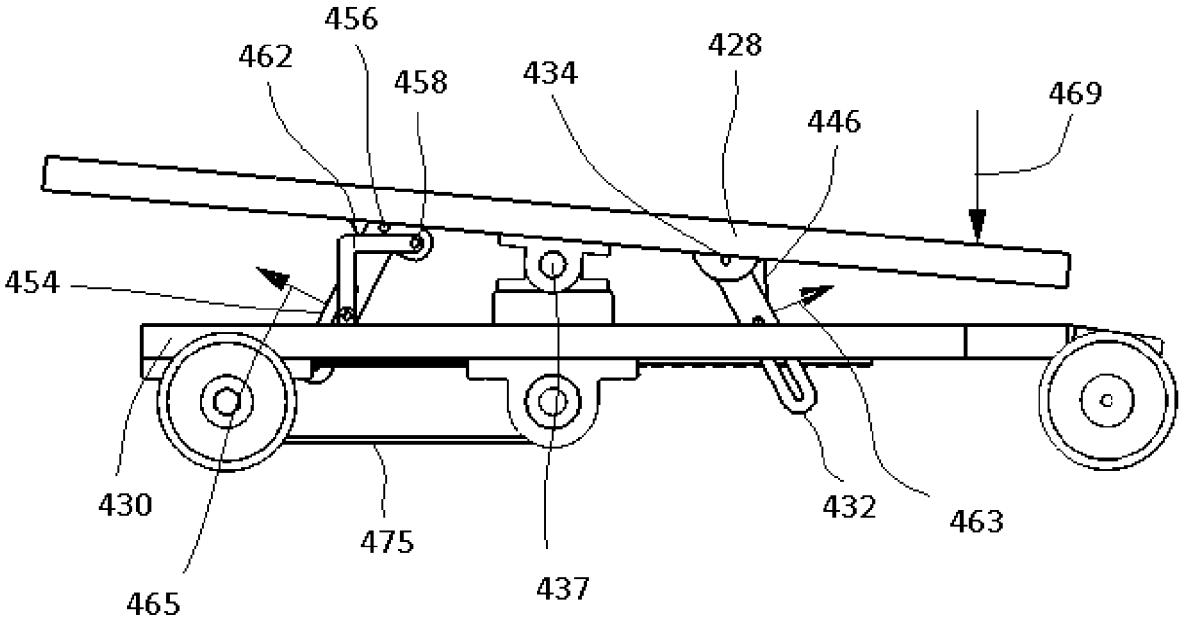
Figure 57:
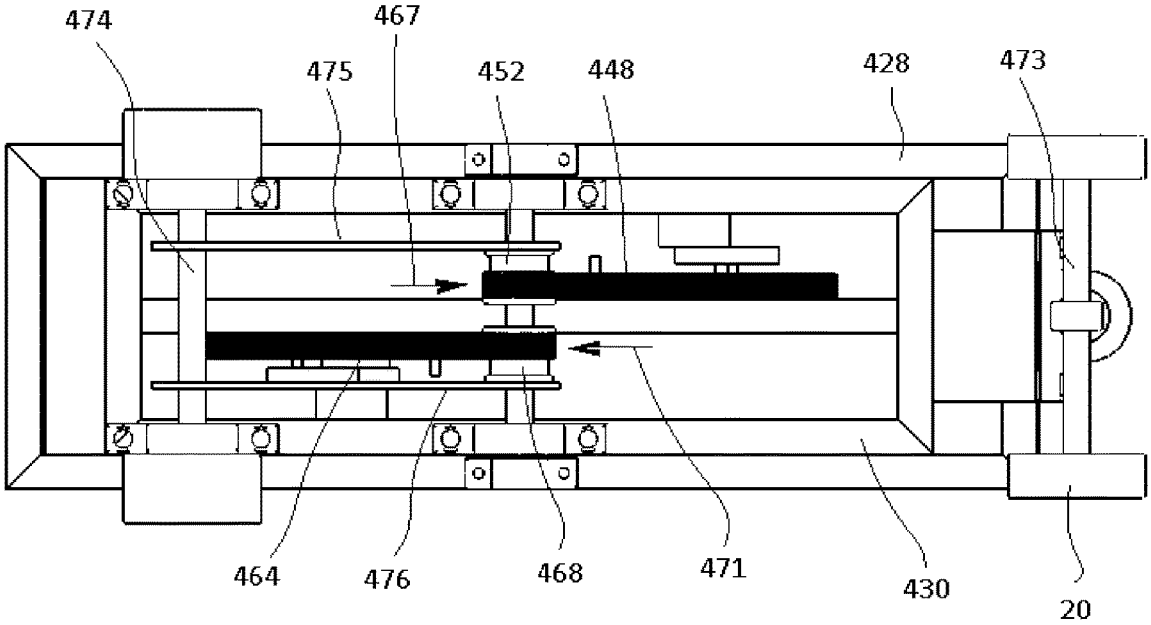
Figure 58:
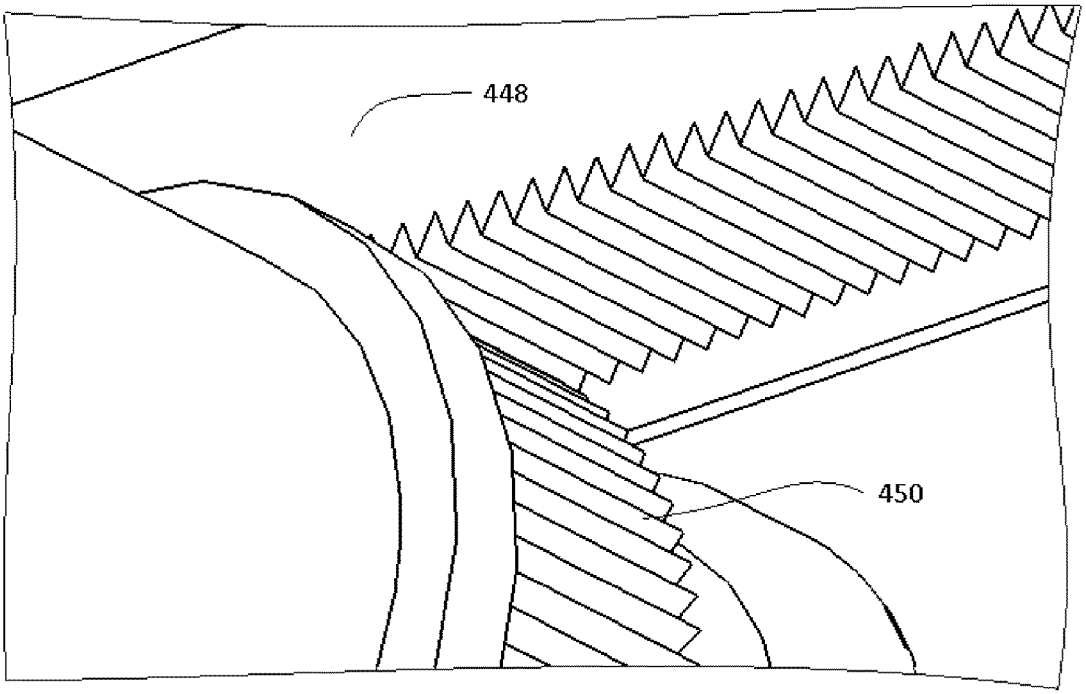
FIG. 58 a rack operatively engaged with a gear, both of rotation powered vehicle embodiment of FIG. 51.
Figure 59:
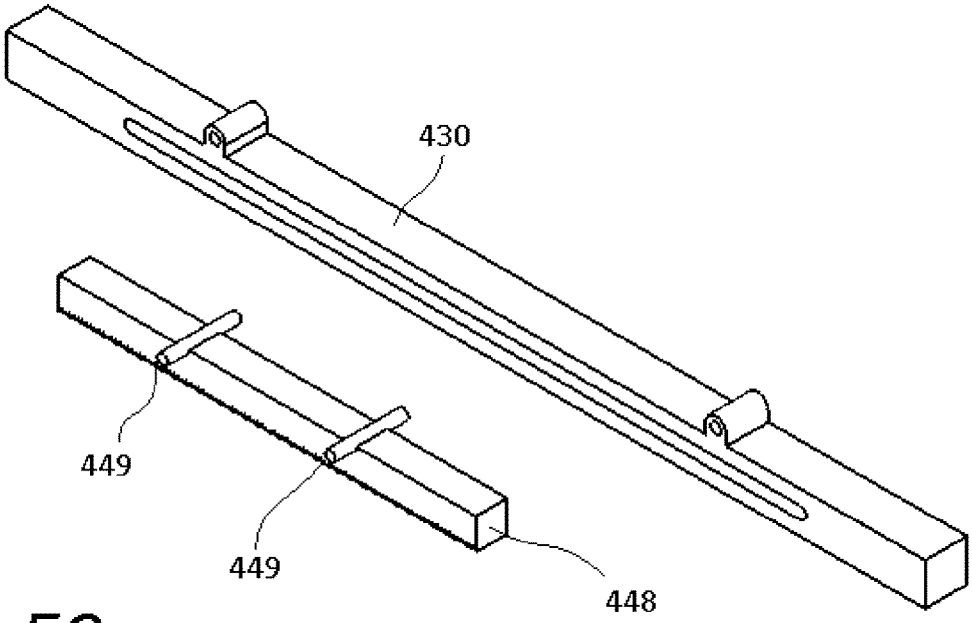
FIGS. 59 and 60 show a rack and a portion of a chassis, and the rack slidably disposed on the portion of the chassis respectively.
Figure 60:
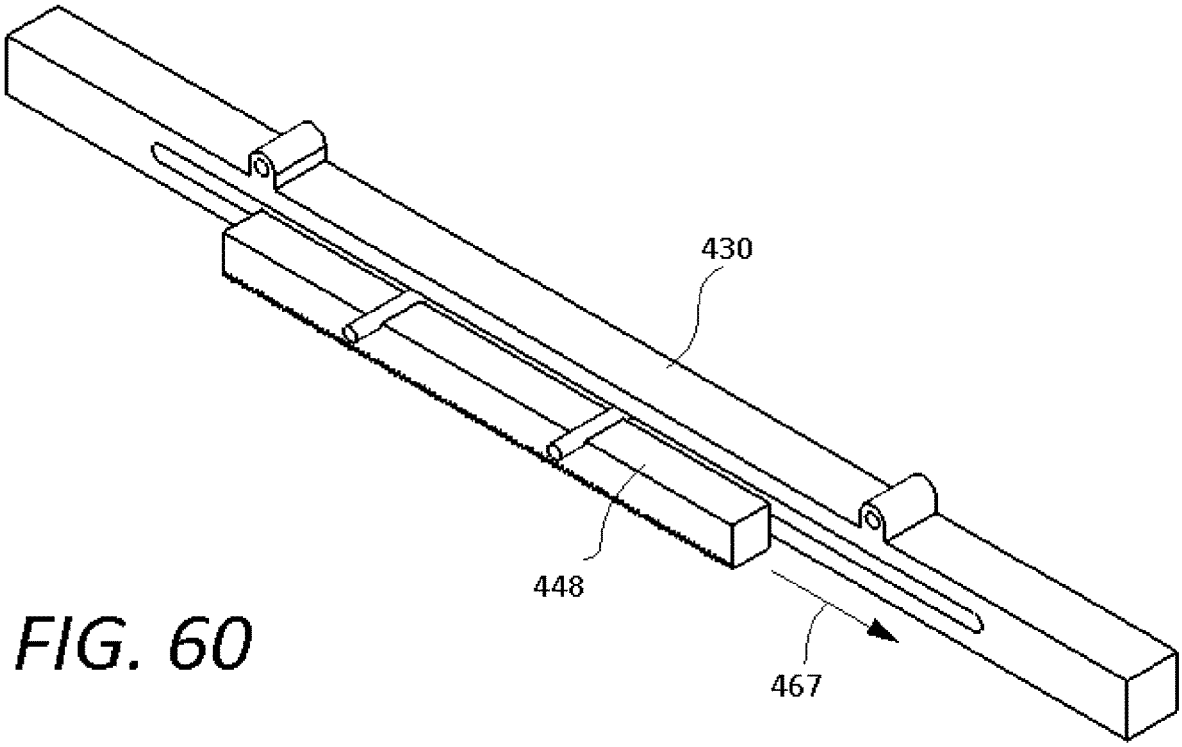

FIGS. 55-57 depict a first half power cycle of the rotation powered vehicle 426 of FIG. 51. FIG. 56 depicts a rotation of the platform 426 in the first angular direction about the platform pivot section 437 by the application of a force 469. This rotates the first linkage 432 in the second angular direction (as indicated by arrow 463) which in turn translates the first rack 448 (as indicated by arrow 467) over the first gear 450 as shown in FIG. 58. Simultaneously, the second linkage 454 rotates in the first angular direction as indicated by arrow 465 and moves the second rack 464 as indicated by arrow 471. As the first gear 450 rotates in the first angular direction it engages the first ratchet 452 which also rotates in the first angular direction. The rotation of the first ratchet 452 in the first angular direction in turn rotates the drive axle 474 in the first angular direction. This results in the translation of the rotation powered vehicle 426 in the first linear direction. FIGS. 59 and 60 depict how the first rack 448 may be slidably disposed along a section of the chassis 430, as first rack pins 449 are inserted into a chassis slot 470.

Figure 61:
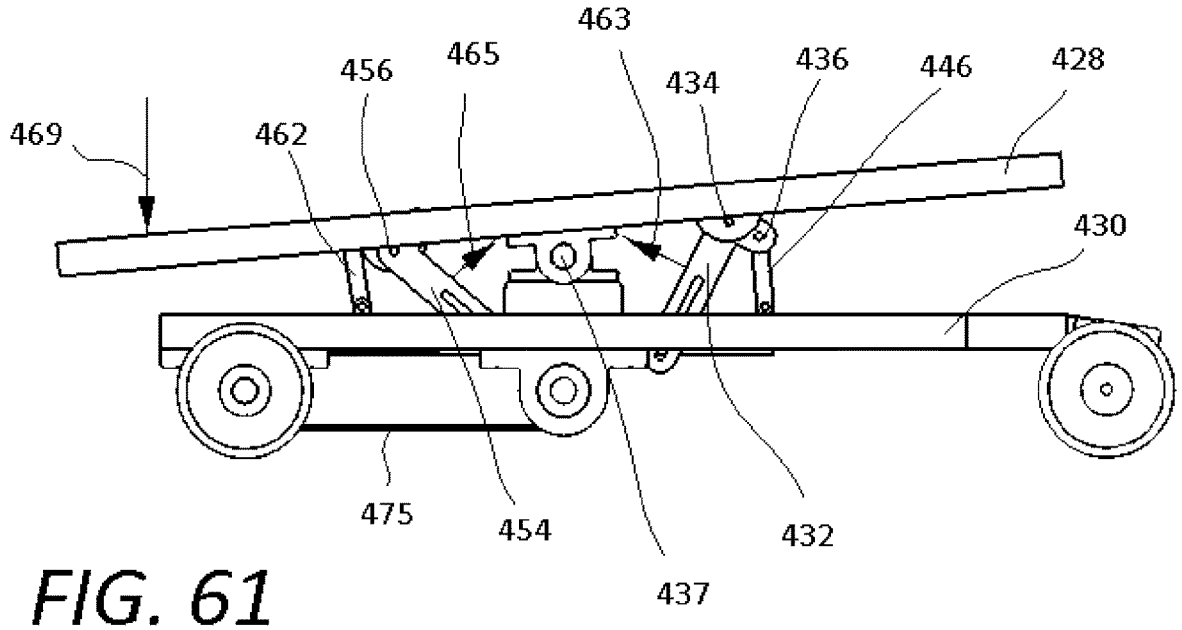
FIGS. 61 and 62 depict the rotation powered vehicle embodiment of FIG. 51 undergoing a second power cycle.
Figure 62:
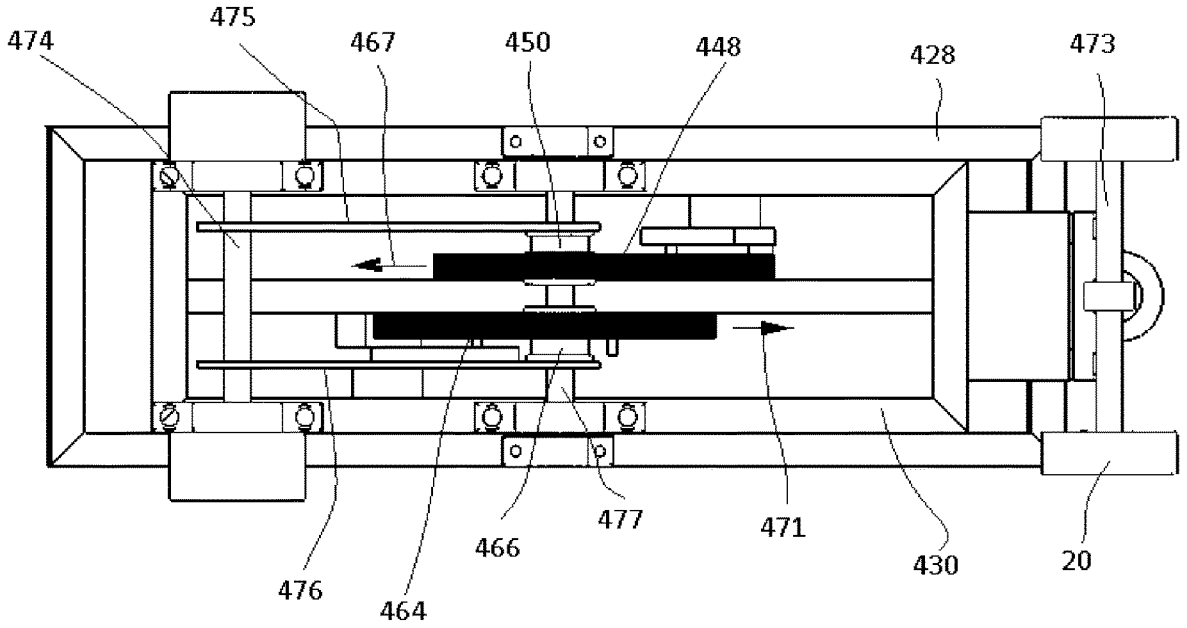

FIGS. 61 and 62 depict a second half power cycle of the rotation powered vehicle 426. FIG. 61 depicts a rotation of the platform 428 in the second angular direction about the platform pivot point 437 by the application of a force 469. This rotates the second linkage 454 in the second angular direction (as indicated by arrow 465) which in turn translates the second rack 464 (as indicated by arrow 471) over the second gear 466 as shown in FIG. 62. Simultaneously, the first linkage 432 rotates in the first angular direction (as indicated by arrow 463) and causes the first rack 448 to move as indicated by arrow 467 in FIG. 62. As the second gear 466 rotates in the first angular direction it engages the second ratchet 468 which also rotates in the second angular direction. The rotation of the second ratchet 468 in the first angular direction in turn rotates the drive axle 474 in the second angular direction. This results in the translation of the rotation powered vehicle 426 in the first linear direction. Other embodiments of the rotation powered vehicle described above may include embodiments which are configured such that the first linkage 432 and the second linkage 454 rotate in the same direction during a given half power cycle.

Figure 63:
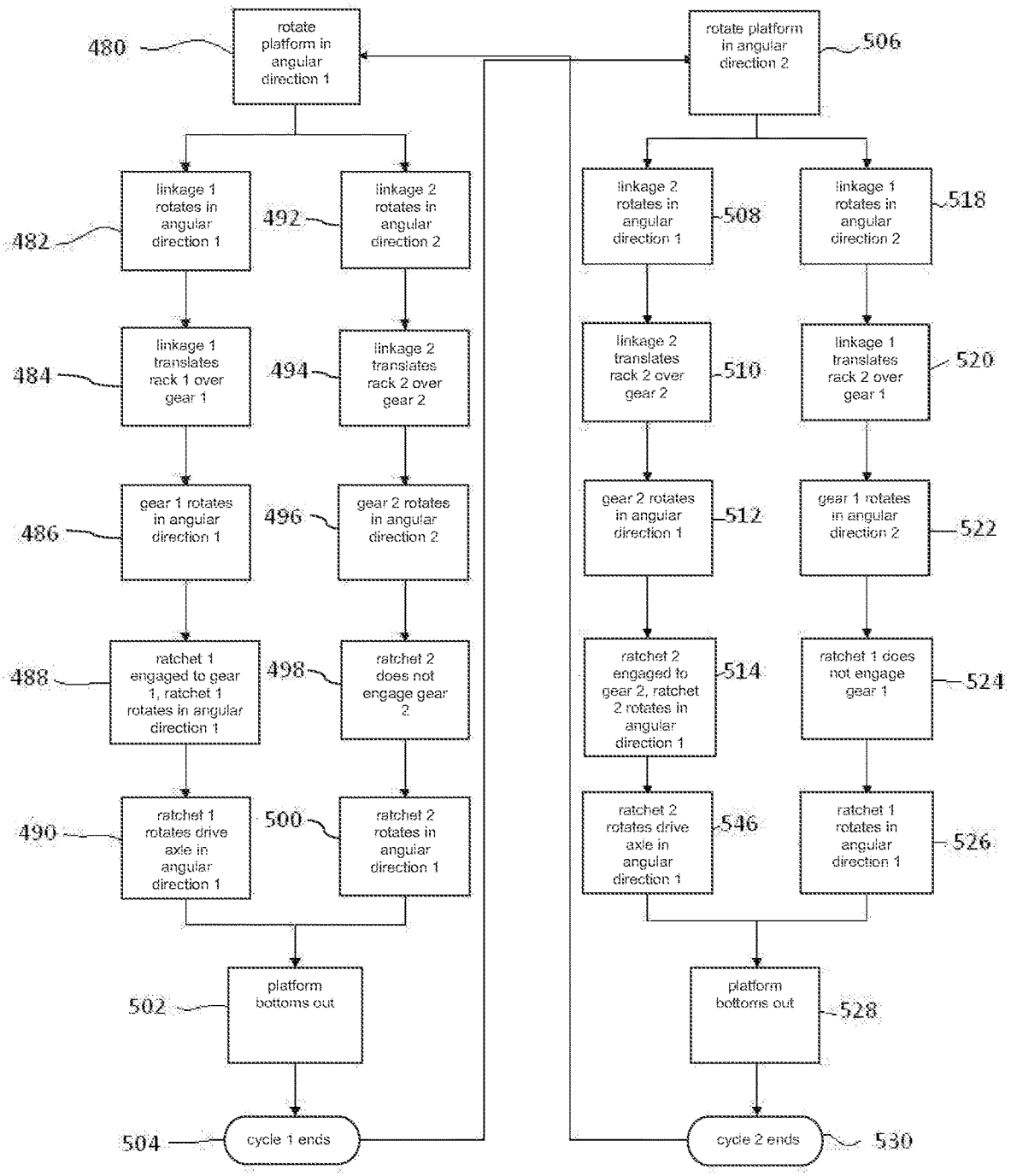
FIG. 63 is a flowchart which depicts the a first power cycle and a second power cycle for the powered vehicle embodiment of FIG. 51.

FIG. 63 is a flowchart which depicts the method described above for carrying out a power cycle of the rotation powered vehicle 426. Boxes 480-504 depict the method steps first half power cycle and boxes 506-530 depict the method steps for the second half power cycle.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A method for propelling a rotation powered vehicle, comprising:

performing a series of power cycles, each power cycle comprising:

A. performing a first half power cycle comprising:

(i) rotating a platform which is pivotally secured to a chassis in a first angular direction;

(ii) rotating a first linkage which is pivotally secured to the platform at a first pivot point and which is engaged with a first coupler link which is pivotally secured to the first linkage at a second pivot point and which is pivotally secured to the chassis, the rotation of the first linkage being caused by the rotation of the platform in the first angular direction as constrained by the first and second pivot points;

(iii) translating a first rack which is slidably coupled to the chassis and which is operatively engaged with a first gear over the first gear, the first rack being coupled to the first linkage by a first rack pin which is slidably disposed within a first rack slot, the first gear being coupled to a first ratchet which is configured to engage the first gear when the first gear is rotated by the first rack in the first angular direction and the first ratchet being configured not to engage the first gear when the first gear rotates in the second angular direction;

(iv) rotating a drive axle which is coupled to the first ratchet and a first wheel and a second wheel which are coupled to the drive axle in the first angular direction thereby propelling the rotation powered vehicle in a first linear direction; and B. performing a second half power cycle comprising:

(i) rotating the platform which is pivotally secured to the chassis in a second angular direction;

(ii) rotating a second linkage which is pivotally secured to the platform at a third pivot point and which is engaged with a second coupler link which is pivotally secured to the second linkage at a fourth pivot point and which is pivotally secured to the chassis, the rotation of the second linkage being caused by the rotation of the platform in the second angular direction as constrained by the third and fourth pivot points;

(iii) translating a second rack which is slidably coupled to the chassis and which is operatively engaged with a second gear over the second gear, the second rack being coupled to the second linkage by a second rack pin which is slidably disposed within a second rack slot, the second gear being coupled to a second ratchet which is configured to engage the second gear when the second gear is rotated by the second rack in the first angular direction and the second ratchet being configured not to engage the second gear when the second gear rotates in the second angular direction; and (iv) rotating the drive axle which is coupled to the first ratchet and the first wheel and the second wheel which are coupled to the drive axle in the first angular direction thereby propelling the rotation powered vehicle in the first linear direction.

2. The method of claim 1 further comprising rotating a front axle which is pivotally secured to the chassis to steer the rotation powered vehicle.

3. The method of claim 2 further comprising rotating the platform third angular direction in order to steer the rotation powered device toward a third linear direction.

4. The method of claim 2 further comprising rotating the platform fourth angular direction in order to steer the rotation powered device toward a fourth linear direction.

5. The method of claim 1 wherein the first ratchet is attached to the drive axle by a first chain and the second ratchet is attached to the drive axle by a second chain.

6. The method of claim 1 wherein the first ratchet is attached to the drive axle by a first belt and the second ratchet is attached to the drive axle by a second belt.

7. The method of claim 1 wherein the first linkage and the second linkage rotate in the same angular direction during a first half power cycle and during a second half power cycle.

8. The method of claim 1 wherein the first linkage and the second linkage rotate in different angular directions during a first half power cycle and during a second half power cycle.

9. The method of claim 1 wherein the platform is separated from the chassis by a distance of about 1 inch to about 6 inches.

10. The method of claim 1 wherein the first and second pivot points are separated by a distance of about 0.5 inches to about 3 inches and the third and second pivot points are separated by a distance of about 0.5 inches to about 3 inches.

* * * * *